US012138513B2

(12) United States Patent
Willmott et al.

(10) Patent No.: US 12,138,513 B2
(45) Date of Patent: Nov. 12, 2024

(54) GOLF CLUB HEADS WITH A MULTI-MATERIAL STRIKING SURFACE

(71) Applicant: KARSTEN MANUFACTURING CORPORATION, Phoenix, AZ (US)

(72) Inventors: James D. Willmott, Loughborough (GB); Erik M. Henrikson, Phoenix, AZ (US); David A. Higdon, Cave Creek, AZ (US); Cole D. Brubaker, Scottsdale, AZ (US); Anthony D. Serrano, Anthem, AZ (US); John A. Solheim, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 17/516,931

(22) Filed: Nov. 2, 2021

(65) Prior Publication Data

US 2022/0054904 A1 Feb. 24, 2022

Related U.S. Application Data

(63) Continuation of application No. 16/983,970, filed on Aug. 3, 2020, now Pat. No. 11,161,022, which is a (Continued)

(51) Int. Cl.
*A63B 53/04* (2015.01)
*A63B 53/06* (2015.01)

(52) U.S. Cl.
CPC ..... *A63B 53/0487* (2013.01); *A63B 53/065* (2013.01); *A63B 53/0408* (2020.08);

(Continued)

(58) Field of Classification Search
CPC .... A63B 2053/0425; A63B 2053/0429; A63B 2053/042; A63B 2053/0416; A63B 53/0458; A63B 53/0487

(Continued)

(56) References Cited

U.S. PATENT DOCUMENTS 1,854,548 A 4/1932 Hunt
1,965,954 A * 7/1934 Davis ..... A63B 60/00 473/331

(Continued)

FOREIGN PATENT DOCUMENTS

GB 2293982 4/1996
JP 09047532 2/1997

(Continued)

OTHER PUBLICATIONS

International Search Report and Written Opinion for PCT Application No. PCT/US2018/045443 dated Dec. 11, 2018, filed Jun. 8, 2018.

(Continued)

*Primary Examiner* — Raeann Gorden

(57) ABSTRACT

Embodiments of putter-type golf club head comprising a striking surface capable of achieving consistent ball speeds across the striking surface to account for various ball impact locations are described herein. The striking surface has at least two materials that differs in concentration away from the geometric center of the striking surface to provide this consistency. Consistent (or uniform) ball speed is achieved throughout the striking surface as the portion of the golf ball that contacts the striking surface interacts with at least two materials having a differing material characteristic.

17 Claims, 17 Drawing Sheets

Related U.S. Application Data continuation-in-part of application No. 16/056,391, filed on Aug. 6, 2018, now Pat. No. 11,083,938, which is a continuation-in-part of application No. 15/962,969, filed on Apr. 25, 2018, now Pat. No. 10,583,338, which is a continuation of application No. 15/236,112, filed on Aug. 12, 2016, now Pat. No. 9,987,530, which is a continuation-in-part of application No. 14/529,590, filed on Oct. 31, 2014, now Pat. No. 9,849,351, which is a continuation-in-part of application No. 14/196,313, filed on Mar. 4, 2014, now Pat. No. 9,452,326, which is a continuation-in-part of application No. 13/761,778, filed on Feb. 7, 2013, now Pat. No. 8,790,193, which is a continuation of application No. 13/628,685, filed on Sep. 27, 2012, now Pat. No. 9,108,088.

(60) Provisional application No. 63/046,505, filed on Jun. 30, 2020, provisional application No. 62/881,463, filed on Aug. 1, 2019, provisional application No. 62/541,445, filed on Aug. 4, 2017, provisional application No. 62/277,358, filed on Jan. 11, 2016, provisional application No. 62/268,011, filed on Dec. 16, 2015, provisional application No. 62/233,099, filed on Sep. 25, 2015, provisional application No. 62/205,550, filed on Aug. 14, 2015, provisional application No. 61/697,994, filed on Sep. 7, 2012, provisional application No. 61/541,981, filed on Sep. 30, 2011.

(52) U.S. Cl.
CPC ..... *A63B 53/0416* (2020.08); *A63B 53/0425* (2020.08); *A63B 53/0429* (2020.08); *A63B 53/0445* (2020.08); *A63B 53/0466* (2013.01); *A63B 53/047* (2013.01); *Y10T 29/49* (2015.01)

(58) Field of Classification Search
USPC ..... 473/342
See application file for complete search history.

(56) References Cited

U.S. PATENT DOCUMENTS 3,659,855 A 5/1972 Hardesty
D240,949 S 8/1976 Jones
4,508,349 A 4/1985 Gebaur et al.
4,550,914 A 11/1985 McCallister
4,749,197 A 6/1988 Orlowski
4,753,440 A 6/1988 Chorne
4,792,140 A 12/1988 Yamaguchi et al.
4,858,929 A 8/1989 Long
4,884,808 A 12/1989 Retzer
5,090,702 A 2/1992 Viste
5,141,231 A 8/1992 Cox
5,255,918 A 10/1993 Anderson
5,282,624 A 2/1994 Viste
5,354,049 A 10/1994 Stuff
5,358,249 A 10/1994 Mendralla
5,423,535 A 6/1995 Shaw
5,458,332 A 10/1995 Fisher
5,472,201 A 12/1995 Aizawa
5,505,450 A 4/1996 Stuff
5,531,439 A 7/1996 Azzarella
5,591,092 A 1/1997 Gilbert
5,601,501 A 2/1997 Kobayashi
5,611,742 A 3/1997 Kobayashi
5,637,044 A * 6/1997 Swash ..... A63B 53/0487 473/331
5,643,099 A 7/1997 Solheim
5,676,605 A 10/1997 Kobayashi
5,688,186 A 11/1997 Michaels
5,690,561 A 11/1997 Rowland
5,709,617 A 1/1998 Nishimura
5,711,722 A 1/1998 Miyajima et al.
5,735,755 A 4/1998 Kobayashi
5,755,626 A 5/1998 Shira
5,762,566 A 6/1998 King et al.
5,766,087 A 6/1998 Kawamatsu
6,200,229 B1 3/2001 Grace
6,224,497 B1 5/2001 Antonious
6,227,986 B1 5/2001 Fisher
6,257,994 B1 7/2001 Antonious
6,273,831 B1 8/2001 Dewanjee
6,322,459 B1 11/2001 Nishimura
6,336,869 B1 1/2002 Hettinger
6,398,665 B1 6/2002 Antonious
6,406,379 B1 6/2002 Christensen
6,478,690 B2 11/2002 Helmstetter
6,488,594 B1 12/2002 Card
6,554,721 B1 4/2003 Woodward
6,592,467 B1 7/2003 Gray
D481,432 S 10/2003 Greene
6,699,140 B1 3/2004 Sun
6,710,287 B2 3/2004 Lu
6,719,644 B2 4/2004 Erb
6,719,645 B2 4/2004 Kouno
D490,129 S 5/2004 Greene
6,743,117 B2 6/2004 Gilbert
6,875,124 B2 4/2005 Gilbert
7,018,303 B2 3/2006 Yamamoto
7,056,226 B2 6/2006 Kennedy
7,066,833 B2 6/2006 Yamamoto
7,101,290 B2 9/2006 Tucker, Sr.
7,163,467 B1 1/2007 Chang et al.
7,179,175 B2 2/2007 Kennedy, III
7,261,644 B2 8/2007 Burrows
7,273,422 B2 9/2007 Vokey et al.
7,285,057 B2 10/2007 Mann, Jr.
7,341,527 B1 3/2008 Fisher
7,364,513 B2 4/2008 Krumme
7,413,517 B2 8/2008 Butler, Jr.
7,431,662 B2 10/2008 Tucker, Sr.
7,442,129 B2 10/2008 Bardha
7,455,597 B2 11/2008 Matsunaga
7,473,186 B2 1/2009 Best
D588,922 S * 3/2009 Hagleitner ..... D9/534
7,500,923 B2 3/2009 Tateno
D596,687 S 7/2009 Bezilla et al.
7,566,276 B2 7/2009 Billings
7,568,983 B2 8/2009 Gilbert
7,588,499 B2 9/2009 Tateno
7,594,863 B2 9/2009 Ban
D603,009 S 10/2009 Bezilla et al.
7,604,550 B1 10/2009 Currie
D605,242 S 12/2009 Franklin
7,662,049 B2 2/2010 Liu et al.
7,691,006 B1 4/2010 Burke
D615,140 S 5/2010 Franklin
7,717,801 B2 5/2010 Franklin
7,749,098 B2 7/2010 Johnson
7,749,099 B2 7/2010 Ban et al.
7,758,449 B2 7/2010 Gilbert et al.
7,780,548 B2 8/2010 Solheim
7,794,335 B2 9/2010 Cole et al.
7,806,779 B2 10/2010 Franklin
7,819,756 B2 10/2010 Ban et al.
7,862,450 B2 1/2011 Gilbert et al.
7,905,797 B2 3/2011 Gilbert
7,914,394 B2 3/2011 Cole et al.
7,922,602 B2 4/2011 Johnson
7,942,758 B2 5/2011 Nakamura
D639,879 S 6/2011 Lee
8,012,035 B2 9/2011 Franklin
8,021,245 B2 9/2011 Beach
8,033,931 B2 10/2011 Wahl
8,066,586 B2 11/2011 Solheim et al.
8,083,605 B2 12/2011 Franklin
8,216,081 B2 * 7/2012 Snyder ..... A63B 53/04 473/331

(56) References Cited

U.S. PATENT DOCUMENTS

| | | | | |
|---|---|---|---|---|
| 8,282,505 | B2 | 10/2012 | Solheim | |
| 8,287,401 | B2 | 10/2012 | Tateno | |
| 8,292,754 | B2 | 10/2012 | Snyder | |
| 8,353,780 | B2 | 1/2013 | Hatton | |
| 8,382,604 | B2 | 2/2013 | Billings | |
| 8,425,342 | B2 | 4/2013 | Snyder | |
| 8,480,513 | B2 | 7/2013 | Kuan | |
| 8,545,343 | B2 | 10/2013 | Boyd | |
| 8,579,717 | B2 | 11/2013 | Snyder | |
| 8,617,001 | B2 | 12/2013 | Sandival | |
| 8,636,607 | B2 | 1/2014 | Renna | |
| 8,641,549 | B2 | 2/2014 | Stites | |
| 8,641,556 | B2 | 2/2014 | Kuan | |
| 8,747,245 | B2 | 6/2014 | Franklin | |
| 8,764,578 | B2 | 7/2014 | Solheim | |
| 8,790,193 | B2 | 7/2014 | Serrano et al. | |
| 8,814,715 | B2 | 8/2014 | Franklin | |
| 8,834,285 | B2 | 9/2014 | Franklin | |
| 8,900,064 | B2 | 12/2014 | Franklin | |
| 8,961,334 | B2 * | 2/2015 | Franklin | A63B 60/02 473/331 |
| 9,022,876 | B2 * | 5/2015 | Snyder | A63B 53/08 473/331 |
| 9,108,088 | B2 | 8/2015 | Serrano | |
| 9,144,717 | B2 | 9/2015 | Franklin | |
| 9,452,326 | B2 | 9/2016 | Serrano et al. | |
| 9,545,547 | B1 | 1/2017 | Abbott | |
| 9,561,407 | B2 | 2/2017 | Serrano et al. | |
| 9,694,260 | B1 | 7/2017 | Abbott | |
| 9,849,351 | B2 | 12/2017 | Serrano | |
| 9,849,358 | B2 | 12/2017 | Franklin | |
| 9,889,353 | B2 | 2/2018 | Philip | |
| 9,943,735 | B2 | 4/2018 | Rife | |
| 9,987,530 | B2 | 6/2018 | Jertson | |
| 10,092,802 | B2 | 10/2018 | Serrano | |
| 10,398,947 | B2 | 9/2019 | Serrano | |
| 10,653,931 | B2 | 5/2020 | Philip | |
| 11,083,938 | B2 | 8/2021 | Wang | |
| 2005/0009623 | A1 | 1/2005 | Dickinson | |
| 2007/0149311 | A1 | 6/2007 | Wright | |
| 2007/0243949 | A1 | 10/2007 | Solari | |
| 2008/0234066 | A1 | 9/2008 | Jones | |
| 2009/0156328 | A1 | 6/2009 | Reese | |
| 2010/0087269 | A1 * | 4/2010 | Snyder | A63B 60/00 473/331 |
| 2011/0165963 | A1 | 7/2011 | Cackett | |
| 2012/0071269 | A1 | 3/2012 | Rahrig | |
| 2016/0016050 | A1 * | 1/2016 | Rife | A63B 53/0487 473/331 |
| 2017/0239534 | A1 | 8/2017 | Rife | |
| 2018/0200588 | A1 | 7/2018 | Rife | |

FOREIGN PATENT DOCUMENTS

| | | |
|---|---|---|
| JP | H0975486 | 3/1997 |
| JP | 2813969 | 10/1998 |
| JP | H10263118 | 10/1998 |
| JP | 11047317 | 2/1999 |
| JP | 2000176058 | 6/2000 |
| JP | 2002153575 | 5/2002 |
| JP | 2002239040 | 8/2002 |
| JP | 2003000776 | 1/2003 |
| JP | 2005287534 | 10/2005 |
| JP | 3901788 | 4/2007 |

OTHER PUBLICATIONS

International Search Report and Written Opinion for PCT Application No. PCT/US2020/044782 dated Oct. 16, 2020, filed Aug. 3, 2020.

Vintage Rare Lilac Bros. No Scuff Putter Dearborn Mich., https://www.worthpoint.com/worthopedia/vintage-lilac-bros-scuff-putter-46140117, Nov. 19, 2012.

Putter, Laser Light By Clayton, https://www.worthpoint.com/worthopedia/putter-laser-light-clayton-151457342, May 6, 2011.

Never Comprise Milled Series, https://forums.golfwrx.com/discussion/2491/never-compromise-milled-series, Jun. 30, 2005.

International Search Report and Written Opinion dated Jan. 14, 2016 for PCT Application No. PCT/US2015/058127, filed Oct. 29, 2015.

International Search Report and Written Opinion dated Jun. 5, 2016 for PCT Application No. PCT/US2015/018813, filed Mar. 4, 2015.

Jeffery B. Ellis, The Club Maker's Art, Antique Golf Clubs and Their History, vol. 1, p. 253, C and C Offset Printing Co., Ltd. (Portland, Oregon 2007).

Truth Digest MyGolfSpy, Machine M2A Converter Putter—Part 1, The Story and The Putter, https://forum.mygolfspy.com/topic/4634-machine-m2a-converter-putter-%C3%A2%E2%82%AC%E2%80%9C-part-1-%C3%A2%E2%82%AC%E2%80%9C-the-story-and-the-putter/, Nov. 2011.

Dave Billings' Golf Locker—Tales and Treasure from 25 years in Golf, http://daveysgolflocker.blogspot.com/, Oct. 5, 2012.

Machine Putters Picture Thread, https://forums.golfwrx.com/discussion/171701/machine-putters-picture-thread/p4, Jan. 9, 2007.

Machine Putters Picture Thread, https://forums.golfwrx.com/discussion/171701/machine-putters-picture-thread/p10, Feb. 1, 2007.

Machine Putters Picture Thread, https://forums.golfwrx.com/discussion/171701/machine-putters-picture-thread/p31, Sep. 6, 2009.

International Search Report and Written Opinion for PCT Application No. PCT/US2012/057503 dated Feb. 27, 2013, filed Sep. 27, 2012.

International Search Report and Written Opinion for PCT Application No. PCT/US2016/046866 dated Oct. 28, 2016, filed Aug. 12, 2016.

* cited by examiner

GOLF CLUB HEADS WITH A MULTI-MATERIAL STRIKING SURFACE

TECHNICAL FIELD

This disclosure relates generally to golf club heads and more particularly to a putter-type golf club head with a multi-material striking surface.

RELATED APPLICATION DATA

This is a continuation of U.S. patent application Ser. No. 16/983,970, filed on Aug. 3, 2020, which claims the benefit of U.S. Provisional Patent Application No. 62/881,463, filed on Aug. 1, 2019, and U.S. Provisional Patent Application No. 63/046,505, filed on Jun. 30, 2020. U.S. patent application Ser. No. 16/983,970 is also a continuation in part of U.S. patent application Ser. No. 16/056,391, filed on Aug. 6, 2018, and is issued as U.S. Pat. No. 11,083,938 on Aug. 10, 2021, which claims the benefit of U.S. Provisional Patent Application No. 62/541,445 filed on Aug. 4, 2017. U.S. patent application Ser. No. 16/056,391 is a continuation in part of U.S. patent application Ser. No. 15/962,969 filed on Apr. 25, 2018, and is issued as U.S. Pat. No. 10,583,338 on Mar. 10, 2020, which is a continuation of U.S. patent application Ser. No. 15/236,112 filed on Aug. 12, 2016, and is issued as U.S. Pat. No. 9,987,530 on Jun. 5, 2018, which claims the benefit of U.S. Provisional Patent Application No. 62/277,358 filed on Jan. 11, 2016, U.S. Provisional Patent Application No. 62/268,011 filed on Dec. 16, 2015, U.S. Provisional Patent Application No. 62/233,099 filed on Sep. 25, 2015, and U.S. Provisional Patent Application No. 62/205,550 filed on Aug. 14, 2015. U.S. patent application Ser. No. 15/236,112 is a continuation in part of U.S. patent application Ser. No. 14/529,590 filed on Oct. 31, 2014, and issued as U.S. Pat. No. 9,849,351 on Dec. 26, 2017, which is a continuation in part of U.S. patent application Ser. No. 14/196,313 filed on Mar. 4, 2013, and issued as U.S. Pat. No. 9,452,326 on Sep. 27, 2016, which is a continuation in part of U.S. patent application Ser. No. 13/761,778 filed on Feb. 27, 2013, and issued as U.S. Pat. No. 8,790,193 on Jul. 29, 2014, which is a continuation of U.S. patent application Ser. No. 13/628,685 filed on Sep. 27, 2012 and issued as U.S. Pat. No. 9,108,088 on Aug. 18, 2015, which claims the benefit of U.S. Provisional Patent Application No. 61/697,994 on Sep. 7, 2012 and U.S. Provisional Patent Application No. 61/541,981 filed on Sep. 30, 2011, the contents of all of which are entirely incorporated herein by reference.

BACKGROUND

As golf clubs are the sole instruments that set golf balls in motion during play, the golf industry has seen improvements in putters and golf club head designs in recent years. However, it is known, that when it comes to designing putter-type club heads, golfers tend to prioritize personal preference characteristics (i.e. club head feel, club head aesthetics, club head sound etc.) over performance.

To putt a golf ball in the hole, a golfer must successfully impact the golf ball (with a golf club head and more particularly a putter-type golf club head) at a proper speed and face angle. This provides a challenge to all golfers, as many struggle to consistently impact the golf ball at the same location putt after putt. Striking the golf ball at various locations on the putter-type club head can alter the amount of energy transferred from the putter head to the golf ball during initial contact, impact feel, impact sound and/or travel direction of the golf ball. There is a need in the art to create a putter-type golf club head that balances golfers' personal preference characteristics while considering various impact locations.

DESCRIPTION

Figure 1:
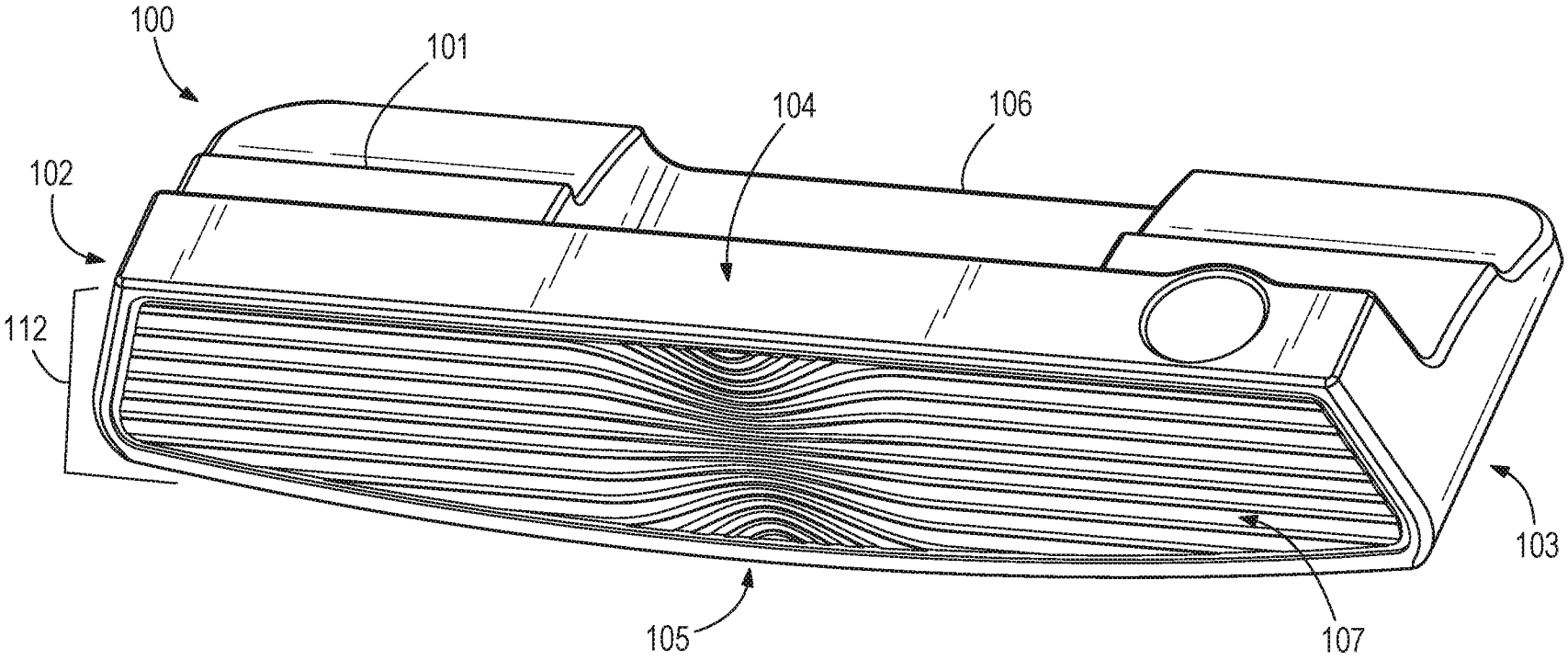
FIG. 1 shows a heel side perspective view of a striking surface having continuous grooves for a non-insert style club head according to one embodiment.

Directed herein are golf club heads, and in particular, a putter-type golf club heads comprising a striking surface capable of achieving consistent ball speeds across the striking surface to account for various ball impact locations. This striking surface has at least two materials that differs in concentration away from the geometric center (or center region) of the striking surface to provide this consistency. Consistent (or uniform) ball speed is achieved throughout the striking surface as the portion of the golf ball that contacts the striking surface interacts with at least two materials having a differing material property (or characteristic).

The differing material property can be (but not an exhaustive list of) tensile strength, flexural modulus, or material hardness. A uniform ball speed is accomplished by the combination of a dual material striking surface and varying the amount of the first material and/or the second material away from the geometric center (or center region) of the striking surface. In many embodiments, the first and second material cooperate to form a softer, more flexible center region and opposing the center region either in a heel or toe direction, the first and second material cooperate to form a harder, stiffer, and less flexible region. This is because contact outside the geometric center of the striking surface (or club head sweet spot) results in less energy transfer from the club head to the golf ball.

Creating a center region that is less responsive than the corresponding heel and toe regions can be accomplished in many ways. For example, in embodiments, where a first soft material dominates a less soft second material, a less responsive center region can be formed. In other embodiments, a less responsive center region can be formed by controlling the void and/or recess patterns to form larger first material land areas at the center region than at adjacent heel and toe regions.

The term or phrase "lie angle" used herein can be defined as being the angle between a golf shaft (not shown) and a playing surface once the sole contacts the playing surface. The lie angle of a golf club head can also be referred to as the angle formed by the intersection of the centerline of the golf shaft and the playing surface when the sole of the golf club head is resting on the playing surface.

The term or phrase "integral" used herein can be defined as two or more elements if they are comprised of the same piece of material. As defined herein, two or more elements are "non-integral" if each element is comprised of a different piece of material.

The term or phrase "couple", "coupled", "couples", and "coupling" used herein can be defined as connecting two or more elements, mechanically or otherwise. Coupling (whether mechanical or otherwise) can be for any length of time, e.g. permanent or semi-permanent or only for an instant. Mechanical coupling and the like should be broadly understood and include mechanical coupling of all types. The absence of the word "removably," "removable," and the like near the word "coupled," and the like does not mean that the coupling, in question is or is not removable.

The term or phrase "head weight" or "head mass" used herein can be defined as the total mass or weight of the putter.

The term or phrase "attach", "attached", "attaches, and "attaching" used herein can be defined as connecting or being joined to something. Attaching can be permanent or semi-permanent. Mechanically attaching and the like should be broadly understood and include all types of mechanical attachment means. Integral attachment means should be broadly understood and include all types of integral attachment means that permanently connects two or more objects together.

The term or phrase "loft angle" used herein can be defined as the angle between the striking surface and the golf shaft. In other embodiments, the loft angle can be defined herein as such: the striking surface comprises a striking surface center point and a loft plane. The striking surface center point is equidistant from (1) the lower edge and upper edge of the strike face, as well as, (2) equidistant from the heel end and toe end of strike face. The loft plane is tangent to the strike surface of the putter type golf club head. The golf shaft comprises a centerline axis that extends the entire length of the golf shaft. The loft angle is between the centerline axis of the golf shaft and the loft plane of the putter. The loft angle of the putter-type golf club head can also be defined herein as the angle between the striking surface and the golf shaft (not shown) when a centerline of the golf shaft is generally vertical (i.e. forms a generally 90° angle with the playing surface).

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the apparatus, methods, and/or articles of manufacture described herein are, for example, capable of operation in other orientations than those illustrated or otherwise described herein.

The term "center region" can be defined as the region on the striking surface that includes the geometric center. The center region can extend from the upper border of the striking surface to the lower border of the striking surface and have a heel-to-toe span of approximately 0.1 inch, 0.2 inch, 0.3 inch, 0.4 inch, 0.5 inch, 0.6 inch, 0.7 inch, 0.8 inch, 0.9 inch, 1.0 inch, 1.1 inch, 1.2 inch, 1.3 inch, 1.4 inch, 1.5 inch, 1.6 inch, 1.7 inch, 1.8 inch, 1.9 inch, or 2.0 inch.

The term "heel region" can be defined as the region on the striking surface that extends from the heel end of the striking surface (and/or club head) up to the center region heel side border. The term "toe region" can be defined as the region on the striking surface that extends from the toe end of the striking surface (and/or club head) up to the center region toe side border.

"A," "an," "the," "at least one," and "one or more" are used interchangeably to indicate that at least one of the item is present; a plurality of such items may be present unless the context clearly indicates otherwise. All numerical values of parameters (e.g., of quantities or conditions) in this specification, including the appended claims, are to be understood as being modified in all instances by the term "about" whether or not "about" actually appears before the numerical value. "About" indicates that the stated numerical value allows some slight imprecision (with some approach to exactness in the value; about or reasonably close to the value; nearly). If the imprecision provided by "about" is not otherwise understood in the art with this ordinary meaning, then "about" as used herein indicates at least variations that may arise from ordinary methods of measuring and using such parameters. In addition, disclosure of ranges includes disclosure of all values and further divided ranges within the entire range. Each value within a range and the endpoints of a range are hereby all disclosed as separate embodiment. The terms "comprises," "comprising," "including," and "having," are inclusive and therefore specify the presence of stated items, but do not preclude the presence of other items. As used in this specification, the term "or" includes any and all combinations of one or more of the listed items. When the terms first, second, third, etc. are used to differentiate various items from each other, these designations are merely for convenience and do not limit the items.

In many examples as used herein, the term "approximately" can be used when comparing one or more values, ranges of values, relationships (e.g., position, orientation, etc.) or parameters (e.g., velocity, acceleration, mass, temperature, spin rate, spin direction, etc.) to one or more other values, ranges of values, or parameters, respectively, and/or when describing a condition (e.g., with respect to time), such as, for example, a condition of remaining constant with respect to time. In these examples, use of the word "approximately" can mean that the value(s), range(s) of values, relationship(s), parameter(s), or condition(s) are within ±0.5%, ±1.0%, ±2.0%, ±3.0%, ±5.0%, and/or±10.0% of the related value(s), range(s) of values, relationship(s), parameter(s), or condition(s), as applicable.

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways.

Presented herein are putter-type golf club heads comprising a plurality of striking surfaces capable of achieving consistent ball speeds across the striking surface to account for various ball impact locations. In many embodiments, the putter-type golf club head described herein includes a putter body comprising a dual-material striking surface having a first material and a second material. The first and second material varies in concentration away from the geometric center of the striking surface in a heel-to-toe direction to provide consistent ball speeds.

For example, in many embodiments, the proportion (or relationship) between the first material and the second material differs to account for where the ball could impact the striking surface (i.e. towards the toe portion, towards the heel portion, or towards the center portion). Altering the striking surface material relationship directly correlates to the impact efficiency or ball speed produced between the golf club head and the golf ball upon impact.

I. Putter-Type Golf Club Heads

In many of the embodiments described herein, the golf club head is a putter-type golf club head. FIGS. 1-23 illustrates exemplary embodiments of putter-type golf club heads having a multi-material striking surface capable of controlling ball speeds across the striking surface, while accounting for impact feel and impact sound upon ball impact.

2. Loft Angle

In many embodiments, the putter-type golf club head can have a loft angle less than 10 degrees. In many embodiments, the loft angle of the club head can be between 0 and 5 degrees, between 0 and 6 degrees, between 0 and 7 degrees, or between 0 and 8 degrees. For example, the loft angle of the club head can be less than 10 degrees, less than 9 degrees, less than 8 degrees, less than 7 degrees, less than 6 degrees, less than 5 degrees, less than 4 degrees, less than 3 degrees, or less than 2 degrees. For further example, the loft angle of the club head can be 0 degrees, 1 degree, 2 degrees, 3 degrees, 4 degrees, 5 degrees, 6 degrees, 7 degrees, 8 degrees, 9 degrees, or 10 degrees.

3. Weight

In many embodiments, the putter-type golf club head can have a weight that ranges between 320 and 385 grams. In other embodiments, the putter-type golf club head can range between 320 grams-325 grams, 325 grams-330 grams, 330 grams-335 grams, 335 grams-340 grams, 340 grams-345 grams, 345 grams-350 grams, 350 grams-355 grams, 355 grams-360 grams, 360 grams-365 grams, 365 grams-370 grams, 370 grams-375 grams, 375 grams-380 grams, or 380 grams-385 grams. In some embodiments, the weight of the putter-type golf club head can be 320 grams, 321 grams, 322 grams, 323 grams, 324 grams, 325 grams, 326 grams, 327 grams, 328 grams, 329 grams, 330 grams, 331 grams, 332 grams, 333 grams, 334 grams, 335 grams, 336 grams, 337 grams, 338 grams, 339 grams, 340 grams, 341 grams, 342 grams, 343 grams, 344 grams, 345 grams, 346 grams, 347 grams, 348 grams, 349 grams, 350 grams, 351 grams, 352 grams, 353 grams, 354 grams, 355 grams, 356 grams, 357 grams, 358 grams, 359 grams, 360 grams, 361 grams, 362 grams, 363 grams, 364 grams, 365 grams, 366 grams, 367 grams, 368 grams, 369 grams, 370 grams, 371 grams, 372 grams, 373 grams, 374 grams, 375 grams, 376 grams, 377 grams, 378 grams, 379 grams, 380 grams, 381 grams, 382 grams, 383 grams, 384 grams, or 385 grams.

4. Materials

The material of the putter-type golf club head can be constructed from any material used to construct a conventional club head. For example, the material of the putter-type golf club head can be constructed from any one or combination of the following: 8620 alloy steel, S25C steel, carbon steel, maraging steel, 17-4 stainless steel, 1380 stainless steel, 303 stainless steel, stainless steel alloys, or any metal or combination of metals for creating a golf club head. In other embodiments, the putter-type golf club heads can be constructed from non-metal materials such as a thermoplastic polyurethane material, a thermoplastic elastomer, and/or a thermoplastic composite material.

1. Composition and Setup of Putter-Type Golf Club Head

In many embodiments, the putter-type golf club head comprises a club head body (may also be referred to as "body" or "putter body"). The club head body comprises a toe portion, a heel portion, a top rail portion, a sole portion, a striking surface (or a portion of a striking surface), and a rear portion. The striking surface can provide a surface adapted for impact with a golf ball. The rear portion is rearwardly spaced from the striking surface. The sole portion is defined as being between the striking surface and the rear portion and resting on a ground plane (or playing surface) at an address position. The top rail can be formed opposite the sole portion. The striking surface is defined by the sole portion, the top rail portion, a heel portion and a toe portion, which is opposite the heel portion.

As mentioned above, in many embodiments, the putter-type golf club head can be configured to reside in the "address position". Unless other described or stated, the putter-type golf club head is in an address position for all reference measurements, ratios, and/or descriptive parameters. The address position can be referred to as being in a state where (1) the sole portion of the putter-type golf club head rests on the ground plane which contacts and is parallel to a playing surface and/or ground plane and (2) the striking surface is substantially perpendicular to the ground plane and/or playing surface.

2. Striking Surface

In many embodiments, the striking surface can be defined by at least the toe portion, the heel portion, the top rail portion, and the sole portion of the putter body. Further, as previously described, the striking surface can comprise of a multi-material striking surface. For example, the striking surface can include at least a first material and a second material that cooperate such that when a golf ball impacts the striking surface, the golf ball engages with two or more materials (i.e. a first material, a second material, etc.) having unique material characteristics to normalize ball speed across the club head while improving personal preference characteristics for a wide range of individuals (i.e. impact sound and/or impact feel).

In many embodiments, the first material can be softer, more flexible, and more deformable then the second material. In other embodiments, the second material can be harder, less flexible, and less deformable than the first material. In many embodiments, the second material can surround, border, or envelope the first material.

3. Material Characteristic of the First Material

The first material of the striking surface can vary based upon the selection of the second material, as the second material comprises the majority of the striking surface. In many embodiments, the first material can be defined by a predetermined material characteristic (but not limited to) the hardness, the tensile strength, the flexure modulus, or the specific gravity of the material.

The hardness of the first material is generally softer than the hardness of the second material. In many embodiments, the hardness of the first material can have a Shore A value that varies between 30A and 95A. In some embodiments, the hardness of the first material can have a Shore A hardness value between 30A-40A, 40A-50A, 50A-60A, 70A-80A, 80A-90A, or 90A-95A. In alternative embodiments, the hardness of the first material can have a Shore A hardness value between 30A-35A, 35A-40A, 40A-45A, 45A-50A, 50A-55A, 55A-60A, 60A-65A, 65A-70A, 70A-75A, 75A-80A, 80A-85A, 85A-90A, or 90A-95A. In additional embodiments, the hardness of the first material can have a Shore A less than 95A, less than 90A, less than 85A, less than 80A, less than 75A, less than 70A, less than 65A, less than 60A, less than 55A, less than 50A, less than 45A, less than 40A, or less than 35A. In other embodiments, the hardness of the first material can have a Shore A hardness of 30A, 31A, 32A, 33A, 34A, 35A, 36A, 37A, 38A, 39A, 40A, 41A, 42A, 43A, 44A, 45A, 46A, 47A, 48A, 49A, 50A, 51A, 52A, 53A, 54A, 55A, 56A, 57A, 58A, 59A, 60A, 61A, 62A, 63A, 64A, 65A, 66A, 67A, 68A, 69A, 70A, 71A, 72A, 73A, 74A, 75A, 76A, 77A, 78A, 79A, 80A, 81A, 82A, 83A, 84A, 85A, 86A, 87A, 88A, 89A, 90A, 91A, 92A, 93A, 94A, or 95A.

The tensile strength of the first material is generally less than the tensile strength of the second material. The tensile strength of the first material can be between 0.5 MPa and 50 MPa. In many embodiments, the tensile strength of the first material can be between 0.5 MPa to 5.5 MPa, 5.5 MPa to 10.5 MPa, 10.5 MPa to 15.5 MPa, 15.5 MPa to 20.5 MPa, 20.5 MPa to 25.5 MPa, 25.5 MPa to 30.5 MPa, 30.5 MPa to 35.5 MPa, 35.5 MPa to 40 MPa, 40 MPa to 45.5 MPa, or 45.5 MPa to 50 MPa. In alternative embodiments, the tensile strength of the first material can be less than 50 MPa, less than 45 MPa, less than 40 MPa, less than 35 MPa, less than 30 MPa, less than 25 MPa, less than 20 MPa, less than 15 MPa, less than 10 MPa, or less than 5 MPa. In specific embodiments, the tensile strength of the first material can be approximately 0.5 MPa, approximately 5 MPa, approximately 10 MPa, approximately 15 MPa, approximately 20 MPa, approximately 25 MPa, approximately 30 MPa, approximately 35 MPa, approximately 40 MPa, approximately 45 MPa, or approximately 50 MPa.

The flexure modulus of the first material is generally lower than the flexure modulus of the second material. The flexure modulus of the first material can be between 0.5 MPa and 90 MPa. In many embodiments, the flexure modulus of the first material can be between 0.5 MPa and 5.5 MPa, 5.5 MPa and 10.5 MPa, 10.5 MPa to 15.5 MPa, 15.5 MPa to 20.5 MPa, 20.5 MPa to 25.5 MPa, 25.5 MPa to 30.5 MPa, 30.5 MPa to 35.5 MPa, 35.5 MPa to 40 MPa, 40 MPa to 45.5 MPa, 45.5 MPa to 50 MPa, 50 MPa to 55 MPa, 55 MPa to 60 MPa, 60 MPa to 65 MPa, 65 MPa to 70 MPa, 70 MPa to 75 MPa, 75 MPa to 80 MPa, 80 MPa to 85 MPa, or 85 MPa to 90 MPa. In alternative embodiments, the flexure modulus of the first material can be less than 90 MPa, less than 85 MPa, less than 80 MPa, less than 75 MPa, less than 70 MPa, less than 65 MPa, less than 60 MPa, less than 55 MPa, less than 50 MPa, less than 45 MPa, less than 40 MPa, less than 35 MPa, less than 30 MPa, less than 25 MPa, less than 20 MPa, less than 15 MPa, less than 10 MPa, or less than 5 MPa. In specific embodiments, the flexure modulus of the first material can be approximately 0.5 MPa, approximately 5 MPa, approximately 10 MPa, approximately 15 MPa, approximately 20 MPa, approximately 25 MPa, approximately 30 MPa, approximately 35 MPa, approximately 40 MPa, approximately 45 MPa, approximately 50 MPa, approximately 55 MPa, approximately 60 MPa, approximately 65 MPa, approximately 70 MPa, approximately 75 MPa, approximately 80 MPa, approximately 85 MPa, or approximately 90 MPa.

The specific gravity of the first material is generally lower (or can be the same) as the specific gravity of the second material. The specific gravity of the first material can be between 0.5 and 2. In many embodiments, the specific gravity of the first material can be between 0.5-0.75, 0.75-1, 1-1.25, 1.25-1.5, 1.5-1.75, or 1.75-2.0. In alternative embodiments, the specific gravity of the first material can be less than 2, less than 1.5, or less than 1.0.

The first material is generally comprised from a substantially non-metallic material and more preferably a polymeric material. For example, in many embodiments, the first material can be formed from an elastomer, a polyurethane, a thermoplastic elastomer, a thermoset elastomer, a thermoplastic polyurethane, a thermoset polyurethane, a viscoelastic material, a urethane, other polymers, other polymeric materials with doped metal portions, or combinations thereof. In many embodiments, the first material is selected from one of the categories listed above to satisfy one or more of the material characteristics listed above.

4. Material Characterization of the Second Material

The second material of the striking surface can vary based upon the selection of the first material, as the first material provides certain ball impact characteristics. In many embodiments, the second material can be defined by a predetermined material characteristic (but not limited to) the hardness, tensile strength, flexure modulus, and specific gravity of the material.

The hardness of the second material is generally harder than the hardness of the first material. In many embodiments, the hardness of the second material can have a Shore D value that varies between 60D and 100D. In some embodiments, the hardness of the second material can have a Shore D hardness value between 60D-70D, 70D-80D, 80D-90D, or 90D-100D. In alternative embodiments, the hardness of the second material can have a Shore D hardness between 60D-65D, 65D-70D, 70D-75D, 75D-80D, 80D-85D, 85D-90D, 90D-95D, or 95D-100D. In additional embodiments, the hardness of the second material can have a Shore D hardness greater than 60D, greater than 65D, greater than 70D, greater than 75D, greater than 80D, greater than 85D, greater than 90D, greater than 95D, or greater than 100D. In other embodiments, the hardness of the second material can have a Shore D hardness of 60D, 61D, 62D, 63D, 64D, 65D, 66D, 67D, 68D, 69D, 70D, 71D, 72D, 73D, 74D, 75D, 76D, 77D, 78D, 79D, 80D, 81D, 82D, 83D, 84D, 85D, 86D, 87D, 88D, 89D, 90D, 91D, 92D, 93D, 94D, 95D, 96D, 97D, 98D, 99D, or 100D.

The tensile strength of the second material is generally greater than the tensile strength of the first material. The tensile strength of the second material can be between 40 MPa and 1040 MPa. In many embodiments, the tensile strength of the second material can be between 40 MPa to 140 MPa, 140 MPa to 240 MPa, 240 MPa to 340 MPa, 340 MPa to 440 MPa, 440 MPa to 540 MPa, 540 MPa to 640 MPa, 640 MPa to 740 MPa, 840 MPa to 940 MPa, or 940 MPa to 1040 MPa. In alternative embodiments, the tensile strength of the second material can be greater than 40 MPa, greater than 140 MPa, greater than 240 MPa, greater than 340 MPa, greater than 440 MPa, greater than 540 MPa, greater than 640 MPa, greater than 740 MPa, greater than 840 MPa, greater than 940 MPa, or greater than 1040 MPa. In specific embodiments, the tensile strength of the second material can be approximately 41 MPa, 42 MPa, 43 MPa, 44 MPa, 45 MPa, 46 MPa, 47 MPa, 48 MPa, 49 MPa, 50 MPa, 51 MPa, 52 MPa, 53 MPa, 54 MPa, 55 MPa, 56 MPa, 57 MPa, 58 MPa, 59 MPa, 60 MPa, 61 MPa, 62 MPa, 63 MPa, 64 MPa, 65 MPa, 66 MPa, 67 MPa, 68 MPa, 69 MPa, or 70 MPa. In alternative embodiments, the tensile strength of the second material can be 141 MPa, 241 MPa, 341 MPa, 441 MPa, 541 MPa, 641 MPa, 741 MPa, 841 MPa, or 941 MPa.

The flexure modulus of the second material material is generally higher than the flexure modulus of the first material. The flexure modulus of the second material can be between 0.5 MPa and 300 MPa. In many embodiments, the flexure modulus of the second material can be between 0.5 MPa and 5.5 MPa, 5.5 MPa and 10.5 MPa, 10.5 MPa to 15.5 MPa, 15.5 MPa to 20.5 MPa, 20.5 MPa to 25.5 MPa, 25.5 MPa to 30.5 MPa, 30.5 MPa to 35.5 MPa, 35.5 MPa to 40 MPa, 40 MPa to 45.5 MPa, 45.5 MPa to 50 MPa, 50 MPa to 55 MPa, 55 MPa to 60 MPa, 60 MPa to 70 MPa, 70 MPa to 75 MPa, 75 MPa to 80 MPa, 80 MPa to 85 MPa, 85 MPa to 90 MPa, 90 MPa to 100 MPa, 100 MPa to 110 MPa, 110 MPa to 120 MPa, 120 MPa to 130 MPa, 130 MPa to 140 MPa, 140 MPa to 150 MPa, 150 MPa to 160 MPa, 160 MPa to 170 MPa, 170 MPa to 180 MPa, 180 MPa to 190 MPa, 190 MPa to 200 MPa, 200 MPa to 210 MPa, 210 MPa to 220 MPa, 220 MPa to 230 MPa, 240 MPa to 250 MPa, 250 MPa to 260 MPa, 260 MPa to 270 MPa, 270 MPa to 280 MPa, 280 MPa to 290 MPa, or 290 MPa to 300 MPa. In alternative embodiments, the flexure modulus of the second material can be less than 300 MPa, less than 275 MPa, less than 250 MPa, less than 225 MPa, less than 200 MPa, less than 175 MPa, less than 150 MPa, less than 125 MPa, less than 100 MPa, less than 75 MPa, less than 50 MPa, or less than 25 MPa. In specific embodiments, the flexural modulus of the second material be approximately 0.6 MPa, 5.6 MPa, 10.6 MPa, 15.6 MPa, 20.6 MPa, 25.6 MPa, 30.6 MPa, 35.6 MPa, 40.1 MPa, 45.6 MPa, 50.1 MPa, 55.1 MPa, 60.1 MPa, 70.1 MPa, 75.1 MPa, 80.1 MPa, 85.1 MPa, 90.1 MPa, 100.1 MPa, 110.1 MPa, 120.1 MPa, 130.1 MPa, 140.1 MPa, 150.1 MPa, 160.1 MPa, 170.1 MPa, 180.1 MPa, 190.1 MPa, 200.1 MPa, 210.1 MPa, 220.1 MPa, 230.1 MPa, 240.1 MPa, 250.1 MPa, 260.1 MPa, 270.1 MPa, 280.1 MPa, or 290.1 MPa.

The specific gravity of the second material is generally greater (or the same as) than the specific gravity of the first material. The specific gravity of the second material can be between 0.5 and 13.5. In many embodiments, the specific gravity of the second material can be between 0.5-1.5, 1.5-2.5, 2.5-3.5, 3.5-4.5, 4.5-5.5, 5.5-6.5, 6.5-7.5, 7.5-8.5, 8.5-9.5, 9.5-10.5, 10.5-11.5, 11.5-12.5, or 12.5-13.5. In alternative embodiments, the specific gravity of the second material can be approximately 0.5, approximately 1.0, approximately 1.5, approximately 2.5, approximately 3.5, approximately 4.5, approximately 5.5, approximately 6.5, approximately 7.5, approximately 8.5, approximately 9.5, approximately 10.5, approximately 11.5, approximately 12.5, or approximately 13.5

The second material can be generally comprised from a substantially non-metallic material or metallic material. For example, in many embodiments, the second material can be formed from a non-metallic material (i.e. an elastomer, a polyurethane, a thermoplastic elastomer, a thermoset elastomer, a thermoplastic polyurethane, a thermoset polyurethane, a viscoelastic material, a urethane, other polymers, other polymeric materials with doped metal portions, or combinations thereof). In alternative embodiments, the second material can be constructed from a metal material. For example, the second material can be constructed from any one or combination of the following: 8620 alloy steel, S25C steel, carbon steel, maraging steel, 17-4 stainless steel, 1380 stainless steel, 303 stainless steel, stainless steel alloys, tungsten, aluminum, aluminum alloys, ADC-12, titanium, or titanium alloys. In many embodiments, the second material is selected from one of the categories listed above to satisfy one or more of the material characteristics listed above.

5. First and Second Material Arrangement

In many embodiments, the second material can define a plurality of recesses or voids that resemble any shape. The characteristics (i.e. geometry, shape, dimensions, and spacing distance) of the recesses or voids formed by the second material can vary to achieved desired performance, aesthetics, and feel attributes. For example, in many embodiments, the second material can define a plurality of discrete voids or recesses that generally define a pill shape, a hexagonal shape, a split hexagonal shape, a circular shape, a rectangular shape, a triangular shape, a pentagonal shape, an octagonal shape, a curvilinear shape, a diamond shape, and/or a trapezoidal shape. In alternative embodiments, the second material, can form continuous voids or recesses that can generally be defined by one or more continuous curvilinear groove(s), one or more continuous arcuate groove(s), one or more continuous arc like grooves, one or more continuous linear groove(s), or one or more combinations thereof.

The first material can be configured to fill, partially fill, reside, occupy and/or be complimentary with one or more of the plurality of discrete recesses or voids defined by the second material. For example, in many embodiments, the first material can partially or entirely fill one or more of the plurality of voids or recess described above. In alternative embodiments, the first material can fill, partially fill, reside, and/or be complimentary with one or more of the continuous voids or recesses mentioned above. In embodiments, where the first material partially fills the plurality of recesses or voids, air can occupy the remaining unfilled portion.

The first and second materials can be configured to cooperate with each other to create different material characteristic regions. In many embodiments, the center region of the striking surface can be softer than adjacent heel and toe regions. In alternative embodiments, the center region of the striking surface can be more flexible than adjacent heel and toe regions. In other embodiments, the center region of the striking surface can be more deformable than adjacent heel and toe regions. Creating a center region that is more flexible, deformable, softer, and/or less responsive than adjacent heel and/or toe regions creates more uniform ball speed and sensory feedback characteristics (i.e. impact sound, impact feel, impact feedback, etc) across the striking surface.

Creating a center region that is less responsive than the corresponding heel and toe regions can be accomplished in many ways. For example, in embodiments, where a first soft material dominates a less soft second material, a less responsive center region is formed. In other embodiments, a less responsive center region can be formed by controlling the void and/or recess patterns to form larger first material land areas at the center region than at adjacent heel and toe regions.

I. EMBODIMENTS

Continuous Grooves (Non-Insert Style Putter)

Figure 2:
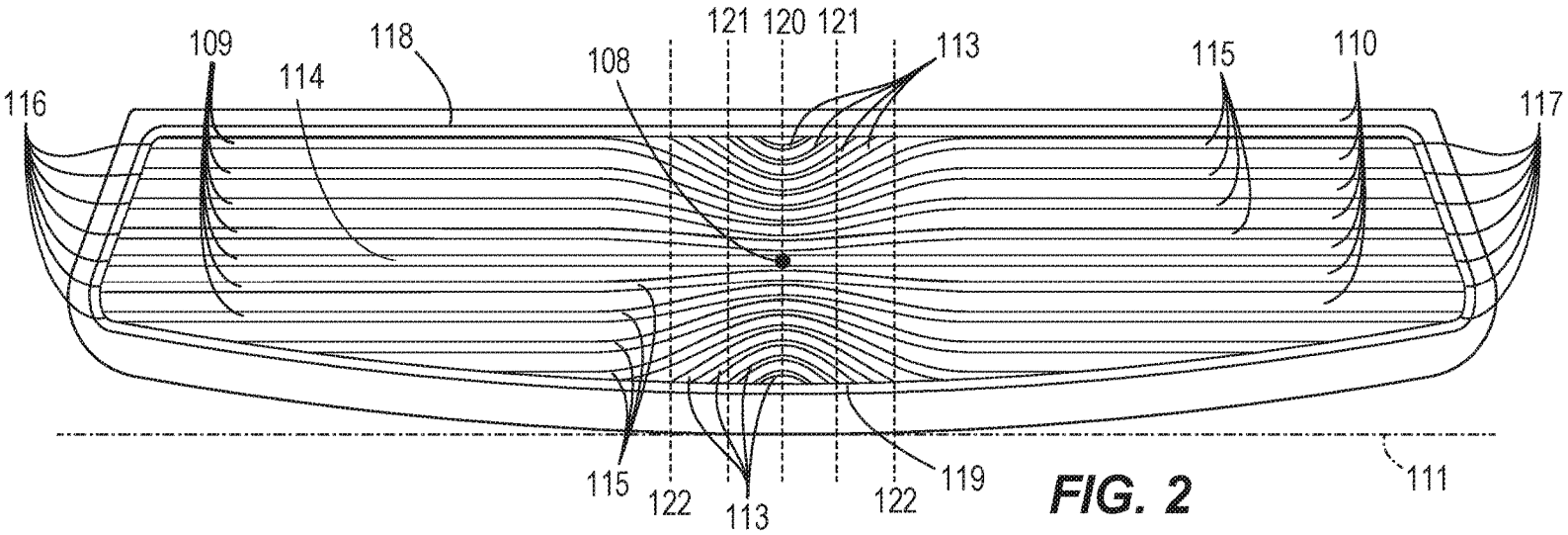
FIG. 2 shows a face on view of the striking surface of FIG. 1.
Figure 3:
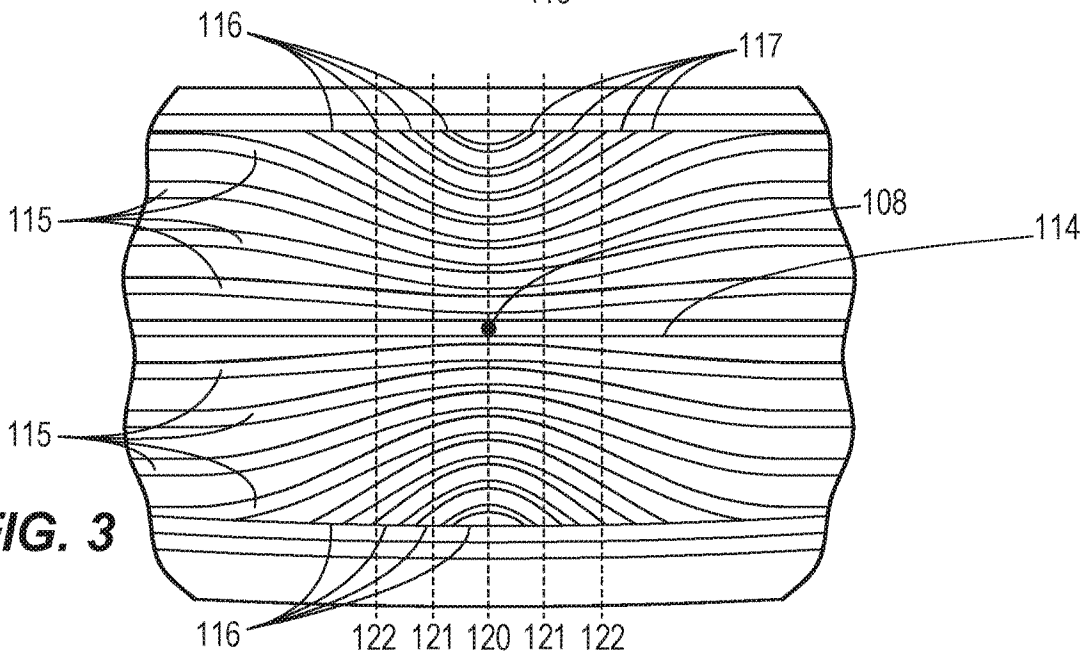
FIG. 3 shows a close-up face on view of the striking surface of FIG. 2.

FIGS. 1-5 illustrate an exemplary embodiment. More particularly, FIGS. 1-3 illustrate an example of a putter-type golf club head 100 comprising a dual-material striking surface 107 having a first material 109 and a second material 110. The putter-type golf club head comprises a putter body 101 having a toe portion 102, a heel portion 103 opposite the toe portion 102, a top rail portion 104, a sole portion 105 opposite the top rail portion 104, a portion of a striking surface 107, and a rear portion 106 opposite the striking surface portion 107.

Further, FIGS. 1-3 illustrate the striking surface 107 of the putter body 100 forming a plurality of continuous groove recesses 112. These continuous groove recesses 112 can separate the striking surface 107 into second material land areas that form ball contact surfaces and continuous groove areas that form non-ball contact surfaces (upon golf ball impact). Through a combination of continuous recesses being entirely arcuate or having arcuate portions, the proportion of ball contact surfaces and non-ball contact surfaces can vary across the striking surface 107, yet create a consistent ball speed upon impact across the striking surface.

For example, FIG. 2 illustrates a possible arrangement where the arcuate portions of each the continuous groove recesses 112 are arranged to form a denser, more packed center region. This causes the center region to be less responsive to ball impacts than at areas (or regions) away from the center region (i.e. towards the heel or toe) as more continuous groove areas (non-ball contact surfaces) are present than ball contact surfaces. Additionally, to create a more densely packed center region towards the top rail and sole (at the center of the strike face), are entirely arcuate recesses (also referred to as semi-circle recesses) to increase the amount of continuous recesses (nonball contact surfaces). These semi-circle recesses are not present moving away from the center region and at the heel end and toe end. The arrangement can be progressive, or asymmetrically arranged from the center to the heel end and/or the center to toe end of the striking surface.

Moving away from the center region toward the heel or toe, the spacing distance between adjacent arcuate portions can gradually increase to introduce more ball contact surface. Increasing the amount of ball contact surfaces (in a heel-to-toe direction) creates a more responsive region when compared to the less responsive center region. As the response of the striking surface changes, this aids in creating a consistent ball speed across the striking surface.

Further, as previously mentioned, the golf club head 100 can be configured to reside in an "address position". The address position is the reference orientation of the golf club head for all reference measurements, ratios, and descriptive parameters described below. Specifically, FIG. 1 illustrates the putter-type golf club head 100 comprising a plurality of continuous groove recesses 112 defined by the putter body 101. In other words, the putter-type golf club head 100 is a non-insert style club head.

The plurality of continuous groove recesses 112 can resemble many shapes or geometries. For example, in this exemplary embodiment, the plurality of continuous groove recesses 112 can be defined by one or more continuous curvilinear groove recesses, one or more continuous arcuate groove recesses (may also be referred to as "continuous arc-like groove recesses"), one or more continuous linear groove recesses, and/or combinations thereof. In this specific embodiment, the putter-body 101 defines eight continuous arcuate groove recesses 113 (or arc-like grooves), one continuous linear groove recess 114, and eight continuous groove recesses 115 that define at least one linear portion and an arcuate portion.

In alternative embodiments of putter-type golf club heads having continuous groove recesses 112, the putter body can define one or more continuous arcuate groove recesses 113, two or more continuous arcuate groove recesses 113, three or more continuous arcuate groove recesses 113, four or more continuous arcuate groove recesses 113, five or more continuous arcuate groove recesses 113, six or more continuous arcuate groove recesses 113, seven or more continuous arcuate groove recesses 113, eight or more continuous arcuate groove recesses 113, nine or more continuous arcuate groove recesses 113, ten or more continuous arcuate groove recesses 113, or eleven or more continuous arcuate groove recesses 113.

In the same or alternative embodiments, the putter-type golf club head can define one or more continuous groove recesses that defines at least one linear portion and an arcuate portion 115, two or more continuous groove recesses that defines at least one linear portion and an arcuate portion 115, three or more continuous groove recesses that defines at least one linear portion and an arcuate portion 115, four or more continuous groove recesses that defines at least one linear portion and an arcuate portion 115, five or more continuous groove recesses that defines at least one linear portion and an arcuate portion 115, six or more continuous groove recesses that defines at least one linear portion and an arcuate portion 115, seven or more continuous groove recesses that defines at least one linear portion and an arcuate portion 115, eight or more continuous groove recesses that defines at least one linear portion and an arcuate portion 115, nine or more continuous groove recesses that defines at least one linear portion and an arcuate portion 115, ten or more continuous groove recesses that defines at least one linear portion and an arcuate portion 115, or eleven or more continuous groove recesses that defines at least one linear portion and an arcuate portion 115. In many embodiments, the arcuate portions of the continuous linear groove recesses are positioned between a first linear portion (proximal to the heel portion) and a second linear portion (proximal to the toe portion).

With continued reference to FIG. 2, each continuous groove recess of the plurality of continuous groove recesses 112 (although not required) comprises either (1) a first end 116 and a second end 117 that can be connected to an upper border 118 of the striking surface 107, (2) a first end 116 and a second end 117 that is connected to either the heel 103 or toe portion 102 of the striking surface, or (3) a first end 116 and a second end 117 that can be connected to the lower border 119 of the striking surface 107. This type of groove configuration permits the land area (or second material area) between the groove recesses to be finely adjusted without requiring the continuous recesses to vary in width. This aids in achieving a consistent ball speed across the striking surface 107.

In many embodiments, the plurality of continuous groove recesses can be symmetrical about the centerline axis of the entirely continuous linear groove recess 114 that extends from the heel portion 103 to the toe portion 102. Each of the plurality of continuous groove recesses between the entirely continuous linear groove recess 114 and the upper border 118 (proximal to the top rail 104 of the putter body 101) of the striking surface 107 can comprise arcuate portions and/or continuous arcuate groove recesses 113 that are concave up relative to the upper border 118 of the striking surface 107. Similarly, each of the plurality of continuous groove recesses between the entirely continuous linear groove recess 114 and the lower border 119 (proximal to the sole portion 105 of the putter body 101) of the striking surface 107 can comprise arcuate portions and/or continuous arcuate groove recesses that are concave down relative to the lower border 119 of the striking surface 107.

Each of the continuous groove recesses can have a constant width measured transversely in a top rail 104-to-sole 105 direction. In many embodiments, the width of each continuous groove recess can range between 0.020 inch to 0.040 inch. For example, the width of each continuous groove recess 112 can be approximately 0.020 inches, approximately, 0.021 inches, approximately 0.022 inches, approximately 0.023 inches, approximately 0.024 inches, approximately 0.025 inches, approximately 0.026 inches, approximately 0.027 inches, approximately 0.028 inches, approximately 0.029 inches, approximately 0.030 inches, approximately 0.031 inches, approximately 0.032 inches, approximately 0.033 inches, approximately 0.034 inches, approximately 0.035 inches, approximately 0.036 inches, approximately 0.037 inches, approximately 0.038 inches, approximately 0.039 inches, or approximately 0.040 inches.

In many embodiments, each arcuate portion and/or continuous arcuate groove recess 113 of the plurality of continuous groove recesses can have a maximum length (measured in a heel 103-to-toe 102 direction) that is between 1% and 50% of the maximum length of the striking surface 107. For example, each arcuate portion and/or continuous arcuate groove recess of the plurality of continuous groove recesses can have a maximum length that is greater than 1% of the striking surface 107, greater than 5% of the striking surface 107, greater than 10% of the striking surface 107, greater than 15% of the striking surface 107, greater than 20% of the striking surface 107, greater than 25% of the striking surface 107, greater than 30% of the striking surface 107, greater than 35% of the striking surface 107, greater than 40% of the striking surface 107, or greater than 45% of striking surface 107.

In the same or alternative embodiments, each arcuate portion or continuous arcuate groove recess 113 of the plurality of continuous groove recesses can have a maximum length that is less than 50% of the striking surface 107, less than 45% of the striking surface 107, less than 40% of the striking surface, less than 35% of the striking surface 107, less than 30% of the striking surface 107, less than 25% of the striking surface 107, less than 20% of the striking surface 107, less than 15% of the striking surface 107, or less than 10% of the striking surface 107.

In other embodiments, each arcuate portion or continuous arcuate groove recess 113 of the plurality of continuous groove recesses 112 can have a maximum length that is between approximately 1% and approximately 50% of the striking surface 107, between approximately 1% and approximately 45%, between approximately 1% and approximately 40%, between approximately 1% and 35%, between approximately 1% and approximately 30%, between approximately 1% and approximately 25%, or between approximately 1% and 20% of the maximum length of the striking surface 107.

In many embodiments to control the relationship (or ratio) between the first material 109 and the second material 110, the diameter and arc length of each arcuate groove portion and/or each continuous arcuate groove recess 113 increases in a direction from the upper border 118 to the entirely continuous linear groove recess 114. This can reduce the spacing distance (or second material area) between groove recesses in a heel-to-toe direction and/or top rail-to-sole direction. Similarly, in the same embodiment or other embodiments, the diameter and arc length of each arcuate portion and/or continuous arcuate groove recess increases in a direction from the lower border 119 to the entirely continuous linear groove recess 114. This can reduce the spacing distance (or second material area) between groove recesses in a heel-to-toe direction and/or top rail-to-sole direction. The configuration of each groove comprising arcuate portions and/or continuous arcuate grooves increasing in diameter and/or arc length from the upper border 118 to the entirely continuous linear groove 114 and from the lower border 119 to the entirely continuous linear groove 114 enables the groove recess to maintain a constant width while achieving a striking surface 107 that can control the ball speed across the striking surface 107 as the ratio of the first material 109 and second material varies 110.

In many of the continuous groove recess embodiments, when the club head is an address position, the striking surface 107 comprises a striking surface imaginary vertical axis 120 that extends through a geometric center 108 of the striking surface 107 in a top rail-to-sole direction (as shown by FIG. 2). Further, a total of five other vertical axes are shown in FIG. 3 (striking surface imaginary vertical reference axis 120, heel and toe vertical axes 121 at 0.25 inch from the center, and heel and toe vertical axes 122 at 0.5 inch from the center. These vertical axes 121, 122 are offset from the striking surface imaginary vertical axis in both a heel 103 and toe 102 direction at 0.25 inch and 0.50 inch.

As illustrated by FIG. 3, adjacent continuous grooves 112 are closer to one another (i.e. packed more closely, smaller land (or second material area) between groove recesses) along the striking surface imaginary vertical axis 120 than at the vertical reference axis at 0.25 inch 121 and 0.5 inch 122 (heel-to-toe direction) due to the groove recess spacing distance and arcuate portions. Similarly, adjacent continuous groove recess are closer to one another (i.e. packed more closely, small land area between grooves) at the vertical reference axis at 0.25 inch 121 than at the vertical reference axis at 0.5 inch 122.

Continuous Grooves (Insert Style Putter)

FIGS. 6-9 illustrate another exemplary embodiment. More particularly, FIGS. 6-9 illustrate an example of a putter-type golf club head 200 comprising a dual-material striking surface 207 having a first material 209 and a second material 210. The golf club head 200 of FIGS. 6-9 and the golf club head 100 of FIGS. 1-3 are similar in many respects, except for that the golf club head 200 is an insert style putter.

FIGS. 6-9 illustrate a two-piece putter insert 224 comprising a first material 209 (also referred to as "first part") and a second material 210 (also be referred to as "second part"). With specific reference to FIG. 6, the second part forms (or defines) a plurality of continuous groove voids 212 that separate the striking surface 207 into second material land areas. The first part of the putter insert 224 comprises a plurality of protruding geometries that are complimentary to a corresponding continuous groove void 212. By coupling the first part of the insert with the second part of the insert, the plurality of protruding geometries can be flush with the second material land areas (i.e. on the same surface or plane). Thereby, the plurality of protruding geometries can form first material land areas. The first material land areas and the second material land areas engage with at least a portion of the golf ball upon golf ball impact.

This embodiment illustrates a possible arrangement where the arcuate portions of each the continuous groove voids 212 are arranged to form a denser, more packed center region to create more first material land areas than second material land areas. Having a greater amount of first material land areas than second material land area aids in creating a center region that is less responsive to ball impacts than areas toward and at the heel end or toe ends. This arrangement can be progressive, or asymmetrically arranged from the center to heel end or center to toe end of the striking surface.

Moving away from the center region toward the heel or toe, the spacing distance between adjacent arcuate portions can increase thereby introducing more second material land areas. This spacing distance can be symmetrically progressive or asymmetrically progressive. This aids in creating a gradually more responsive region away from the center region towards the heel and toe regions. Creating a striking surface with different responses characteristic aids in controlling ball speeds more consistently across the striking surface.

Additionally, to create a more densely packed center region towards the top rail and sole at the center of the strike face are entirely arcuate recesses (also can be referred to as semi-circle grooves). This further increases the amount (or degree) of first material lands areas that not present moving away from the center and at the heel end and toe end.

The putter-type golf club head of FIGS. 6-9 comprises a putter-body 201 having a toe portion 202, a heel portion 203 opposite the toe portion 202, a top rail portion 204, a sole portion 205 opposite the top rail portion 204, a portion of a striking surface 207, and a rear portion 206 opposite the striking surface portion 207. The striking surface portion 207 further defines a striking surface recess 223 defined by the heel portion 203, the toe portion 202, the top rail portion 204, the sole portion 205, and the rear portion 206 of the putter body 201.

Figure 7:
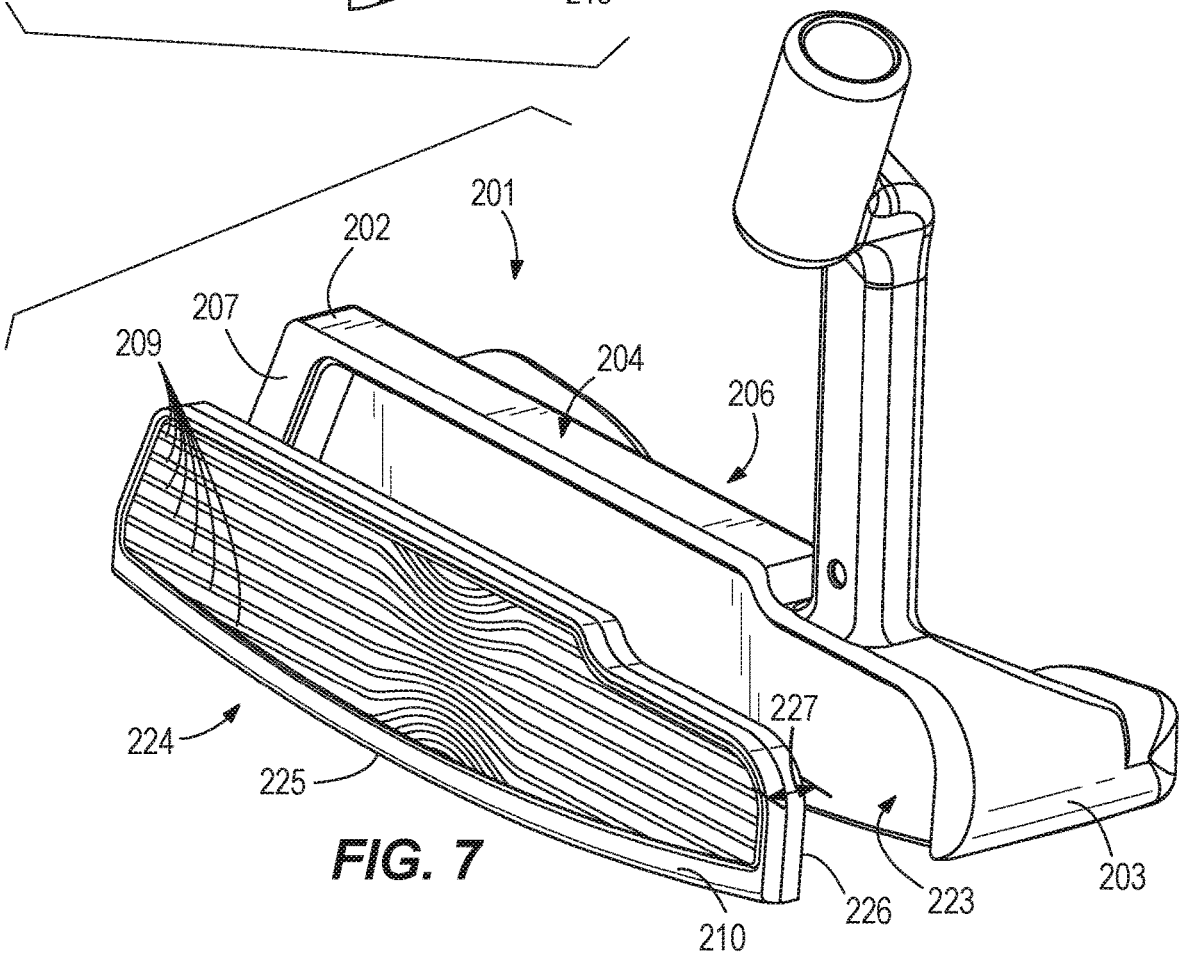
FIG. 7 shows a partially assembled view of a striking surface having continuous grooves of FIG. 6.
Figure 8:
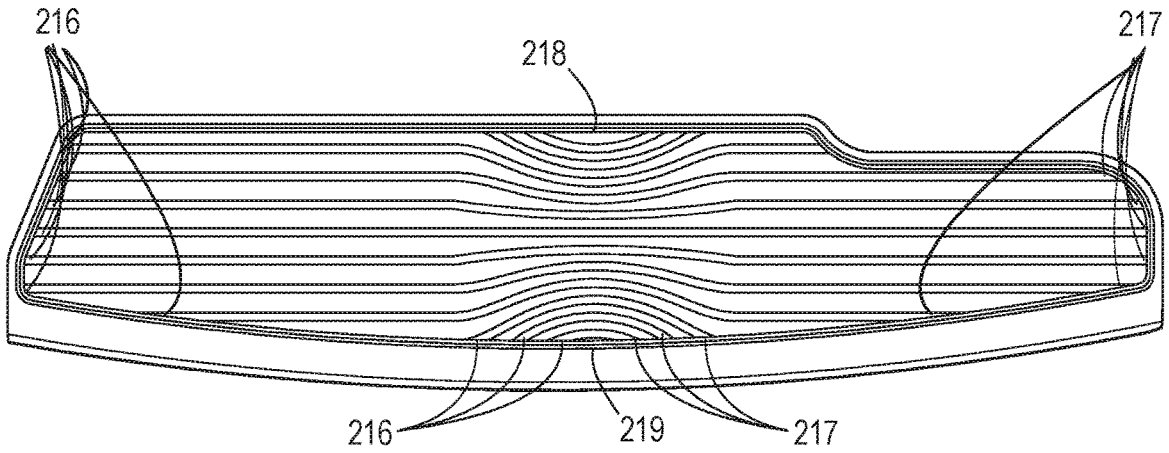
FIG. 8 shows a face on view of the striking surface of FIG. 6.

Referencing FIG. 7, FIG. 7 illustrates a perspective view of a putter insert 224. In many embodiments, the putter insert 224 can be received within and complementary with the striking surface recess 223. Unlike the embodiment of FIGS. 1-3, where the putter body 201 defines the second material 210, the second 210 material and the first material 209 are a part of the putter insert 224 (i.e. distinct from the putter body 201).

Figure 6:
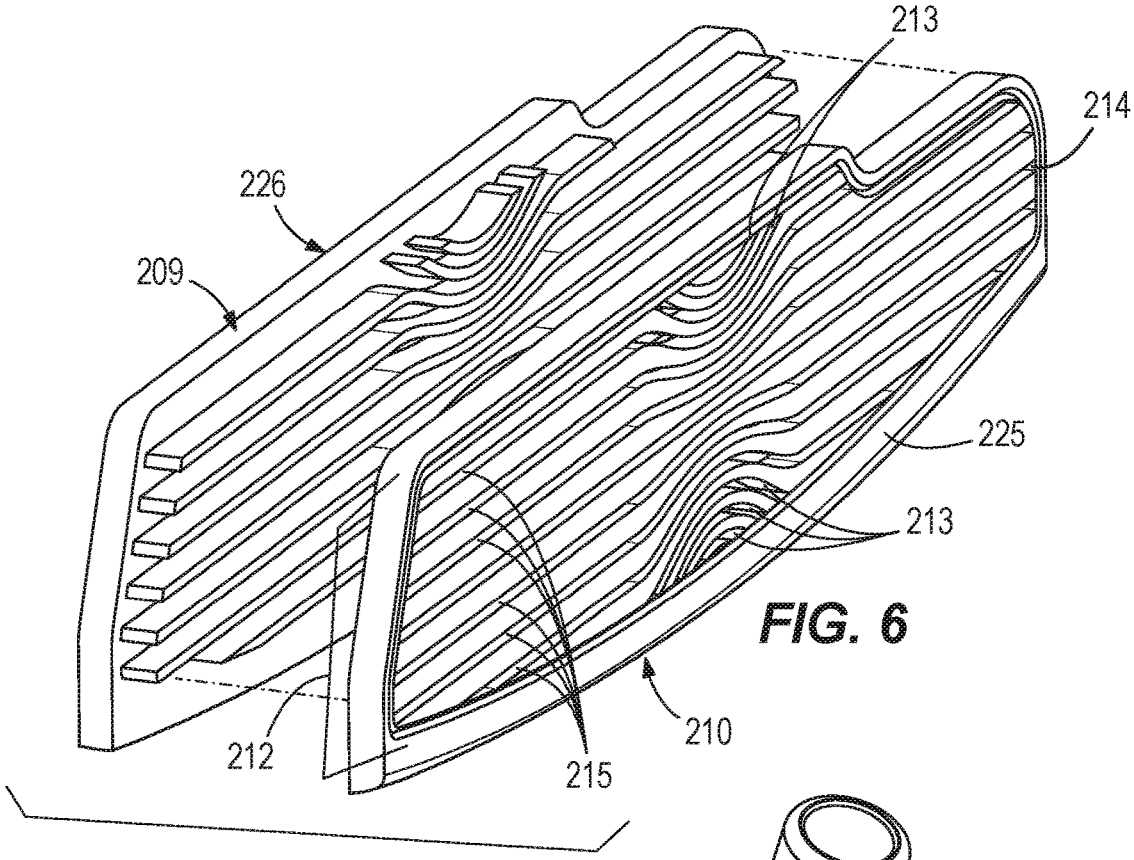
FIG. 6 shows an exploded view of a striking surface having continuous grooves for an insert style club head according to one embodiment.

The insert 224 can comprise of a front surface 225 adapted for impact with a golf ball (not shown) and a rear surface 226 opposite the front portion. A putter insert thickness 227 can be defined as the maximum perpendicular distance between the front surface 225 and the rear surface 226. For example, FIG. 6 illustrates the insert 224 having a plurality of continuous groove voids 212 (defined by the second material) extending entirely through the second material 210 thickness. In many embodiments, the first material, the second material, and/or the combination of the first and second material can be of a constant thickness.

Further, in many embodiments, the first material 209 entirely covers the rear surface 226 of the insert 224. In other words, the rear surface 226 is devoid of the second material 210. In many embodiments, the first material 209 further fully fills each continuous groove void (until flush with the front surface 225 of the insert) of the pluralities of continuous groove voids, so that at the front surface 225 the second material 210 surrounds the first material 209, and upon golf ball impact the first material 209 and the second material 210 are engaged to least a portion of the golf ball.

The plurality of continuous groove voids 212 defined by the putter insert 224 can resemble many shapes or geometries. For example, in this exemplary embodiment, the plurality of continuous groove voids 212 can be defined by one or more continuous curvilinear groove voids, one or more continuous arcuate groove voids (may also be referred to as "continuous arc-like groove voids"), one or more continuous linear groove voids, and/or combinations thereof. In this specific embodiment, the second material 210 defines five continuous arcuate groove voids 213 (or arc-like grooves), one continuous linear groove void 214, and six continuous groove voids 215 that define both a linear portion and an arcuate portion.

In alternative embodiments of putter-type golf club heads having continuous arcuate groove voids 213, the second material 210 can define (or forms) one or more continuous arcuate groove voids 213, two or more continuous arcuate groove voids 213, three or more continuous arcuate groove voids 213, four or more continuous arcuate groove voids 213, five or more continuous arcuate groove voids 213, six or more continuous arcuate groove voids 213, seven or more continuous arcuate groove voids 213, eight or more continuous arcuate groove voids 213, nine or more continuous arcuate groove voids 213, ten or more continuous arcuate groove voids 213, or eleven or more continuous arcuate groove voids 213.

| In the same or other embodiments, the second material 210 can define one or more continuous groove voids that defines a linear portion and an arcuate portion 215, two or more continuous groove voids that defines a linear portion and an arcuate portion 215, three or more continuous groove voids that defines a linear portion and an arcuate portion 215, four or more continuous groove voids that defines a linear portion and an arcuate portion 215, five or more continuous groove voids that defines a linear portion and an arcuate portion 215, six or more continuous groove voids that defines a linear portion and an arcuate portion 215, seven or more continuous groove voids that defines a linear portion and an arcuate portion 215, eight or more continuous groove voids that defines a linear portion and an arcuate portion 215, nine or more continuous groove voids that defines a linear portion and an arcuate portion 215, ten or more continuous groove voids that defines a linear portion and an arcuate portion 215, or eleven or more continuous groove voids that defines a linear portion and an arcuate portion 215. In general, the arcuate portions of the continuous linear groove voids 215 are in between a first linear portion (proximal to the heel portion) and a second linear portion (proximal to the toe portion).

In many embodiments, each continuous groove void of the plurality of continuous groove voids (although not required) comprises either (1) a first end 216 and a second end 217 that can be connected to an upper border 218 of the striking surface 207, (2) a first end 216 and a second end 217 that can be connected to either the heel 203 or toe portion 202 of the striking surface, or (3) a first end 216 and a second end 217 that can be connected to the lower border 219 of the striking surface 207. This type of groove void arrangement permits the land area (or second material area 210) between the groove voids to be finely adjusted without requiring the continuous grooves voids to vary in width or thickness. This aids in achieving a consistent ball speed across the striking surface 207.

In some embodiments, the plurality of continuous groove voids are asymmetrical about the centerline axis of the entirely continuous linear groove void 214 that extends from the heel portion 203 to the toe portion 202. Each of the plurality of continuous groove voids between the entirely continuous linear groove 214 and the upper border 218 (proximal to the top rail 204 of the putter body 201) of the striking surface 207 can comprise arcuate portions and/or continuous arcuate groove voids 213 that are concave up relative to the upper border 218 of the striking surface 207. Similarly, each of the plurality of continuous groove voids between the entirely continuous linear groove void 214 and the lower border 219 (proximal to the sole portion 205 of the putter body 201) of the striking surface 207 can comprise arcuate portions and/or continuous arcuate groove voids that are concave down relative to the lower border 219 of the striking surface 207.

Each of the continuous groove voids can have a constant width measured transversely in a top rail 204-to-sole 205 direction. In many embodiments, the width of each continuous groove voids can range be between 0.020 inch to 0.040 inch. For example, the width of the continuous groove voids can be approximately 0.020 inches, approximately, 0.021 inches, approximately 0.022 inches, approximately 0.023 inches, approximately 0.024 inches, approximately 0.025 inches, approximately 0.026 inches, approximately 0.027 inches, approximately 0.028 inches, approximately 0.029 inches, approximately 0.030 inches, approximately 0.031 inches, approximately 0.032 inches, approximately 0.033 inches, approximately 0.034 inches, approximately 0.035 inches, approximately 0.036 inches, approximately 0.037 inches, approximately 0.038 inches, approximately 0.039 inches, or approximately 0.040 inches.

In many embodiments, each arcuate portion and/or continuous arcuate groove void 213 of the plurality of continuous groove voids can have a maximum length (measured in a heel 203-to-toe 202 direction) that is between 1% and 50% of the maximum length of the striking surface 207. For example, each arcuate portion and/or continuous arcuate groove void of the plurality of continuous groove voids can have a maximum length that is greater than 1% of the striking surface 207, greater than 5% of the striking surface 207, greater than 10% of the striking surface 207, greater than 15% of the striking surface 207, greater than 20% of the striking surface 207, greater than 25% of the striking surface 207, greater than 30% of the striking surface 207, greater than 35% of the striking surface 207, greater than 40% of the striking surface 207, greater than 45% of striking surface 207.

In the same or alternative embodiments, each arcuate portion or continuous arcuate groove void 213 of the plurality of continuous groove voids can have a maximum length that is less than 50% of the striking surface 207, less than 45% of the striking surface 207, less than 40% of the striking surface, less than 35% of the striking surface 207, less than 30% of the striking surface 207, less than 25% of the striking surface 207, less than 20% of the striking surface 207, less than 15% of the striking surface 207, or less than 10% of the striking surface 207.

In other embodiments, each arcuate portion or continuous arcuate groove void 213 of the plurality of continuous groove voids can have a maximum length that is between approximately 1% and approximately 50% of the striking surface 207, between approximately 1% and approximately 45%, between approximately 1% and approximately 40%, between approximately 1% and 35%, between approximately 1% and approximately 30%, between approximately 1% and approximately 25%, or between approximately 1% and 20% of the maximum length of the striking surface 207.

In many embodiments to control the relationship (or ratio) between the first material 209 and the second material 210, the diameter and arc length of each arcuate groove portion and/or each continuous arcuate groove 213 increases in a direction from the upper border 218 to the entirely continuous linear groove 214, to create less land areas (or second material land areas) between continuous groove voids at the center region. In the same embodiment or other embodiments, the diameter and arc length of each arcuate portion and/or continuous arcuate grooves increases in a direction from the lower border 219 to the entirely continuous linear groove 214 to create less second material land area areas between continuous groove voids at the center region The configuration of each continuous groove voids comprising arcuate portions and/or continuous arcuate groove voids increasing in diameter and/or arc length from the upper border 218 to the entirely continuous linear groove void 214 and from the lower border 219 to the entirely continuous linear groove void 214 enables the groove voids to have a constant width and depth while achieving a striking surface 207 that can control the ball speed across the striking surface 207.

Figure 9:
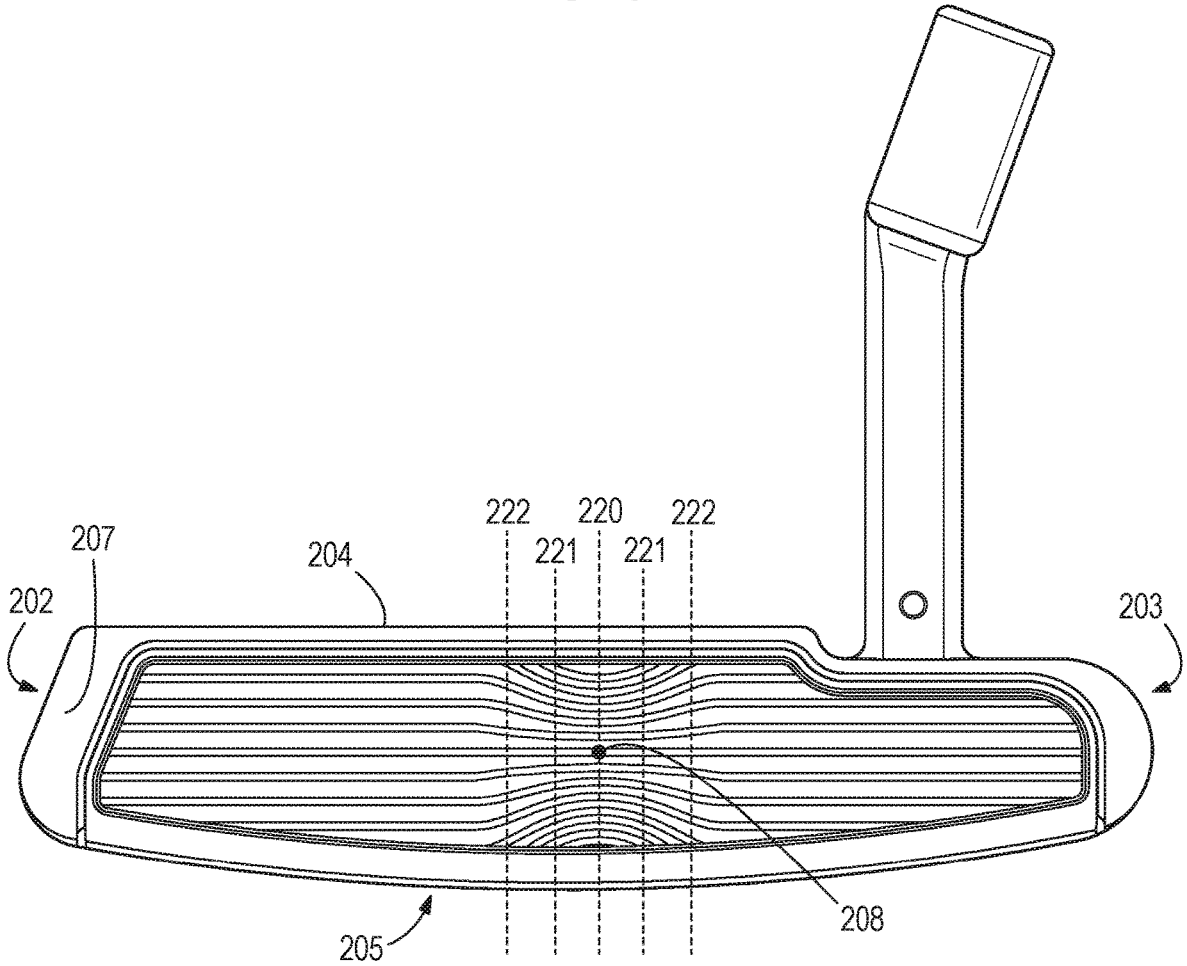
FIG. 9 shows a face on view of the striking surface of FIG. 7.

In many of the continuous groove void embodiments, when the club head is an address position the striking surface comprises a striking surface imaginary vertical axis 220 that extends through a geometric center 208 of the striking surface 207 in a top rail-to-sole direction (as shown by FIG. 9). Further, offset from the striking surface imaginary vertical axis in both a heel 203 and toe 202 direction at 0.25 inch and 0.50 inch are corresponding vertical reference axes.

As further illustrated in FIG. 9, adjacent continuous groove voids are closer to one another (i.e. packed more closely, creating small land areas (or smaller second material land areas) between continuous grooves voids) along the striking surface imaginary vertical axis 220 than at the vertical reference axis of 0.25 inch 221 and 0.5 inch 222. Similarly, adjacent continuous groove voids are closer to one another (i.e. packed more closely, smaller land (or second material) area between groove voids) at the vertical reference axis of 0.25 inch 221 than at the vertical reference axis of 0.5 inch 222.

In many of the continuous groove void embodiments, the percentage of the first material (or first material land area) along the 0.5-inch vertical reference axis 222 can between approximately 20% and 40%. For example, the percentage of the first material land area along the 0.5 inch vertical reference axis 222 can be 20%, 21%, 22%, 23%, 24%, 25%, 26%, 27%, 28%, 29%, 30%, 31%, 32%, 33%, 34%, 35%, 36%, 37%, 38%, 39%, or 40%. For further example, the percentage of the first material land area along the 0.5 inch vertical reference axis 222 can be greater than 20%, greater than 21%, greater than 22%, greater than 23%, greater than 24%, greater than 25%, greater than 26%, greater than 27%, greater than 28%, greater than 29%, greater than 30%, greater than 31%, greater than 32%, greater than 33%, greater than 34%, greater than 35%, greater than 36%, greater than 37%, greater than 38%, or greater than 39%. In alternative embodiments, the percentage of the first material land area along the 0.5 inch vertical reference axis 222 can be less than 21%, less than 22%, less than 23%, less than 24%, less than 25%, less than 26%, less than 27%, less than 28%, less than 29%, less than 30%, less than 31%, less than 32%, less than 33%, less than 34%, less than 35%, less than 36%, less than 37%, less than 38%, less than 39%, or less than 40%, In many of the continuous groove embodiments, the percentage of the first material (or first material land area) along the 0.25-inch vertical reference axis 221 can be between approximately 30% and 50%. For example, the percentage of the first material along the 0.25 inch vertical reference axis 221 can be 30%, 31%, 32%, 33%, 34%, 35%, 36%, 37%, 38%, 39%, 40%, 41%, 42%, 43%, 44%, 45%, 46%, 47%, 48%, 49%, or 50%. For further example, the percentage of the first material land area along the 0.25 inch vertical reference axis 221 can be greater than 30%, greater than 31%, greater than 32%, greater than 33%, greater than 34%, greater than 35%, greater than 36%, greater than 37%, greater than 38%, greater than 39%, greater than 40%, greater than 41%, greater than 42%, greater than 43%, greater than 44%, greater than 45%, greater than 46%, greater than 47%, greater than 48%, or greater than 49%. In alternative embodiments, the percentage of the first material land area along the 0.25 inch vertical reference axis 221 can be less than 31%, less than 32%, less than 33%, less than 34%, less than 35%, less than 36%, less than 37%, less than 38%, less than 39%, less than 40%, less than 41%, less than 42%, less than 43%, less than 44%, less than 45%, less than 46%, less than 47%, less than 48%, less than 49%, or less than 50%, In many of the continuous groove embodiments, the percentage of the first material (or the first material land area) along the striking surface imaginary axis 220 can between approximately 40% and 60%. For example, the percentage of the first material along the striking surface imaginary axis 220 can be 40%, 41%, 42%, 43%, 44%, 45%, 46%, 47%, 48%, 49%, 50%, 51%, 52%, 53%, 54%, 55%, 56%, 57%, 58%, 59%, or 60%. For further example, the percentage of the first material along the striking surface imaginary axis 220 can be greater than 40%, greater than 41%, greater than 42%, greater than 43%, greater than 44%, greater than 45%, greater than 46%, greater than 47%, greater than 48%, greater than 49%, greater than 50%, greater than 51%, greater than 52%, greater than 53%, greater than 54%, greater than 55%, greater than 56%, greater than 57%, greater than 58%, or greater than 59%. In alternative embodiments, the percentage of the first material along the striking surface imaginary axis 220 can be less than 41%, less than 42%, less than 43%, less than 44%, less than 45%, less than 46%, less than 47%, less than 48%, less than 49%, less than 50%, less than 51%, less than 52%, less than 53%, less than 54%, less than 55%, less than 56%, less than 57%, less than 58%, less than 59%, or less than 60%, Further, in many embodiments, the average ratio defined as the surface area of the first material land area to the surface area of the second material land area (measured in a top rail-to-sole direction) decreases from the striking surface imaginary vertical axis 220 to the 0.5-inch vertical reference axis 222. This type of arrangement of the first material and the second material aid in providing consistent ball speeds across the striking surface as the average ratio along the striking surface imaginary vertical axis is greater (i.e. softer) than the average ratio along the 0.5 inch vertical reference axis (i.e. harder). This counteracts the loss of energy transfer on heel and toe mishits.

Discrete Voids (Pill Shape)

FIGS. 10-13 illustrate another exemplary embodiment. More particularly, FIGS. 10-13 illustrate an example of a putter-type golf club head 300 comprising a dual-material striking surface 307 comprising a first material 309 and a second material 310. The golf club head 300 of FIGS. 10-13 and the golf club head 200 of FIGS. 6-9 are similar in many respects, except for that the golf club head 300 comprises discrete voids that extend in a heel-to-toe direction rather than continuous voids and/or recesses. The discrete voids generally have a greater length proximate the center region of the striking surface 307 than towards the heel and/or toe. In many embodiments, the discrete voids are substantially the same width.

Figure 10:
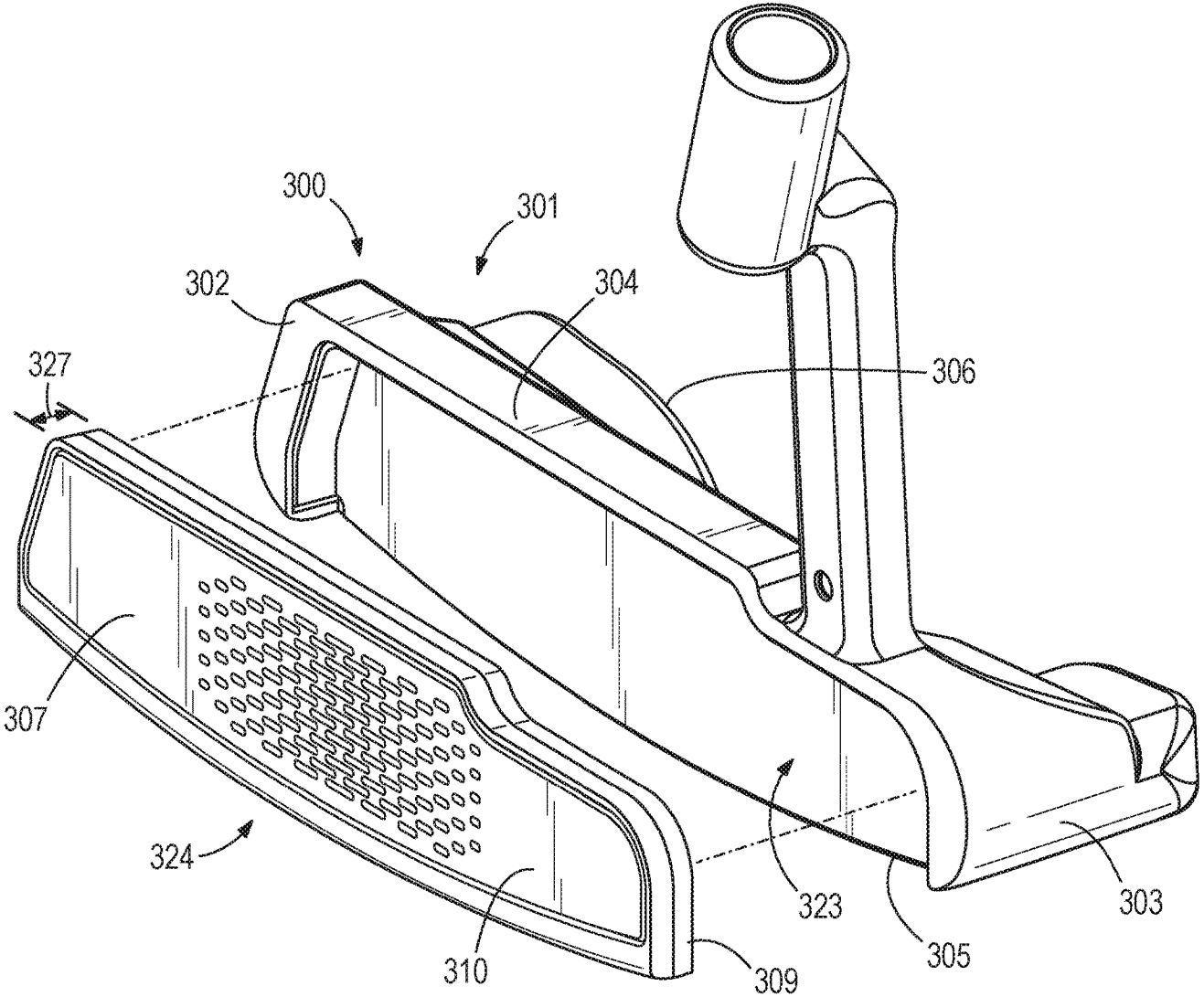
FIG. 10 shows a partially assembled view of a striking surface having discrete pill shaped voids for an insert style club head according to one embodiment.

FIG. 10 illustrates a putter-type golf club head 300 comprising a putter-body 301 having a toe portion 302, a heel portion 303 opposite the toe portion 302, a top rail portion 304, a sole portion 305 opposite the top rail portion 304, a portion of a striking surface 307, and a rear portion 306 opposite the striking surface portion 307. The striking surface portion 307 can further define a striking surface recess 323 defined by the heel portion 303, the toe portion 302, the top rail portion 304, the sole portion 305, and the rear portion 306 of the putter body 301.

FIGS. 10-13 illustrate a two-part putter insert 324 comprising a first material 309 (also referred to as "first part") and a second material 310 (also referred to as "second part"). With specific reference to FIG. 10, the second part forms (or defines) a plurality of discrete pill shaped voids 312. These discrete pill shaped voids are arranged in rows and columns and do not connect or touch another pill shaped void.

The second part surrounds the pill shaped voids to form second material land areas. The first part of the putter insert 324 comprises a plurality of protruding pill shaped geometries that are complimentary to a corresponding discrete pill shaped void 212. By coupling the first part and the second part together, the plurality of protruding discrete pill shaped voids can be flush with the second material land areas. Thereby, the plurality of protruding discrete pill shaped voids can form first material land areas. The first material land areas and the second material land engage with at least a portion of the golf ball upon golf ball impact. The first material has a hardness less than the second material.

This embodiment illustrates a possible arrangement where variable length pill shaped voids are arranged to form a denser, more packed center region creating more first material land areas than second material land areas. Referencing FIG. 12, it can be seen that in any given row the pill shaped voids having the greatest lengths are proximate to the center region and the pill shaped voids having the smallest lengths are proximate the heel and toe ends. This arrangement creates a center region having a greater amount of first material land areas than second material land area (which creates a center region that is less responsive to ball impacts than areas toward and at the heel end or toe ends). In a top rail to sole direction, the first material land areas and the second material land areas are substantially the same or constant. Therefore, the first material land area only varies in a heel to toe direction and not a top rail to sole direction.

Moving away from the center region toward the heel or toe along a given row, the spacing distance between adjacent discrete pill shaped voids increases (i.e. the length of the discrete pills shaped voids decrease. This creates more second material land areas, which aids in gradually creating a more responsive region away from the center region towards the heel and toe regions to consistently control ball speeds across the striking surface.

Figure 11:
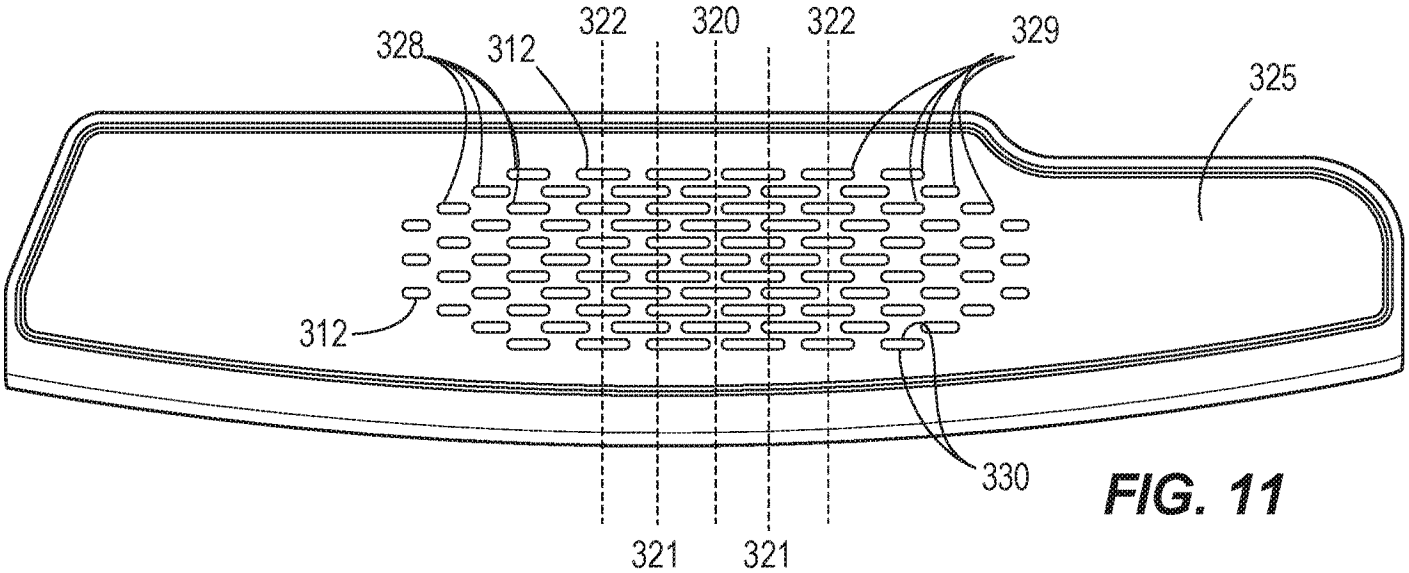
FIG. 11 shows a face on view of the striking surface of FIG. 10.
Figure 12:
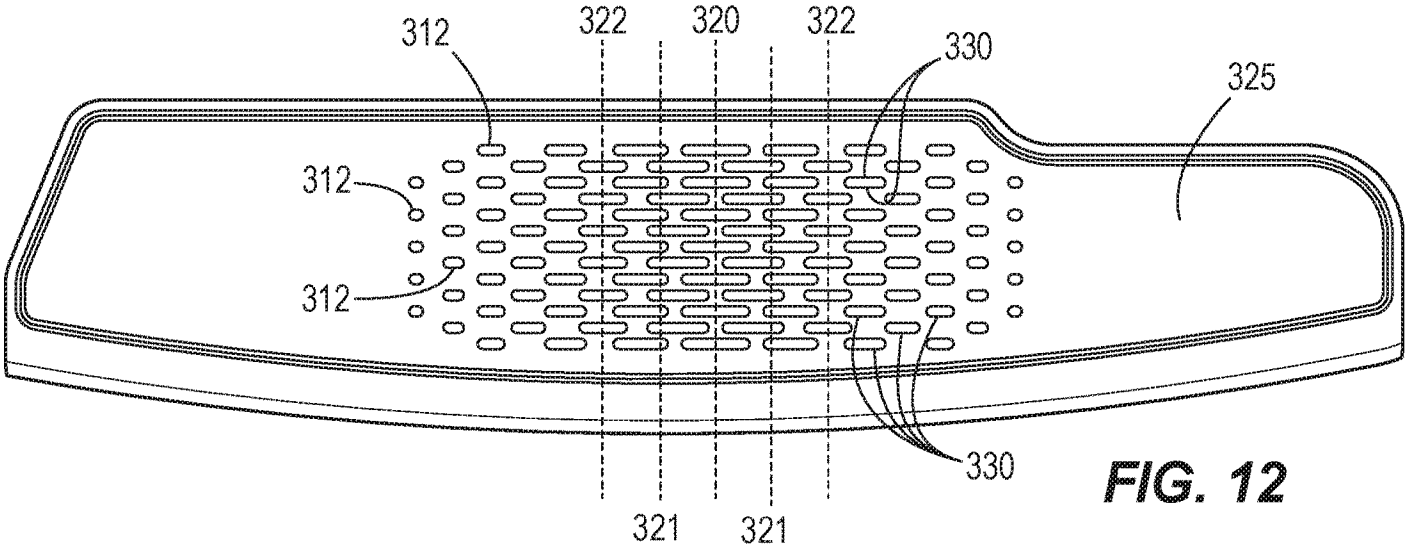
FIG. 12 shows another face on view of a striking surface having discrete pill shaped voids for an insert style club head according to one embodiment.
Figure 13:
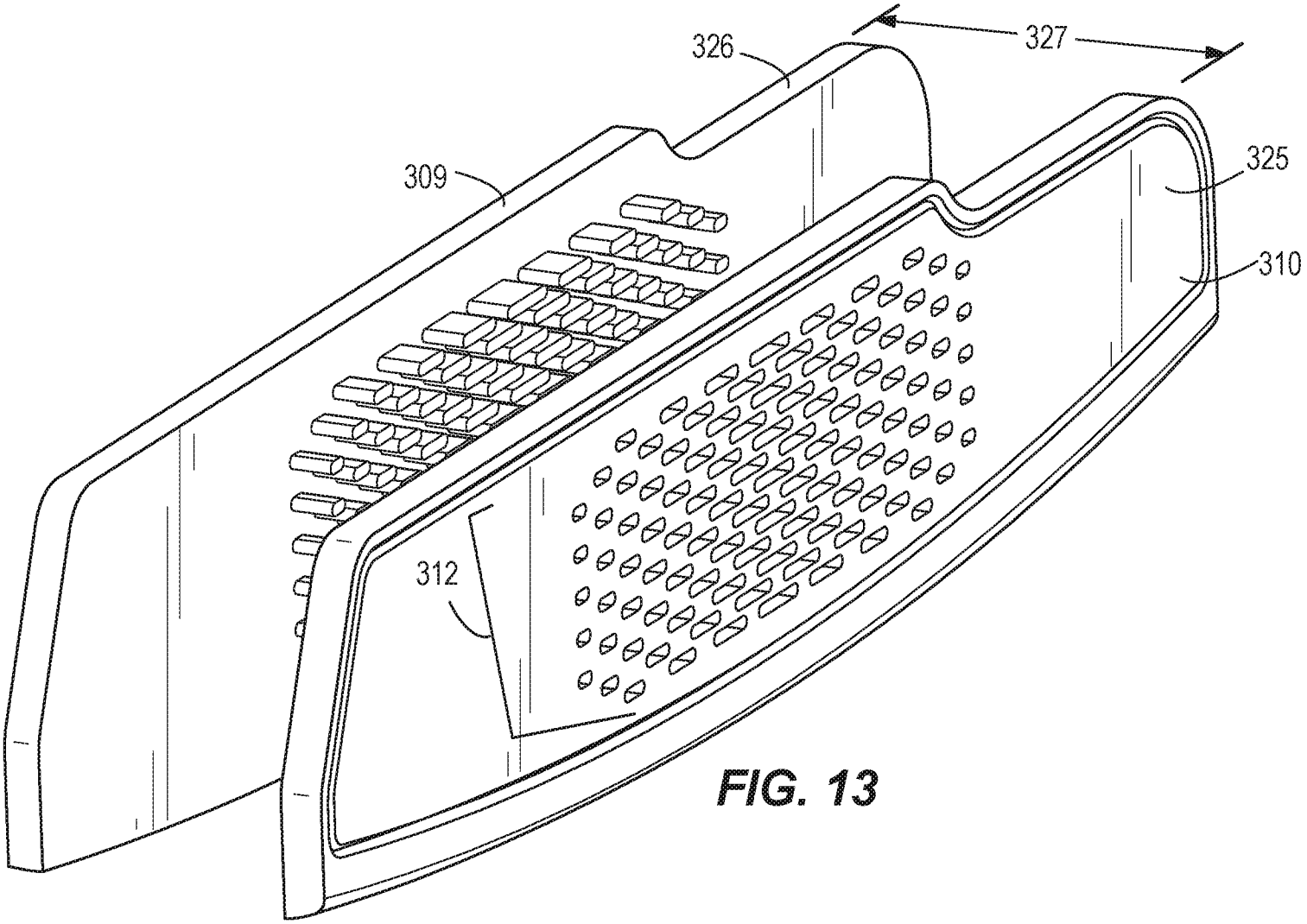
FIG. 13 shows an exploded view of the striking surface of FIG. 12.

FIGS. 11-13 illustrates various putter inserts 324 comprising discrete pill shaped voids. In many embodiments, the putter insert 324 can be received within and complementary with the striking surface recess 323. However, it should be noted in alternative embodiments, the putter-type golf club head 300 need not to be an insert style putter.

FIG. 13 illustrates an exploded view of the putter insert 324 comprising discrete pill shaped voids. The insert 324 can comprise of a front surface 325 adapted for impact with a golf ball (not shown) and a rear surface 326 opposite the front portion. A putter insert thickness (or depth) 327 can be defined as the maximum perpendicular distance between the front surface 325 and the rear surface 326. For example, FIG. 13 illustrates the insert 324 having a plurality of discrete pill shaped voids 312 (defined by the second material) extending entirely through the second material 310 thickness (or depth).

Further, in many embodiments, the first material 309 can entirely cover the rear surface 326 of the insert 324. In other words, the rear surface 326 is devoid of the second material 310. In many embodiments, the first material 309 further fills each of the discrete pill shaped voids 312 (until flush with the front surface 325 of the insert) of the pluralities of discrete pill shaped voids, so that at the front surface 325 the second material 310 surrounds the first material 309 and upon golf ball impact the first material 309 and the second material 310 can engage to least a portion of the golf ball.

Each discrete pill shaped void can have a first end 328 (proximal to the toe) forming an arcuate geometry and a second end 329 (proximal to the heel) forming an arcuate geometry. In many embodiments, the first 328 and second end 329 geometry can be curvilinear, circular, semicircular, crescent like, bow shape, curved, or rounded. The first end 328 and second end 329 can be connected by parallel horizontal segments 330 that extend substantially in a heel-to-toe direction.

The maximum length of each discrete pill shaped void 312 (measured in a heel-to-toe direction) can vary in a heel-to-toe direction. In many embodiments, the maximum length of each discrete pill shaped 312 void can be between 0.02 inches and 0.36 inches. For example, the maximum length of each of the plurality of discrete pill shaped voids 312 can be between 0.02 inches-0.36 inches, 0.04 inches-0.36 inches, 0.06 inches-0.36 inches, 0.08 inches-0.36 inches, 0.10 inches-0.36 inches, 0.12 inches-0.36 inches, 0.14 inches-0.36 inches, 0.16 inches-0.36 inches, 0.18 inches-0.36 inches, 0.20 inches-0.36 inches, 0.22 inches-0.36 inches, 0.24 inches-0.36 inches, 0.26 inches-0.36 inches, or 0.28 inches-0.36 inches. In other embodiments, the maximum length of each discrete pill shaped void 312 can vary between 0.06 inch and 0.180 inch.

The maximum width of each discrete pill shaped void 312 of the plurality of pill shaped voids (measured in a top rail-to-sole direction) can remain the same or substantially constant. In many embodiments, the maximum width of each discrete pill shaped void 312 can be between 0.01 inches and 0.3 inches. For example, the maximum width of each discrete pill shaped void 312 can be greater than 0.01 inches, greater than 0.02 inches, greater than 0.03 inches, greater than 0.04 inches, greater than 0.05 inches, greater than 0.06 inches, greater than 0.07 inches, greater than 0.08 inches, greater than 0.09 inches, greater than 0.10 inches, greater than 0.11 inches, greater than 0.12 inches, greater than 0.13 inches, greater than 0.14 inches, greater than 0.15 inches, greater than 0.16 inches, greater than 0.17 inches, greater than 0.18 inches, greater than 0.19 inches, greater than 0.20 inches, greater than 0.21 inches, greater than 0.22 inches, greater than 0.23 inches, greater than 0.24 inches, greater than 0.25 inches, greater than 0.26 inches, greater than 0.27 inches, greater than 0.28 inches, or greater than 0.29 inches.

In other embodiments, the maximum width of each discrete pill shaped void 312 can be less than 0.30 inches, less than 0.29 inches, less than 0.28 inches, less than 0.27 inches, less than 0.26 inches, less than 0.25 inches, less than 0.24 inches, less than 0.23 inches, less than 0.22 inches, less than 0.21 inches, less than 0.20 inches, less than 0.19 inches, less than 0.18 inches, less than 0.17 inches, less than 0.16 inches, less than 0.15 inches, less than 0.14 inches, less than 0.13 inches, less than 0.12 inches, less than 0.11 inches, less than 0.10 inches, less than 0.09 inches, less than 0.08 inches, less than 0.07 inches, less than 0.06 inches, less than 0.05 inches, less than 0.04 inches, less than 0.03 inches, or less than 0.02 inches.

In the same or other discrete pill shaped void 312 embodiments, the plurality of discrete pill shaped voids 312 can be positioned in substantially horizontal rows and/or substantially vertical columns. In the exemplary embodiment of FIG. 11, the plurality of discrete pill shaped voids are arranged to form eleven rows and seventeen columns. In the embodiment of FIG. 12, the plurality of discrete pill shaped voids are arranged to form thirteen rows and seventeen columns. In alternative embodiments, the plurality of discrete pill shaped voids can be arranged to form two or more rows, three or more rows, four or more rows, five or more rows, six or more rows, seven or more rows, eight or more rows, nine or more rows, ten or more rows, eleven or more rows, twelve or more rows, thirteen or more rows, fourteen or more rows, fifteen or more rows, sixteen or more rows, seventeen or more rows, eighteen or more rows, nineteen or more rows, or twenty or more rows. In the same or alternative embodiments, the plurality of discrete pill shaped voids can be arranged to form two or more columns, three or more columns, four or more columns, five or more columns, six or more columns, seven or more columns, eight or more columns, nine or more columns, ten or more columns, eleven or more columns, twelve or more columns, thirteen or more columns, fourteen or more columns, fifteen or more columns, sixteen or more columns, seventeen or more columns, eighteen or more columns, nineteen or more columns, or twenty or more columns. As will be further described below, aligning the pill shaped voids 312 in rows and columns permits the appropriate ratio between the first and second material along a vertical reference axis.

As can be seen in the exemplary embodiment of FIGS. 10-13, each of the plurality of discrete pill shaped voids 312 are spaced from one another in both a heel-to-toe direction and a top rail-to-sole direction. This is dissimilar from the continuous groove or recesses embodiments of FIGS. 1-9 which are continuously connected in the heel-to-toe direction. Each row or column can have two or more discrete pill shaped voids, three or more discrete pill shaped voids, four or more discrete pill shaped voids, five or more discrete pill shaped voids, six or more discrete pill shaped voids, seven or more discrete pill shaped voids, eight or more discrete pill shaped voids, nine or more discrete pill shaped voids, ten or more discrete pill shaped voids, eleven or more discrete pill shaped voids, twelve or more discrete pill shaped voids, thirteen or more discrete pill shaped voids, fourteen or more discrete pill shaped voids, fifteen or more discrete pill shaped voids, sixteen or more discrete pill shaped voids, seventeen or more discrete pill shaped voids, eighteen or more discrete pill shaped voids, nineteen or more discrete pill shaped voids, or twenty or more discrete pill shaped voids.

The volume of the first material 309 that fills each discrete pill shaped void 312 can vary in a heel-to-toe direction. In many embodiments, first material 309 can fill a volume between 0.0000803 $in^3$-0.00104122 $in^3$. In some embodiments, the first material 309 can fill a volume between 0.0000803 $in^3$-0.00104122 $in^3$, 0.000176 $in^3$-0.00104122 $in^3$, 0.000272 $in^3$-0.00104122 $in^3$, 0.000368 $in^3$-0.00104122 $in^3$, 0.000464 $in^3$-0.00104122 $in^3$, 0.00056 $in^3$-0.00104122 $in^3$, 0.00065 $in^3$-0.00104122 $in^3$, 0.0075 $in^3$-0.0010422 $in^3$, 0.000849 $in^3$-0.0010422 $in^3$, or 0.000945 $in^3$-0.00104 $in^3$. In other embodiments, the first material 309 can fill a volume between 0.000160 $in^3$-0.00052061 $in^3$. Having the first material 309 fill discrete voids of this size more accurately controls the adjustment resolution between the first material and the second material to create a consistent ball speed across the striking surface and enhanced impact feel and sound.

In many of the discrete pill shaped void embodiments, when the club head is in an address position the striking surface comprises a striking surface imaginary vertical axis 320 that extends through a geometric center 308 of the striking surface 307 in a top rail-to-sole direction (as shown by FIGS. 11 and 12). Further, offset from the striking surface imaginary vertical axis in both a heel 303 and toe 302 direction at 0.25 inch and 0.50 inch are corresponding vertical reference axes 321, 322.

As further illustrated in FIGS. 11 and 12, adjacent discrete pill shaped voids 312 are closer to one another (i.e. packed more closely, small (second material) land area between discrete voids) along the striking surface imaginary vertical axis 320 in both a horizontal and vertical direction than at the vertical reference axis of 0.25 inch 321 and 0.5 inch 322. Similarly, adjacent discrete pill shaped voids 312 are closer to one another (i.e. packed more closely, smaller land (or second material) area in both a horizontal and vertical direction between discrete pill shaped voids 312) at the vertical reference axis of 0.25 inch 321 than at the vertical reference axis of 0.5 inch 322.

In many of the discrete pill shaped voids embodiments, the percentage of the first material 309 (or first material land area) along the 0.5-inch vertical reference axis 322 can be between approximately 20% and 40%. For example, the percentage of the first material 309 along the 0.5 inch vertical reference axis 322 can be 20%, 21%, 22%, 23%, 24%, 25%, 26%, 27%, 28%, 29%, 30%, 31%, 32%, 33%, 34%, 35%, 36%, 37%, 38%, 39%, or 40%. For further example, the percentage of the first material along the 0.5 inch vertical reference axis 322 can be greater than 20%, greater than 21%, greater than 22%, greater than 23%, greater than 24%, greater than 25%, greater than 26%, greater than 27%, greater than 28%, greater than 29%, greater than 30%, greater than 31%, greater than 32%, greater than 33%, greater than 34%, greater than 35%, greater than 36%, greater than 37%, greater than 38%, or greater than 39%. In alternative embodiments, the percentage of the first material 309 along the 0.5 inch vertical reference axis 322 can be less than 21%, less than 22%, less than 23%, less than 24%, less than 25%, less than 26%, less than 27%, less than 28%, less than 29%, less than 30%, less than 31%, less than 32%, less than 33%, less than 34%, less than 35%, less than 36%, less than 37%, less than 38%, less than 39%, or less than 40%, In many of the discrete pill shaped voids embodiments, the percentage of the first material 309 along the 0.25-inch vertical reference axis 321 can be between approximately 30% and 50%. For example, the percentage of the first material 309 along the 0.25 inch vertical reference axis 321 can be 30%, 31%, 32%, 33%, 34%, 35%, 36%, 37%, 38%, 39%, 40%, 41%, 42%, 43%, 44%, 45%, 46%, 47%, 48%, 49%, or 50%. For further example, the percentage of the first material 309 along the 0.25 inch vertical reference axis 321 can be greater than 30%, greater than 31%, greater than 32%, greater than 33%, greater than 34%, greater than 35%, greater than 36%, greater than 37%, greater than 38%, greater than 39%, greater than 40%, greater than 41%, greater than 42%, greater than 43%, greater than 44%, greater than 45%, greater than 46%, greater than 47%, greater than 48%, or greater than 49%. In alternative embodiments, the percentage of the first material 309 along the 0.25 inch vertical reference axis 321 can be less than 31%, less than 32%, less than 33%, less than 34%, less than 35%, less than 36%, less than 37%, less than 38%, less than 39%, less than 40%, less than 41%, less than 42%, less than 43%, less than 44%, less than 45%, less than 46%, less than 47%, less than 48%, less than 49%, or less than 50%, In many of the discrete pill shaped voids embodiments, the percentage of the first material 309 along the striking surface imaginary axis 320 can between approximately 40% and 60%. For example, the percentage of the first material 309 along the striking surface imaginary axis can be 40%, 41%, 42%, 43%, 44%, 45%, 46%, 47%, 48%, 49%, 50%, 51%, 52%, 53%, 54%, 55%, 56%, 57%, 58%, 59%, or 60%. For further example, the percentage of the first material 309 along the striking surface imaginary axis 320 can be greater than 40%, greater than 41%, greater than 42%, greater than 43%, greater than 44%, greater than 45%, greater than 46%, greater than 47%, greater than 48%, greater than 49%, greater than 50%, greater than 51%, greater than 52%, greater than 53%, greater than 54%, greater than 55%, greater than 56%, greater than 57%, greater than 58%, or greater than 59%. In alternative embodiments, the percentage of the first material 309 along the striking surface imaginary axis 320 can be less than 41%, less than 42%, less than 43%, less than 44%, less than 45%, less than 46%, less than 47%, less than 48%, less than 49%, less than 50%, less than 51%, less than 52%, less than 53%, less than 54%, less than 55%, less than 56%, less than 57%, less than 58%, less than 59%, or less than 60%, Further, in many embodiments, the average ratio defined as the surface area of the first material land area percentage 309 to the surface area of the second material land area percentage 310 (measured along a respective vertical references axis) decreases from the striking surface imaginary vertical axis 320 to the 0.5-inch vertical reference axis 322. This type of arrangement of the first material and the second material aid in providing consistent ball speeds across the striking surface as the average ratio along the striking surface imaginary vertical axis is greater (i.e. softer) than the average ratio along the 0.5 inch vertical reference axis. This counteracts the loss of energy transfer on heel and toe mishits.

Additionally, in this exemplary embodiment, variable width, variable thickness, and/or even variable depth discrete voids are not needed to create consistent ball speeds across the striking surface. Consistent ball speeds are achieved as the discrete pill shaped voids vary in length (in a heel-to-toe direction) creating differing first and second material ratios measured along in a top rail-to-sole direction.

Discrete Voids (Hexagonal Shape)

Figure 14:
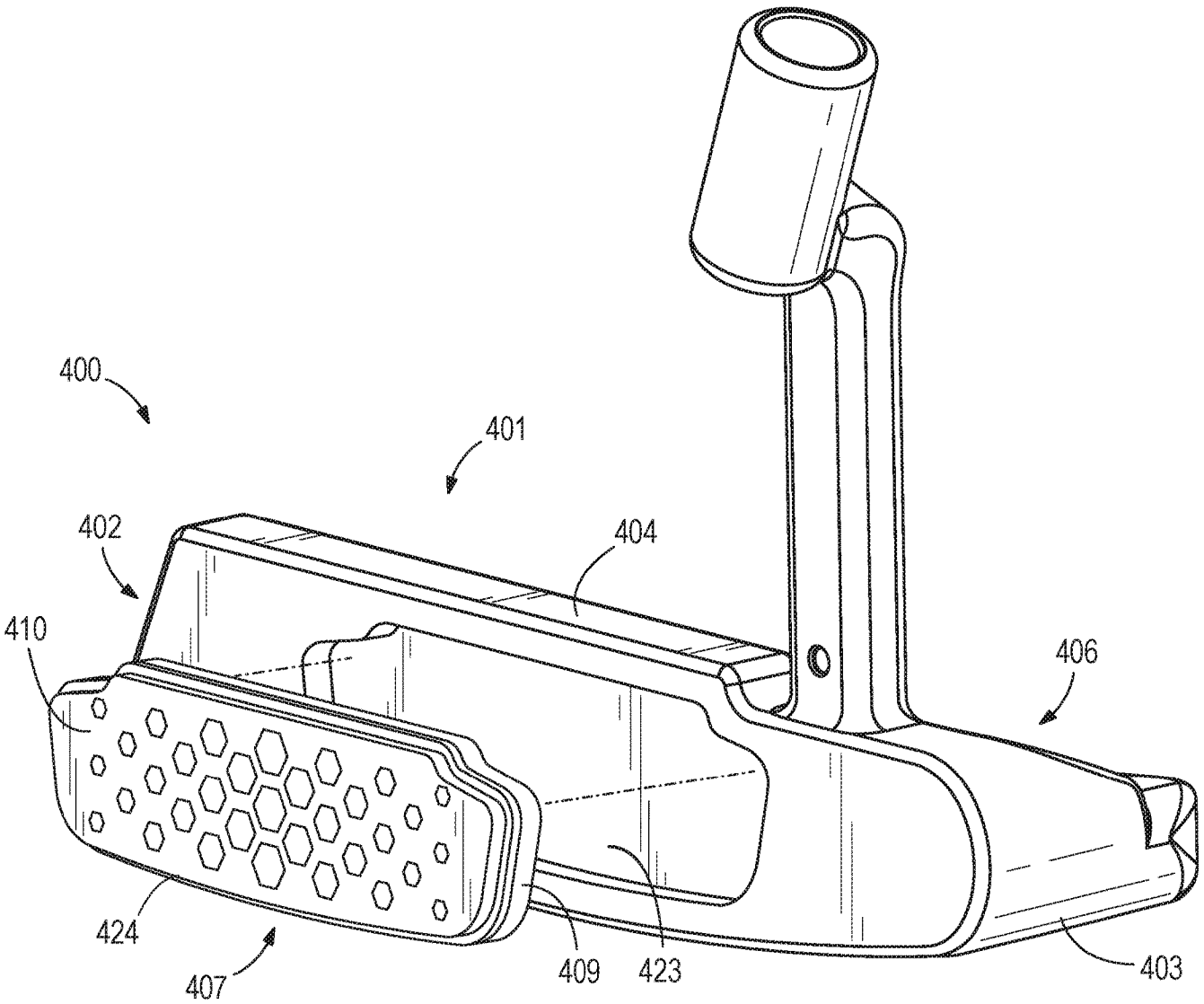
FIG. 14 shows a partially assembled view of a striking surface having discrete hexagonal shaped voids for an insert style club head according to one embodiment.
Figure 15:
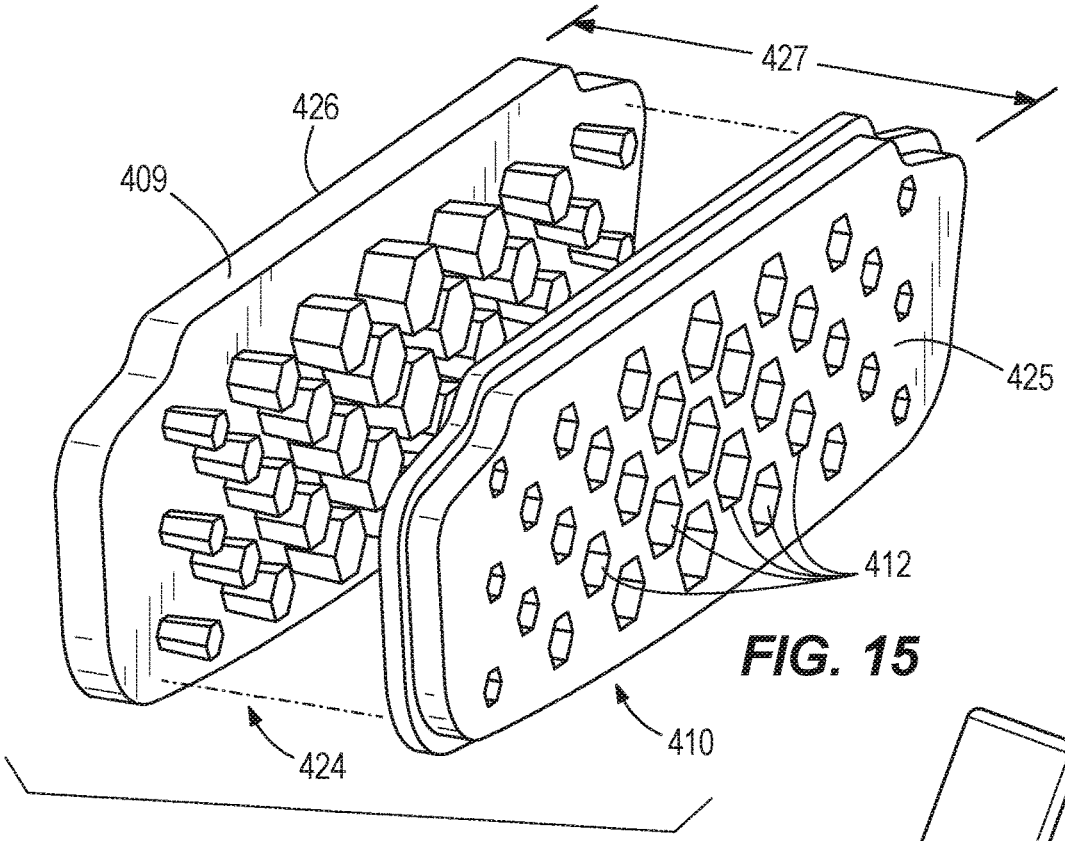
FIG. 15 shows an exploded view of the insert having discrete hexagonal voids of FIG. 14.
Figure 16:
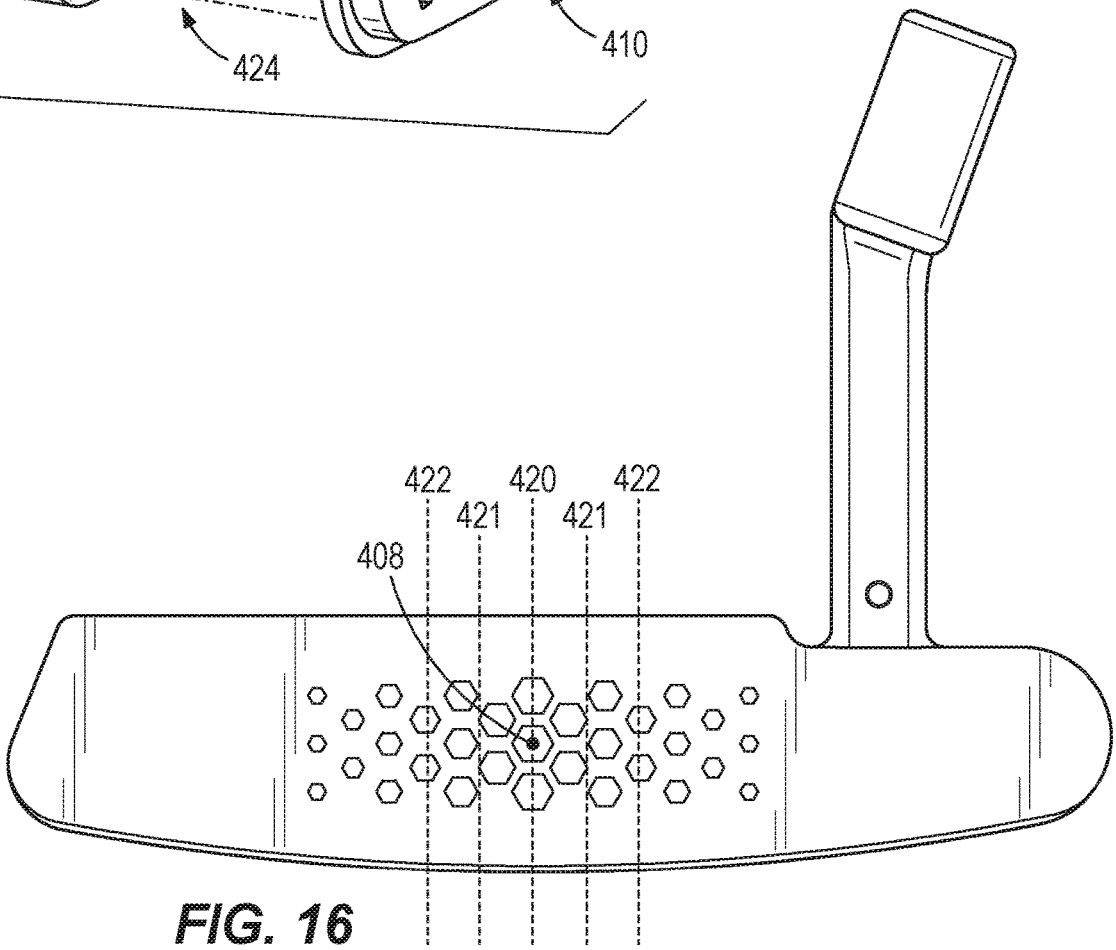
FIG. 16 shows an assembled face on view of FIG. 14.

FIGS. 14-16 illustrate another exemplary embodiment according to the invention described herein. More particularly, FIGS. 14-16 illustrate an example of a putter-type golf club head 400 comprising a dual-material striking surface 407 comprising a first material 409 and a second material 410. The golf club head 400 of FIGS. 14-16 and the golf club head 300 of FIGS. 10-13 are similar in many respects, except for that the golf club head 400 comprises discrete voids that are hexagonal in shape rather than pill shaped.

FIG. 14 illustrates a putter-type golf club head 400 comprising a putter-body 401 having a toe portion 402, a heel portion 403 opposite the toe portion 402, a top rail portion 404, a sole portion 405 opposite the top rail portion 404, a portion of a striking surface 407, and a rear portion 406 opposite the striking surface portion 407. The striking surface portion 407 can further define a striking surface recess 423 defined by the heel portion 403, the toe portion 402, the top rail portion 404, the sole portion 405, and the rear portion 406 of the putter body 401.

FIG. 15 illustrates a two-part putter insert 424 comprising discrete hexagonal voids. In many embodiments, the putter insert 424 can be received within and complementary with the striking surface recess 423. However, it should be noted in alternative embodiments, the putter-type golf club head 400 need not to be an insert style putter.

FIGS. 14-16 illustrate the putter insert 424 comprising a first material 409 (also can be referred to as "first part") and a second material 410 (also can be referred to as "second part"). With specific reference to FIG. 15, the second part forms (or defines) a plurality of discrete hexagonal shaped voids 412. These discrete hexagonal shaped voids are arranged in rows and columns and do not connect (or touch) another hexagonal shaped void. The first material has a hardness less than the second material.

The second material surrounds the hexagonal shaped void to form second material land areas. The first part of the putter insert 424 comprises a plurality of protruding hexagonal shaped geometries that are complimentary to a corresponding hexagonal pill shaped void 412. Upon coupling, the first part and the second part together, the plurality of protruding hexagonal shaped voids can be flush with the second material land areas. Thereby, permitting the plurality of protruding discrete hexagonal shaped voids to form first material land areas. The first material land areas and the second material land engage with at least a portion of the golf ball upon golf ball impact.

This embodiment illustrates one possible arrangement where hexagonal voids are arranged to form a denser, more packed center region creating more first material land areas than second material land areas. Referencing FIG. 16, it can be seen that in any given row the hexagonal shaped voids having the greatest widths are proximate to the center region and the hexagonal shaped voids having the smallest widths are distal from the center region. This arrangement creates a center region having a greater amount of first material land areas than second material land area. This creates a center region that is less responsive to ball impacts relative to heel end or toe regions. In a top rail to sole direction, the widths of the first material land are substantially the same or constant. Therefore, as the widths of the discrete hexagonal voids decreases away from the center region, the ratio between the first material and the second material varies too.

Moving away from the center region toward the heel or toe along a given row, the spacing distance between adjacent discrete hexagonal shaped voids increases (i.e. the length of the discrete hexagonal shaped voids decrease. This creates more second material land areas, which aids in gradually creating a more responsive region away from the center region towards the heel and toe regions to consistently control ball speeds across the striking surface.

With continued reference FIG. 15, FIG. 15 illustrates an exploded view of the putter insert 424 comprising discrete hexagonal shaped voids. The insert 424 can comprise of a front surface 425 adapted for impact with a golf ball (not shown) and a rear surface 426 opposite the front portion. A putter insert thickness (i.e. depth) 427 can be defined as the maximum perpendicular distance between the front surface 425 and the rear surface 426. For example, FIG. 15 illustrates the insert 424 having a plurality of discrete hexagonal voids 412 (defined by the second material) extending entirely through the second material 410 thickness (i.e. depth).

Further, in many embodiments, the first material 409 can entirely cover the rear surface 426 of the insert 424. In other words, the rear surface 426 is devoid of the second material 410. In many embodiments, the first material 409 further fills each of the discrete hexagonal voids 412 (until flush with the front surface 425 of the insert) of the pluralities of discrete hexagonal shaped voids, so that at the front surface 425 the second material 410 surrounds the first material 409, so that upon golf ball impact the first material 409 and the second material 410 can engage to least a portion of the golf ball.

Each discrete hexagonal shape void can be defined as a six-sided polygon with six internal angles and six vertices. Each internal angle 431 of the six internal angles can be approximately 120 degrees. The internal angles add up to approximately 720 degrees. Each side of the six-sided polygon can be equal or substantially equal in length.

The maximum length of each discrete hexagonal shaped void 412 (measured in a heel-to-toe direction) can vary in a heel-to-toe direction. In many embodiments, the maximum length of each discrete hexagonal shape 412 void can be between 0.03 inches and 0.40 inches. For example, the maximum length of each of the plurality of discrete hexagonal shaped voids 412 can be between 0.03 inches-0.40 inches, 0.04 inches-0.40 inches, 0.05 inches-0.40 inches, 0.06 inches-0.40 inches, 0.07 inches-0.40 inches, 0.08 inches-0.40 inches, 0.09 inches-0.40 inches, 0.10 inches-0.40 inches, 0.11 inches-0.40 inches, 0.12 inches-0.40 inches, 0.13 inches-0.40 inches, 0.14 inches-0.40 inches, or 0.15 inches-0.40 inches. In other embodiments, the maximum length of each discrete hexagonal void 412 can vary between 0.074 inches and 0.17 inches.

In other embodiments, the maximum length of each discrete hexagonal shaped void 412 can be less than 0.30 inches, less than 0.29 inches, less than 0.28 inches, less than 0.27 inches, less than 0.26 inches, less than 0.25 inches, less than 0.24 inches, less than 0.23 inches, less than 0.22 inches, less than 0.21 inches, less than 0.20 inches, less than 0.19 inches, less than 0.18 inches, less than 0.17 inches, less than 0.16 inches, less than 0.15 inches, less than 0.14 inches, less than 0.13 inches, less than 0.12 inches, less than 0.11 inches, less than 0.10 inches, less than 0.09 inches, less than 0.08 inches, less than 0.07 inches, less than 0.06 inches, less than 0.05 inches, or less than 0.04 inches.

The maximum width of each discrete hexagonal shaped void 412 of the plurality of hexagonal shaped voids (measured in a top rail-to-sole direction) can vary. In many embodiments, the maximum width of each discrete hexagonal shaped void 412 can be between 0.03 inches and 0.40 inches. For example, the maximum width of each discrete hexagonal void 412 can be greater than 0.03 inches, greater than 0.04 inches, greater than 0.05 inches, greater than 0.06 inches, greater than 0.07 inches, greater than 0.08 inches, greater than 0.09 inches, greater than 0.10 inches, greater than 0.11 inches, greater than 0.12 inches, greater than 0.13 inches, greater than 0.14 inches, greater than 0.15 inches, greater than 0.16 inches, greater than 0.17 inches, greater than 0.18 inches, greater than 0.19 inches, or greater than 0.20 inches. In other embodiments, the maximum width of each discrete hexagonal shaped void 412 can be less than 0.20 inches, less than 0.19 inches, less than 0.18 inches, less than 0.17 inches, less than 0.16 inches, less than 0.15 inches, less than 0.14 inches, less than 0.13 inches, less than 0.12 inches, less than 0.11 inches, or less than 0.10 inches.

In the same or other of discrete hexagonal shaped void 412 embodiments, the plurality of discrete hexagonal shaped voids 412 can be positioned in substantially horizontal rows and/or substantially vertical columns. In the exemplary embodiment of FIG. 16, the plurality of discrete hexagonal shaped voids are arranged to form five rows and thirteen columns. In alternative embodiments, the plurality of discrete hexagonal shaped voids can be arranged to form two or more rows, three or more rows, four or more rows, five or more rows, six or more rows, seven or more rows, eight or more rows, nine or more rows, ten or more rows, eleven or more rows, twelve or more rows, thirteen or more rows, fourteen or more rows, fifteen or more rows, sixteen or more rows, seventeen or more rows, eighteen or more rows, nineteen or more rows, or twenty or more rows. In the same or alternative embodiments, the plurality of discrete hexagonal shaped voids can be arranged to form two or more columns, three or more columns, four or more columns, five or more columns, six or more columns, seven or more columns, eight or more columns, nine or more columns, ten or more columns, eleven or more columns, twelve or more columns, thirteen or more columns, fourteen or more columns, fifteen or more columns, sixteen or more columns, seventeen or more columns, eighteen or more columns, nineteen or more columns, or twenty or more columns. As will be further described below, aligning the hexagonal shaped voids 412 in rows and columns permits an appropriate ratio between the first and second material along a vertical reference axis.

As can be seen in the exemplary embodiment of FIGS. 14-16, each of the plurality of discrete hexagonal shaped voids 412 are spaced from one another in both a heel-to-toe direction and a top rail-to-sole direction. This is dissimilar from the continuous groove or recesses embodiments of FIGS. 1-9 which are continuously connected in the heel-to-toe direction. Each row or column can have two or more discrete hexagonal shaped voids, three or more discrete hexagonal shaped voids, four or more discrete hexagonal shaped voids, five or more discrete hexagonal shaped voids, six or more discrete hexagonal shaped voids, seven or more discrete hexagonal shaped voids, eight or more discrete hexagonal shaped voids, nine or more discrete hexagonal shaped voids, ten or more discrete hexagonal shaped voids, eleven or more discrete hexagonal shaped voids, twelve or more discrete hexagonal shaped voids, thirteen or more discrete hexagonal shaped voids, fourteen or more discrete hexagonal shaped voids, fifteen or more discrete hexagonal shaped voids, sixteen or more discrete hexagonal shaped voids, seventeen or more discrete hexagonal shaped voids, eighteen or more discrete hexagonal shaped voids, nineteen or more discrete hexagonal shaped voids, or twenty or more discrete hexagonal shaped voids.

The volume of the first material 409 that fills each discrete hexagonal shaped void 412 can vary in a heel-to-toe direction. In many embodiments, first material 409 can fill a volume between 0.0000803 $in^3$-0.004 $in^3$. In some embodiments, the first material 409 can fill a volume between 0.0000803 $in^3$-0.004 $in^3$, 0.000176 $in^3$-0.004 $in^3$, 0.000272 $in^3$-0.004 $in^3$, 0.000368 $in^3$-0.004 $in^3$, 0.000464 $in^3$-0.004 $in^3$, 0.00056 $in^3$-0.004 $in^3$, 0.00065 $in^3$-0.004 $in^3$, 0.0075 $in^3$-0.004 $in^3$, 0.000849 $in^3$-0.004 $in^3$, or 0.000945 $in^3$-0.004 $in^3$. In other embodiments, the first material 409 can fill a volume between 0.00035 $in^3$-0.00187 $in^3$. Having the first material 409 fill discrete voids of this size more accurately controls the adjustment resolution between the first material and the second material to create a consistent ball speed across the striking surface and enhanced impact feel and sound.

In many of the discrete hexagonal void embodiments, when the club head is an address position the striking surface comprises a striking surface imaginary vertical axis 420 that extends through a geometric center 408 of the striking surface 407 in a top rail-to-sole direction (as shown by FIG. 16). Further, offset from the striking surface imaginary vertical axis in both a heel 403 and toe 402 direction at 0.25 inch and 0.50 inch are corresponding vertical reference axes.

As further illustrated in FIGS. 16, adjacent discrete hexagonal shaped voids 412 are closer to one another (i.e. packed more closely, small (second material) land area between discrete voids) along the striking surface imaginary vertical axis 420 in both a horizontal and vertical direction than at the vertical reference axis of 0.25 inch 421 and 0.5 inch 422. Similarly, adjacent discrete hexagonal shaped voids 412 are closer to one another (i.e. packed more closely, smaller land (or second material) area in both a horizontal and vertical direction between discrete hexagonal shaped voids 412) at the vertical reference axis of 0.25 inch 421 than at the vertical reference axis of 0.5 inch 422.

In many of the discrete hexagonal shaped voids embodiments, the percentage of the first material 409 along the 0.5-inch vertical reference axis 422 can between approximately 20% and 40%. For example, the percentage of the first material 409 along the 0.5 inch vertical reference axis 422 can be 20%, 21%, 22%, 23%, 24%, 25%, 26%, 27%, 28%, 29%, 30%, 31%, 32%, 33%, 34%, 35%, 36%, 37%, 38%, 39%, or 40%. For further example, the percentage of the first material along the 0.5 inch vertical reference axis 422 can be greater than 20%, greater than 21%, greater than 22%, greater than 23%, greater than 24%, greater than 25%, greater than 26%, greater than 27%, greater than 28%, greater than 29%, greater than 30%, greater than 31%, greater than 32%, greater than 33%, greater than 34%, greater than 35%, greater than 36%, greater than 37%, greater than 38%, or greater than 39%. In alternative embodiments, the percentage of the first material 409 along the 0.5 inch vertical reference axis 422 can be less than 21%, less than 22%, less than 23%, less than 24%, less than 25%, less than 26%, less than 27%, less than 28%, less than 29%, less than 30%, less than 31%, less than 32%, less than 33%, less than 34%, less than 35%, less than 36%, less than 37%, less than 38%, less than 39%, or less than 40%, In many of the discrete hexagonal shaped voids embodiments, the percentage of the first material 409 (or first material land area) along the 0.25-inch vertical reference axis 421 can be between approximately 30% and 50%. For example, the percentage of the first material 409 along the 0.25 inch vertical reference axis 421 can be 30%, 31%, 32%, 33%, 34%, 35%, 36%, 37%, 38%, 39%, 40%, 41%, 42%, 43%, 44%, 45%, 46%, 47%, 48%, 49%, or 50%. For further example, the percentage of the first material 409 along the 0.25 inch vertical reference axis 421 can be greater than 30%, greater than 31%, greater than 32%, greater than 33%, greater than 34%, greater than 35%, greater than 36%, greater than 37%, greater than 38%, greater than 39%, greater than 40%, greater than 41%, greater than 42%, greater than 43%, greater than 44%, greater than 45%, greater than 46%, greater than 47%, greater than 48%, or greater than 49%. In alternative embodiments, the percentage of the first material 409 along the 0.25 inch vertical reference axis 421 can be less than 31%, less than 32%, less than 33%, less than 34%, less than 35%, less than 36%, less than 37%, less than 38%, less than 39%, less than 40%, less than 41%, less than 42%, less than 43%, less than 44%, less than 45%, less than 46%, less than 47%, less than 48%, less than 49%, or less than 50%, In many of the discrete hexagonal shaped voids embodiments, the percentage of the first material 409 (or first material land area) along the striking surface imaginary axis 420 can between approximately 40% and 60%. For example, the percentage of the first material 409 along the striking surface imaginary axis can be 40%, 41%, 42%, 43%, 44%, 45%, 46%, 47%, 48%, 49%, 50%, 51%, 52%, 53%, 54%, 55%, 56%, 57%, 58%, 59%, or 60%. For further example, the percentage of the first material 409 along the striking surface imaginary axis 420 can be greater than 40%, greater than 41%, greater than 42%, greater than 43%, greater than 44%, greater than 45%, greater than 46%, greater than 47%, greater than 48%, greater than 49%, greater than 50%, greater than 51%, greater than 52%, greater than 53%, greater than 54%, greater than 55%, greater than 56%, greater than 57%, greater than 58%, or greater than 59%. In alternative embodiments, the percentage of the first material 409 along the striking surface imaginary axis 420 can be less than 41%, less than 42%, less than 43%, less than 44%, less than 45%, less than 46%, less than 47%, less than 48%, less than 49%, less than 50%, less than 51%, less than 52%, less than 53%, less than 54%, less than 55%, less than 56%, less than 57%, less than 58%, less than 59%, or less than 60%, Further, in many embodiments, the average ratio defined as the surface area of the first material land area percentage 409 to the surface area of the second material land area percentage 410 (measured along a respective vertical references axis) decreases from the striking surface imaginary vertical axis 420 to the 0.5-inch vertical reference axis 422. This type of arrangement of the first material and the second material aid in providing consistent ball speeds across the striking surface as the average ratio along the striking surface imaginary vertical axis is greater (i.e. softer) than the average ratio along the 0.5 inch vertical reference axis. This counteracts the loss of energy transfer on heel and toe mishits.

Additionally, in this exemplary embodiment, variable width (in a top rail-to-sole direction along columns) and/or even variable thickness (or depth) discrete voids are not needed to create consistent ball speeds across the striking surface. Consistent ball speeds are achieved as the discrete hexagonal shaped voids vary in length (in a heel-to-toe direction) creating differing first and second material ratios along a vertical direction.

Continuous Grooves (Insert Style Putter)

Figure 17:
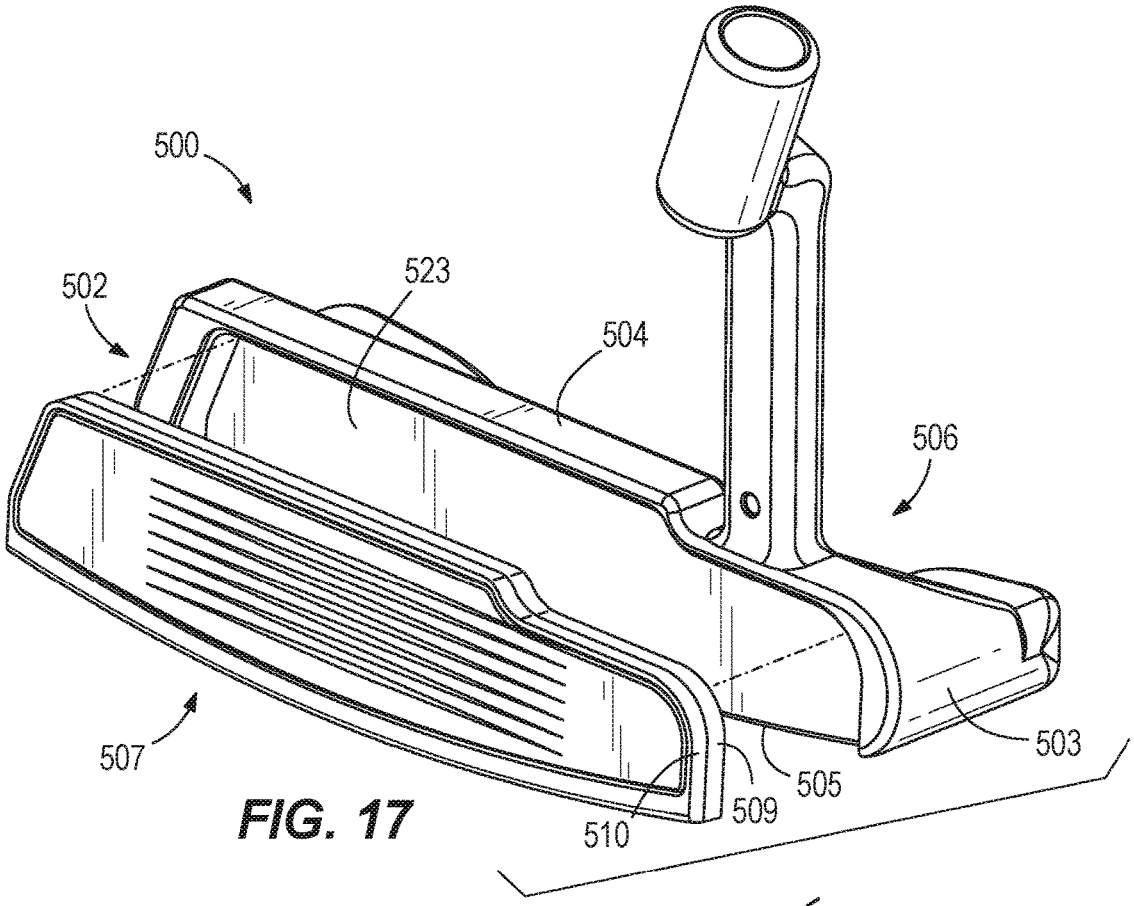
FIG. 17 shows a heel side perspective view of a striking surface having continuous grooves for an insert style club head according to one embodiment.
Figure 18:
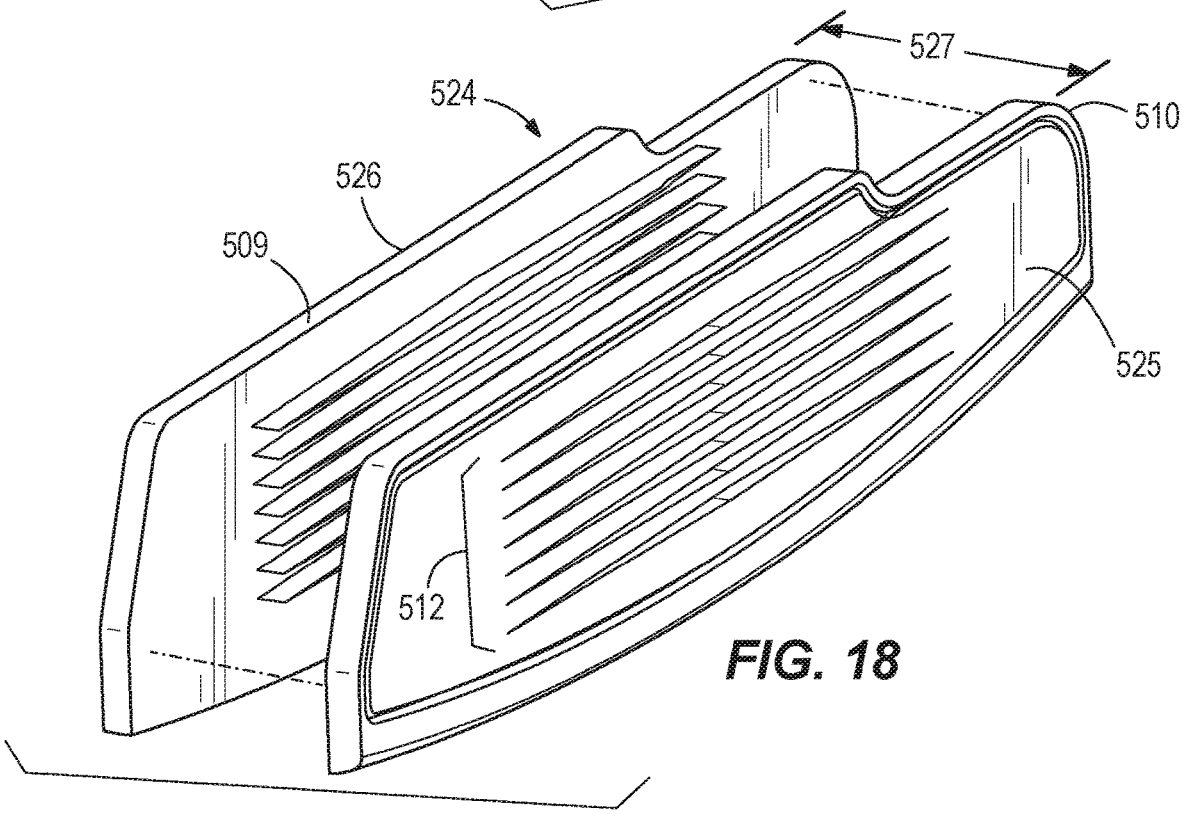
FIG. 18 shows an exploded view of the insert of FIG. 17.
Figure 19:
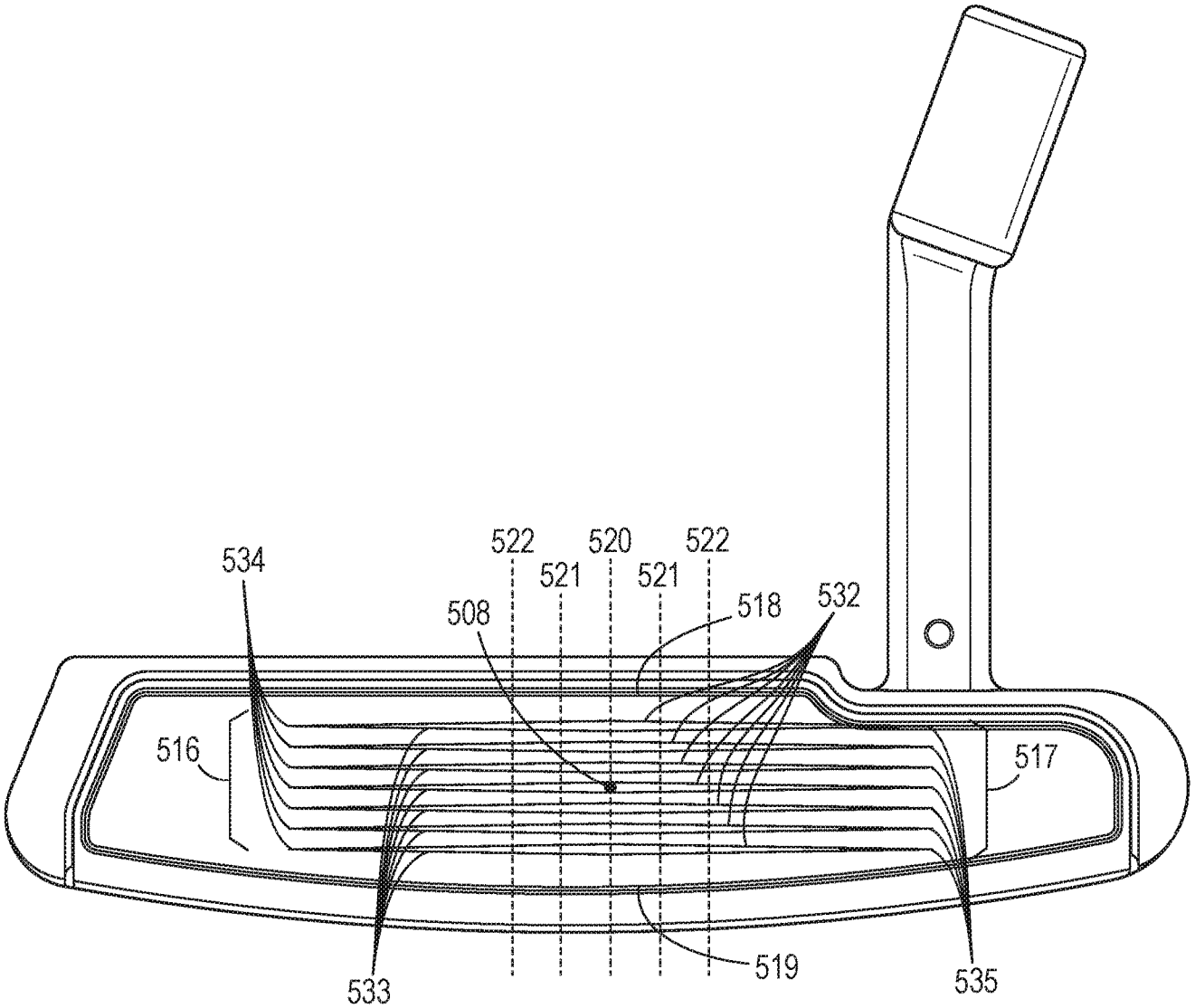
FIG. 19 shows an assembled face on view of FIG. 17.

FIGS. 17-19 illustrate another exemplary embodiment. More particularly, FIGS. 17-19 illustrate an example of a putter-type golf club head 500 comprising a dual-material striking surface 507 comprising a first material 509 and a second material 510. The golf club head 500 of FIGS. 17-19 are similar in many respects to the above described embodiments.

The putter-type golf club head of FIGS. 17-19 comprises a putter-body 501 having a toe portion 502, a heel portion 503 opposite the toe portion 502, a top rail portion 504, a sole portion 505 opposite the top rail portion 504, a portion of a striking surface 507, and a rear portion 506 opposite the striking surface portion 507. The striking surface portion 507 further defines a striking surface recess 523 defined by the heel portion 503, the toe portion 502, the top rail portion 504, the sole portion 505, and the rear portion 506 of the putter body 501.

FIGS. 17-19 illustrate a putter insert 524 comprising a first material 509 (can also be referred to as "first part") and a second material 510 (can also be referred to as "second part"). With specific reference to FIG. 18, the second part forms (or defines) a plurality of continuous groove voids 512 and the second material 510 surrounding the plurality of continuous groove voids can be defined as second material land areas. The first part of the putter insert 524 comprises a plurality of protruding geometries that are complimentary to a corresponding continuous groove void 512. Upon coupling, the first part and the second part of the insert 524 together, the plurality of protruding geometries can be flush with the second material land areas. Therefore, the plurality of protruding geometries can also form first material land areas. The first material land areas and the second material land can engage with at least a portion of the golf ball upon golf ball impact.

This embodiment illustrates one possible arrangement where each continuous groove voids 412 defines an upper inflection point and lower inflection point. The upper and lower inflection point are centrally positioned on the striking surface. This allows the maximum width of each of the continuous groove void to be centrally located on the striking surface in a top rail-to-sole direction and a heel-to-toe direction. The first material has a hardness less than the second material. This creates a denser, more packed center region having more first material land areas than second material land areas. Having a greater amount of first material land areas than second material land area aids in creating a center region that is less responsive to ball impacts than areas toward and at the heel end or toe ends.

Moving away from the center region in a heel and/or toe direction, the spacing distance between adjacent arcuate portions increases to introduce more second material land areas. This creates a gradually more responsive region from the center region towards the heel and toe regions to control ball speeds more consistently across the striking surface.

Referencing FIG. 18, FIG. 18 illustrates a perspective view of a putter insert 524. In many embodiments, the putter insert 524 can be received within and complementary with the striking surface recess 523. The putter insert 524 can comprise of a front surface 525 adapted for impact with a golf ball (not shown) and a rear surface 526 opposite the front portion.

A putter insert thickness 527 can be defined as the maximum perpendicular distance between the front surface 525 and the rear surface 526. For example, FIG. 18 illustrates the insert 524 having a plurality of continuous groove voids 512 (defined by the second material) extending entirely through the second material 510 thickness. In many embodiments, the first material, the second material, and/or the combination of the first and second material can be of a constant thickness.

Further, in many embodiments and as illustrated herein, the first material 509 entirely covers the rear surface 526 of the insert 524. In other words, the rear surface 526 is devoid of the second material 510. In many embodiments, the first material 509 further fully fills (or fully occupies) each continuous groove void (until flush with the front surface 525 of the insert) of the pluralities of continuous groove voids, so that at the front surface 525 the second material 510 surrounds the first material 509, so that upon golf ball impact the first material 509 and the second material 510 are engaged to least a portion of the golf ball.

The plurality of continuous groove voids 512 defined by the putter insert 524 can resemble many shapes or geometries. For example, in this exemplary embodiment illustrated herein the continuous groove voids 512 extend substantially horizontal in a heel-to-toe direction. Each groove continuous groove 512 of the plurality of continuous grooves 512 defines an upper continuous groove wall 532 proximal to the upper border of the striking surface 518, a lower continuous groove wall proximal 533 to the lower border of the striking surface 519, a first continuous groove vertex 534 proximal to the toe portion, and a second continuous groove vertex 535 proximal to the heel portion.

In many embodiments, the upper continuous groove wall 532 continuously decreases from the striking surface imaginary vertical axis 520 to a first continuous groove vertex 534 and a second continuous vertex 535. Stated another way, the upper continuous groove wall 532 defines an upper inflection point along the upper continuous groove wall at the striking surface imaginary vertical axis 520 and a lower inflection point along the lower continuous groove wall 533 at the striking surface imaginary axis 520. At the first end 516 and the second end 517 of the continuous groove voids 512, the upper continuous groove wall 532 and the lower continuous groove wall 533 meet to define a first continuous groove vertex 534 and a second continuous groove vertex 535.

In alternative embodiments of putter-type golf club heads having continuous groove voids 512, the second material 510 can define one or more continuous groove voids 512, two or more continuous groove voids 512, three or more continuous groove voids 512, four or more continuous groove voids 512, five or more continuous groove voids 512, six or more continuous groove voids 512, seven or more continuous groove voids 512, eight or more continuous groove voids 512, nine or more continuous groove voids 512, ten or more continuous groove voids 512, or eleven or more continuous groove voids 512.

Each of the continuous groove voids can have a maximum width measured at the striking surface imaginary vertical axis 520 in a top rail 504-to-sole 505 direction. In many embodiments, the maximum width of each continuous groove void 520 can range between 0.020 inch to 0.060 inch. For example, the maximum width of the continuous groove voids 520 can be approximately 0.020 inches, approximately, 0.021 inches, approximately 0.022 inches, approximately 0.023 inches, approximately 0.024 inches, approximately 0.025 inches, approximately 0.026 inches, approximately 0.027 inches, approximately 0.028 inches, approximately 0.029 inches, approximately 0.030 inches, approximately 0.031 inches, approximately 0.032 inches, approximately 0.033 inches, approximately 0.034 inches, approximately 0.035 inches, approximately 0.036 inches, approximately 0.037 inches, approximately 0.038 inches, approximately 0.039 inches, approximately 0.040 inches, approximately 0.041 inches, approximately 0.042 inches, approximately 0.043 inches, approximately 0.044 inches, approximately 0.045 inches, approximately 0.046 inches, approximately 0.047 inches, approximately 0.048 inches, approximately 0.049 inches, approximately 0.050 inches, approximately 0.051 inches, approximately 0.052 inches, approximately 0.053 inches, approximately 0.054 inches, approximately 0.055 inches, approximately 0.056 inches, approximately 0.057 inches, approximately 0.058 inches, approximately 0.059 inches, or approximately 0.060 inches. The width of the continuous groove voids 512 at the first continuous groove vertex and a second continuous groove are less than 0.0001 inch and preferably 0 inch.

In many embodiments, each continuous groove void 512 of the plurality of continuous groove voids can have a maximum length (measured in a heel 503-to-toe 502 direction) that is between 30% and 100% of the maximum length of the striking surface 507. For example, each continuous groove void of the plurality of continuous groove voids 512 can have a maximum length that is greater than 30% of the striking surface 507, greater than 35% of the striking surface 507, greater than 40% of the striking surface 507, greater than 45% of the striking surface 507, greater than 50% of the striking surface 507, greater than 55% of the striking surface 507, greater than 60% of the striking surface 507, greater than 65% of the striking surface 507, greater than 70% of the striking surface 507, greater than 75% of striking surface 507, greater than 80% of the striking surface 507, greater than 85% of the striking surface 507, greater than 90% of the striking surface 507, or greater than 95% of the striking surface 507.

In many embodiments to control the relationship (or ratio) between the first material 509 and the second material 510, the width of the continuous groove voids decreases from the striking surface imaginary vertical axis 520 to a virtually zero width at the first continuous groove vertex and/or from the striking surface imaginary vertical axis to a virtually zero width at the second continuous groove vertex. This type of void geometry accurately controls the amount of land areas (or second material area) between adjacent continuous groove voids in a vertical direction to reached predetermined first material-to-second material thresholds.

In many of the continuous groove void embodiments and as described above when the club head is an address position the striking surface comprises a striking surface imaginary vertical axis 520 that extends through a geometric center 508 of the striking surface 507 in a top rail-to-sole direction (as shown by FIG. 19). Further, offset from the striking surface imaginary vertical axis in both a heel 503 and toe 502 direction at 0.25 inch and 0.50 inch are corresponding vertical reference axes.

As further illustrated in FIG. 19, adjacent continuous groove voids are closer to one another (i.e. packed more closely, small land area between grooves) along the striking surface imaginary vertical axis 520 than at the vertical reference axis of 0.25 inch 521 and 0.5 inch 522. Similarly, adjacent continuous grooves are closer to one another (i.e.

packed more closely, smaller land (or second material) area between groove voids) at the vertical reference axis of 0.25 inch 521 than at the vertical reference axis of 0.5 inch 522.

In many of the continuous groove void embodiments, the percentage of the first material (or first material land area) along the 0.5-inch vertical reference axis can between approximately 20% and 40%. For example, the percentage of the first material along the 0.5 inch vertical reference axis can be 20%, 21%, 22%, 23%, 24%, 25%, 26%, 27%, 28%, 29%, 30%, 31%, 32%, 33%, 34%, 35%, 36%, 37%, 38%, 39%, or 40%. For further example, the percentage of the first material along the 0.5 inch vertical reference axis can be greater than 20%, greater than 21%, greater than 22%, greater than 23%, greater than 24%, greater than 25%, greater than 26%, greater than 27%, greater than 28%, greater than 29%, greater than 30%, greater than 31%, greater than 32%, greater than 33%, greater than 34%, greater than 35%, greater than 36%, greater than 37%, greater than 38%, or greater than 39%. In alternative embodiments, the percentage of the first material along the 0.5 inch vertical reference axis can be less than 21%, less than 22%, less than 23%, less than 24%, less than 25%, less than 26%, less than 27%, less than 28%, less than 29%, less than 30%, less than 31%, less than 32%, less than 33%, less than 34%, less than 35%, less than 36%, less than 37%, less than 38%, less than 39%, or less than 40%, In many of the continuous groove embodiments, the percentage of the first material (or first material land area) along the 0.25-inch vertical reference axis can be between approximately 30% and 50%. For example, the percentage of the first material along the 0.25 inch vertical reference axis can be 30%, 31%, 32%, 33%, 34%, 35%, 36%, 37%, 38%, 39%, 40%, 41%, 42%, 43%, 44%, 45%, 46%, 47%, 48%, 49%, or 50%. For further example, the percentage of the first material along the 0.25 inch vertical reference axis can be greater than 30%, greater than 31%, greater than 32%, greater than 33%, greater than 34%, greater than 35%, greater than 36%, greater than 37%, greater than 38%, greater than 39%, greater than 40%, greater than 41%, greater than 42%, greater than 43%, greater than 44%, greater than 45%, greater than 46%, greater than 47%, greater than 48%, or greater than 49%. In alternative embodiments, the percentage of the first material along the 0.25 inch vertical reference axis can be less than 31%, less than 32%, less than 33%, less than 34%, less than 35%, less than 36%, less than 37%, less than 38%, less than 39%, less than 40%, less than 41%, less than 42%, less than 43%, less than 44%, less than 45%, less than 46%, less than 47%, less than 48%, less than 49%, or less than 50%, In many of the continuous groove embodiments, the percentage of the first material (or first material land area) along the striking surface imaginary axis can between approximately 40% and 60%. For example, the percentage of the first material along the striking surface imaginary axis can be 40%, 41%, 42%, 43%, 44%, 45%, 46%, 47%, 48%, 49%, 50%, 51%, 52%, 53%, 54%, 55%, 56%, 57%, 58%, 59%, or 60%. For further example, the percentage of the first material along the striking surface imaginary axis can be greater than 40%, greater than 41%, greater than 42%, greater than 43%, greater than 44%, greater than 45%, greater than 46%, greater than 47%, greater than 48%, greater than 49%, greater than 50%, greater than 51%, greater than 52%, greater than 53%, greater than 54%, greater than 55%, greater than 56%, greater than 57%, greater than 58%, or greater than 59%. In alternative embodiments, the percentage of the first material along the striking surface imaginary axis can be less than 41%, less than 42%, less than 43%, less than 44%, less than 45%, less than 46%, less than 47%, less than 48%, less than 49%, less than 50%, less than 51%, less than 52%, less than 53%, less than 54%, less than 55%, less than 56%, less than 57%, less than 58%, less than 59%, or less than 60%, Further, in many embodiments, the average ratio defined as the surface area of the first material land area percentage to the surface area of the second material land area percentage (measured along a respective vertical references axis) decreases from the striking surface imaginary vertical axis to the 0.5-inch vertical reference axis. This type of arrangement of the first material and the second material aid in providing consistent ball speeds across the striking surface as the average ratio along the striking surface imaginary vertical axis is greater (i.e. softer) than the average ratio along the 0.5 inch vertical reference axis. This counteracts the loss of energy transfer on heel and toe mishits.

Discrete Voids (Vertical Radiating Pattern)

FIGS. 20-23 illustrate another exemplary embodiment. More particularly, FIGS. 20-23 illustrate an example of a putter-type golf club head 600 comprising a dual-material striking surface 607 comprising a first material 609 and a second material 610. The golf club head 600 of FIGS. 20-23 and the above described golf club heads 100, 200, 300, 400, 500 are similar in many respects, except for that the golf club head 600 comprises discrete voids that extend substantially in a top rail-to-sole direction.

The putter-type golf club head of FIGS. 20-23 can comprises a putter-body (similar to the above mentioned putter bodies) having a toe portion, a heel portion opposite the toe portion, a top rail portion, a sole portion opposite the top rail portion, a portion of a striking surface, and a rear portion opposite the striking surface portion. The striking surface portion further defines a striking surface recess defined by the heel portion, the toe portion, the top rail portion, the sole portion, and the rear portion of the putter body.

FIGS. 20-23 illustrate a putter insert 624 comprising a first material 609 (also can be referred to as "first part") and a second material 610 (also can be referred to as "second part"). With specific reference to FIG. 20, the second part forms (or defines) a plurality of discrete concentric radiating voids 612. Each of the discrete concentric radiating voids have a common center at the striking surface geometric center 608.

The second material substantially surrounds the discrete concentric radiating voids to form second material land areas. The first part of the putter insert 624 comprises a plurality of discrete concentric radiating protrusions that are complimentary to a corresponding discrete concentric radiating void 612. By coupling, the first part and the second part together, the plurality of protruding discrete concentric radiating voids can be flush with the second material land areas (i.e. same planar surface). This allows the plurality of protruding discrete concentric radiating voids to form first material land areas. The first material has a hardness less than the second material. The first material land areas and the second material land engage with at least a portion of the golf ball upon golf ball impact.

This embodiment illustrates a possible arrangement where the discrete concentric radiating voids are arranged to increase in diameter outwardly and away from the striking surface geometric center 608. This forms a denser, more packed center region creating more first material land areas than second material land areas. This arrangement creates a center region having a greater amount of first material land areas than second material land area. Thereby, creating a center region that is less responsive to ball impacts relative to heel or toe regions. In a top rail to sole direction and in a heel to toe direction, the widths of the first material land areas are substantially the same or constant.

Moving away from the center region toward the heel or toe direction, the spacing distance between adjacent discrete concentric radiating voids increases. This creates more second material land areas, which aids in gradually creating a more responsive region away from the center region towards the heel and toe regions to consistently control ball speeds across the striking surface.

Figure 20:
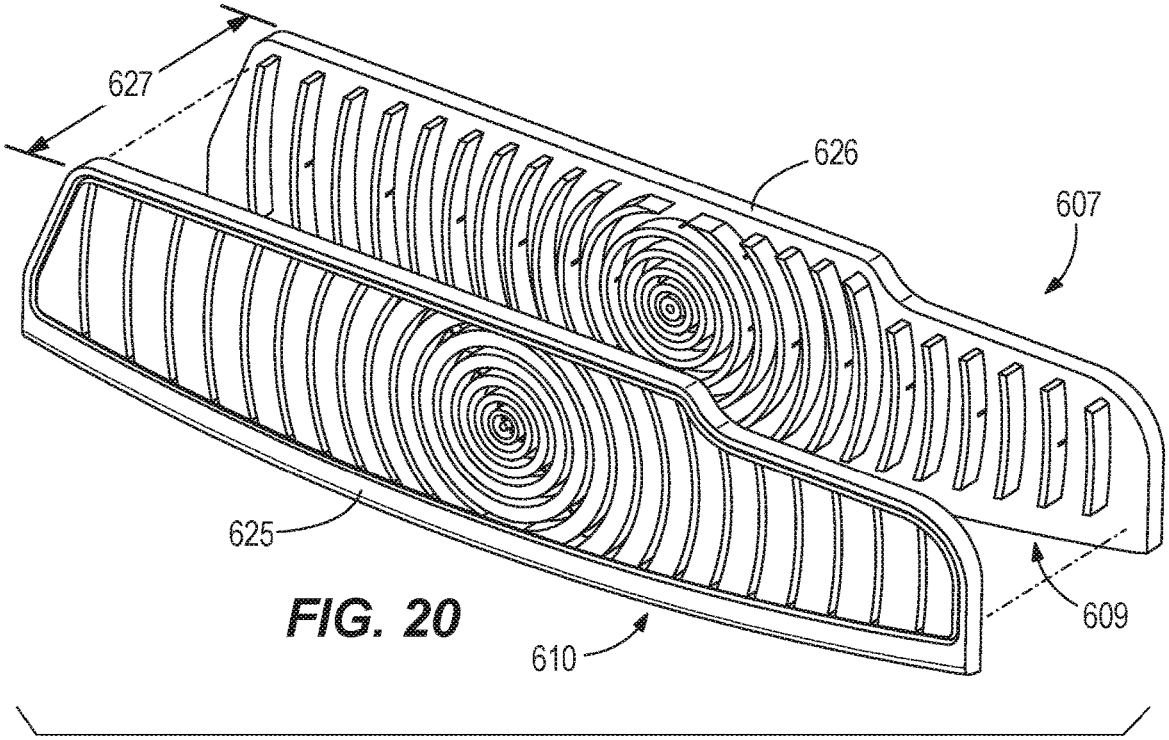
FIG. 20 shows an exploded view of an insert having discrete concentric radiating voids.

Referring to FIG. 20, FIG. 20 illustrates a perspective view of a putter insert 624. In many embodiments, the putter insert 624 can be received within and complementary with the striking surface recess. The putter insert 624 can comprise of a front surface 625 adapted for impact with a golf ball (not shown) and a rear surface 626 opposite the front portion.

A putter insert thickness 627 can be defined as the maximum perpendicular distance between the front surface 625 and the rear surface 626. For example, FIG. 20 illustrates the insert 624 having a plurality of discrete concentric radiating voids 612 (defined by the second material) extending entirely through the second material 610 thickness. In many embodiments, the first material, the second material, and/or the combination of the first and second material can be of a constant thickness.

Further, in many embodiments and as illustrated herein, the first material 609 entirely covers the rear surface 626 of the insert 624. In other words, the rear surface 626 is devoid of the second material 610. In many embodiments, the first material 609 further fully fills (or fully occupies) each discrete concentric radiating void (until flush with the front surface 625 of the insert) of the pluralities of discrete concentric radiating voids, so that at the front surface 625 the second material 610 surrounds the first material 609, so that upon golf ball impact the first material 609 and the second material 610 are engaged to least a portion of the golf ball.

In many embodiments, a majority of the discrete concentric radiating voids 612 vertically extend in a top rail-to-sole direction and connect to both an upper border 618 of the striking surface 607 and a lower border 619 of the striking surface 607. In many embodiments, where a discrete concentric radiating void 612 does not connect to the upper or lower border of the striking surface, a strut 636 or a string of struts 636 are needed to connect it directly or indirectly to a discrete concentric radiating void that is connected to an upper and lower border of the striking surface.

In many embodiments, the discrete concentric radiating voids 612 are concentric about the geometric center of the striking surface and can be either circular or arc-like. In a direction from the geometric center of the striking surface to the toe portion and from the geometric center of the striking surface to the heel portion, the diameter of the discrete concentric radiating voids increases. Stated another way, and in many embodiments, in a direction from the geometric center of the striking surface to the upper border of the striking surface and in a direction the geometric center of the striking surface to the lower border of the striking surface the diameter of the discrete concentric radiating voids increases.

As can be seen by FIGS. 20-23, not all the discrete concentric voids directly connect to the upper and lower border of the striking surface. To ensure that the first material fills the discrete concentric voids in the course of a manufacturing process (i.e. molding), the discrete concentric voids that do not directly connect to the upper and lower border of the striking surface, one or more struts 636 are needed. As can be seen by a combination of FIGS. 22 and 23, a plurality of struts are recessed inwardly from the front surface 625 of the striking surface 607. These struts enable the discrete concentric voids that are not connected to the upper and lower border of the striking surface to be indirectly connected to one or more discrete concentric voids connected to the upper and lower border of the striking surface.

In alternative embodiments of putter-type golf club heads having discrete concentric radiating voids 612, the second material 610 can define one or more discrete concentric radiating voids 612, two or more discrete concentric radiating voids 612, three or more discrete concentric radiating voids 612, four or more discrete concentric radiating voids 612, five or more discrete concentric radiating voids 612, six or more discrete concentric radiating voids 612, seven or more discrete concentric radiating voids 612, eight or more discrete concentric radiating voids 612, nine or more discrete concentric radiating voids 612, ten or more discrete concentric radiating voids 612, or eleven or more discrete concentric radiating voids 612, twelve or more discrete concentric radiating voids 612, thirteen or more discrete concentric radiating voids 612, fourteen or more discrete concentric radiating voids 612, fifteen or more discrete concentric radiating voids 612, sixteen or more discrete concentric radiating voids 612, seventeen or more discrete concentric radiating voids 612, eighteen or more discrete concentric radiating voids 612, nineteen or more discrete concentric radiating voids 612, twenty or more discrete concentric radiating voids 612, twenty-one or more discrete concentric radiating voids 612, twenty-two or more discrete concentric radiating voids 612, twenty-three or more discrete concentric radiating voids 612, twenty-four or more discrete concentric radiating voids 612, twenty-five or discrete concentric radiating voids 612, twenty-six or more discrete concentric radiating voids 612, twenty-seven or more discrete concentric radiating voids 612, twenty-eight or more discrete concentric radiating voids 612, twenty-nine or more discrete concentric radiating voids 612, or thirty or more discrete concentric radiating voids 612.

Each of the discrete concentric radiating voids 612 can have a constant width measured transversely in a heel-to-toe direction. In many embodiments, the width of the plurality of discrete concentric radiating voids can range between 0.020 inch to 0.060 inch. For example, the width of the plurality of discrete concentric radiating voids 612 can be approximately 0.020 inches, approximately, 0.021 inches, approximately 0.022 inches, approximately 0.023 inches, approximately 0.024 inches, approximately 0.025 inches, approximately 0.026 inches, approximately 0.027 inches, approximately 0.028 inches, approximately 0.029 inches, approximately 0.030 inches, approximately 0.031 inches, approximately 0.032 inches, approximately 0.033 inches, approximately 0.034 inches, approximately 0.035 inches, approximately 0.036 inches, approximately 0.037 inches, approximately 0.038 inches, approximately 0.039 inches, approximately 0.040 inches, approximately 0.041 inches, approximately 0.042 inches, approximately 0.043 inches, approximately 0.044 inches, approximately 0.045 inches, approximately 0.046 inches, approximately 0.047 inches, approximately 0.048 inches, approximately 0.049 inches, approximately 0.050 inches, approximately 0.051 inches, approximately 0.052 inches, approximately 0.053 inches, approximately 0.054 inches, approximately 0.055 inches, approximately 0.056 inches, approximately 0.057 inches, approximately 0.058 inches, approximately 0.059 inches, or approximately 0.060 inches. As will be further seen in the Examples section, variable width, variable depth, and or variable thickness voids are not required to achieve a consistent ball speed across the striking surface 607.

Figure 21:
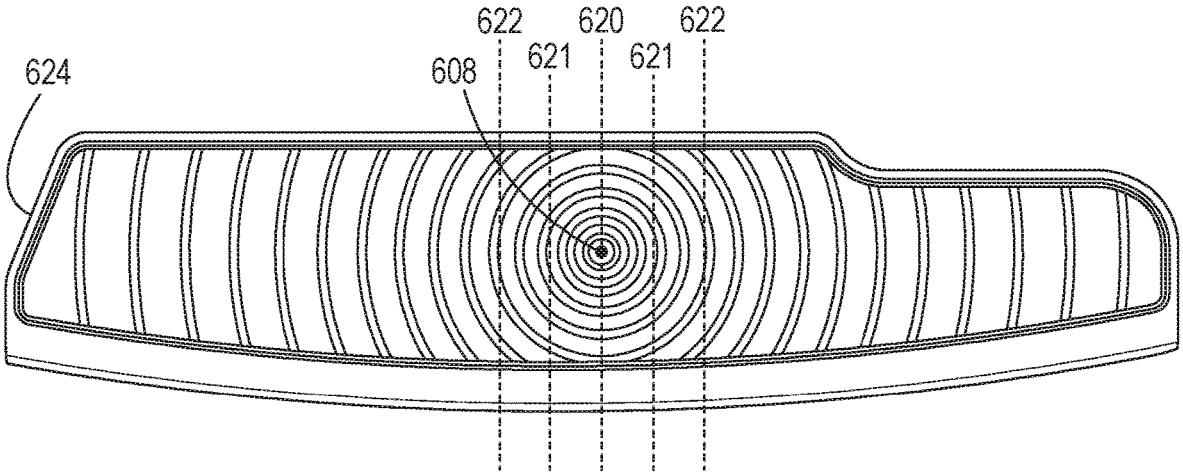
FIG. 21 shows an assembled face on view of the insert of FIG. 20.
Figure 22:
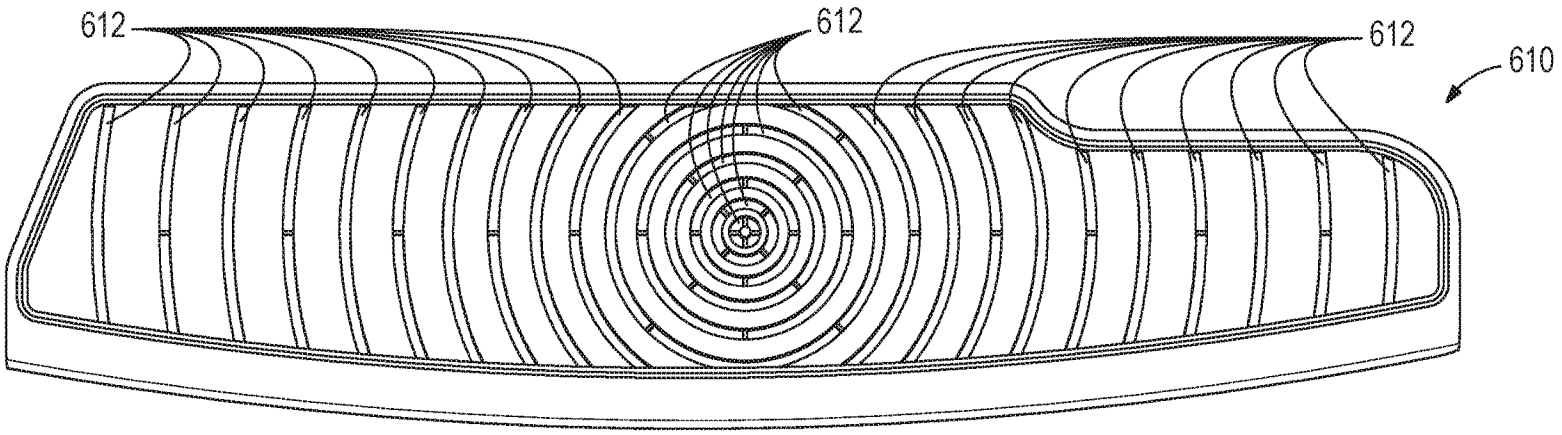
FIG. 22 shows a non-assembled face on view of the second material of FIG. 20.
Figure 23:
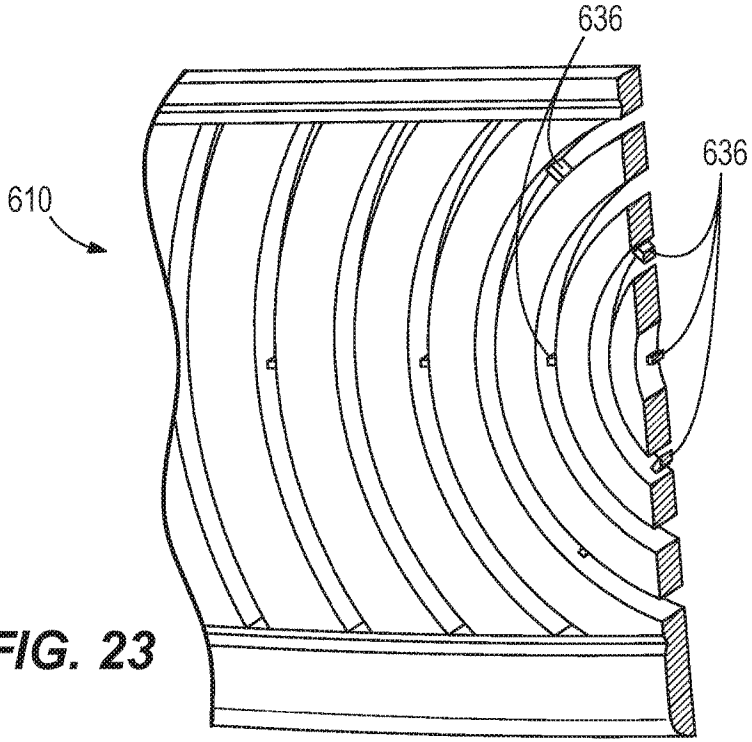
FIG. 23 shows a cross sectional view of FIG. 22.

In many of the discrete concentric radiating void embodiments and as described above when the club head is an address position the striking surface comprises a striking surface imaginary vertical axis 620 that extends through a geometric center 608 of the striking surface 607 in a top rail-to-sole direction (as shown by FIG. 21). Further, offset from the striking surface imaginary vertical axis in both a heel 603 and toe 602 direction at 0.25 inch and 0.50 inch are corresponding vertical reference axes.

As further illustrated in FIG. 21, adjacent discrete concentric radiating voids are closer to one another (i.e. packed more closely, small land area (or second material) area between voids) along the striking surface imaginary vertical axis 620 than at the vertical reference axis of 0.25 inch 621 and 0.5 inch 622. Similarly, adjacent discrete concentric radiating voids are closer to one another (i.e. packed more closely, smaller land (or second material) area between voids) at the vertical reference axis of 0.25 inch 621 than at the vertical reference axis of 0.5 inch 622.

In many of the discrete concentric radiating voids embodiments, the percentage of the first material (or first material land area) along the 0.5-inch vertical reference axis can between approximately 20% and 40%. For example, the percentage of the first material along the 0.5 inch vertical reference axis can be 20%, 21%, 22%, 23%, 24%, 25%, 26%, 27%, 28%, 29%, 30%, 31%, 32%, 33%, 34%, 35%, 36%, 37%, 38%, 39%, or 40%. For further example, the percentage of the first material along the 0.5 inch vertical reference axis can be greater than 20%, greater than 21%, greater than 22%, greater than 23%, greater than 24%, greater than 25%, greater than 26%, greater than 27%, greater than 28%, greater than 29%, greater than 30%, greater than 31%, greater than 32%, greater than 33%, greater than 34%, greater than 35%, greater than 36%, greater than 37%, greater than 38%, or greater than 39%. In alternative embodiments, the percentage of the first material along the 0.5 inch vertical reference axis can be less than 21%, less than 22%, less than 23%, less than 24%, less than 25%, less than 26%, less than 27%, less than 28%, less than 29%, less than 30%, less than 31%, less than 32%, less than 33%, less than 34%, less than 35%, less than 36%, less than 37%, less than 38%, less than 39%, or less than 40%, In many of the discrete concentric radiating voids, the percentage of the first material (or first material land area) along the 0.25-inch vertical reference axis can be between approximately 30% and 50%. For example, the percentage of the first material along the 0.25 inch vertical reference axis can be 30%, 31%, 32%, 33%, 34%, 35%, 36%, 37%, 38%, 39%, 40%, 41%, 42%, 43%, 44%, 45%, 46%, 47%, 48%, 49%, or 50%. For further example, the percentage of the first material along the 0.25 inch vertical reference axis can be greater than 30%, greater than 31%, greater than 32%, greater than 33%, greater than 34%, greater than 35%, greater than 36%, greater than 37%, greater than 38%, greater than 39%, greater than 40%, greater than 41%, greater than 42%, greater than 43%, greater than 44%, greater than 45%, greater than 46%, greater than 47%, greater than 48%, or greater than 49%. In alternative embodiments, the percentage of the first material along the 0.25 inch vertical reference axis can be less than 31%, less than 32%, less than 33%, less than 34%, less than 35%, less than 36%, less than 37%, less than 38%, less than 39%, less than 40%, less than 41%, less than 42%, less than 43%, less than 44%, less than 45%, less than 46%, less than 47%, less than 48%, less than 49%, or less than 50%, In many of the discrete concentric radiating voids embodiments, the percentage of the first material (or first material land area) along the striking surface imaginary axis can between approximately 40% and 60%. For example, the percentage of the first material along the striking surface imaginary axis can be 40%, 41%, 42%, 43%, 44%, 45%, 46%, 47%, 48%, 49%, 50%, 51%, 52%, 53%, 54%, 55%, 56%, 57%, 58%, 59%, or 60%. For further example, the percentage of the first material along the striking surface imaginary axis can be greater than 40%, greater than 41%, greater than 42%, greater than 43%, greater than 44%, greater than 45%, greater than 46%, greater than 47%, greater than 48%, greater than 49%, greater than 50%, greater than 51%, greater than 52%, greater than 53%, greater than 54%, greater than 55%, greater than 56%, greater than 57%, greater than 58%, or greater than 59%. In alternative embodiments, the percentage of the first material along the striking surface imaginary axis can be less than 41%, less than 42%, less than 43%, less than 44%, less than 45%, less than 46%, less than 47%, less than 48%, less than 49%, less than 50%, less than 51%, less than 52%, less than 53%, less than 54%, less than 55%, less than 56%, less than 57%, less than 58%, less than 59%, or less than 60%, Further, in many embodiments, the average ratio defined as the surface area of the first material land area percentage to the surface area of the second material land area percentage (measured along a respective vertical references axis) decreases from the striking surface imaginary vertical axis to the 0.5-inch vertical reference axis. This type of arrangement of the first material and the second material aid in providing consistent ball speeds across the striking surface as the average ratio along the striking surface imaginary vertical axis is greater (i.e. softer) than the average ratio along the 0.5 inch vertical reference axis. This counteracts the loss of energy transfer on heel and toe mishits.

Example 1

Example 1 shows that to select a threshold or desired ball speed across the striking surface, that both the length of the putt and the vertical land area percentage are important factors to consider. This Example generally corresponds to the continuous groove embodiments of FIGS. 1-9.

Figure 4:
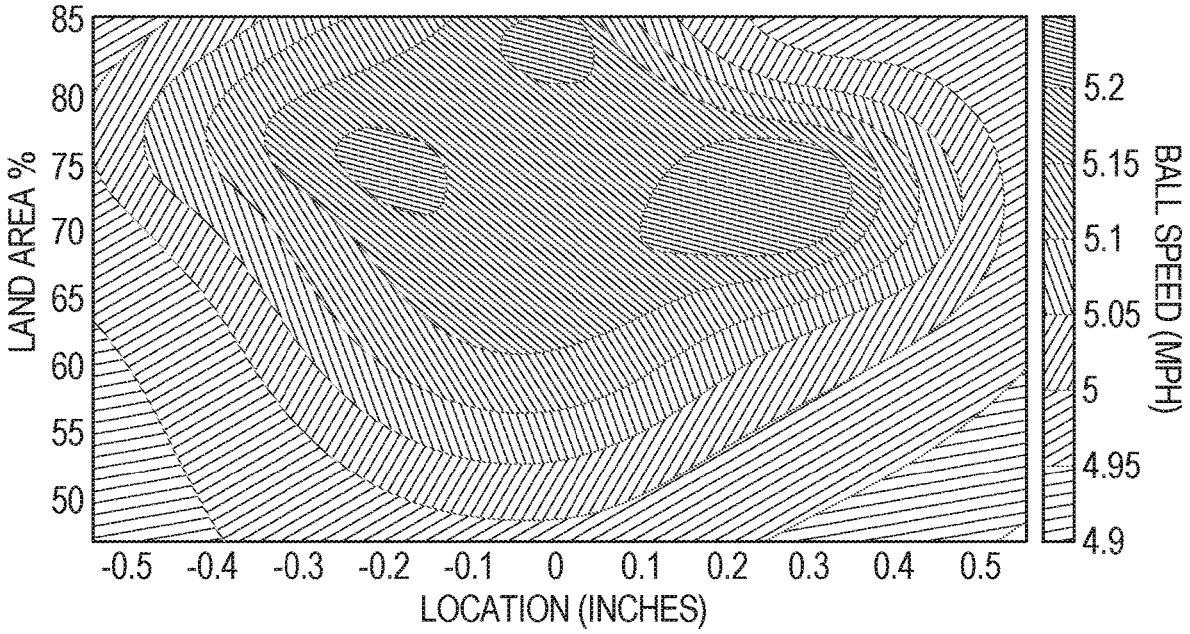
FIG. 4 shows a seven variable gradient map that compares ball speed, impact location, and the land area percentage for putts of 10 feet in length.

FIG. 4 illustrates a seven variable gradient map that details for various impact locations the vertical required land area percentage (or percentage of the second material) needed to achieve a consistent ball speed for putts of approximately 10 ft in length. For example, if a desired ball speed for a 10 ft putt of 5.15 mph is desired, the second material vertical land area percentage at the 0.5 inch vertical reference axis 122 offset from the striking surface imaginary vertical axis 120 is approximately 76%. The second material vertical land area percentage at the 0.25 inch vertical reference axis 121 offset from the striking surface imaginary vertical axis 122 is approximately 58%. The second material vertical land area percentage at the striking surface imaginary vertical axis 120 is approximately 53%.

If a desired ball speed for a 10 ft putt of 5.10 mph is desired, the second material vertical land area percentage at the 0.5 inch vertical reference axis 122 offset from the striking surface imaginary vertical axis 120 is approximately 73%. The second material vertical land area percentage at the 0.25 inch vertical reference axis 121 offset from the striking surface imaginary vertical axis 120 is approximately 55%. The second material vertical land area percentage at the striking surface imaginary vertical axis 120 is approximately 50%.

If a desired ball speed for a 10 ft putt of 5.05 mph is desired, the second material vertical land area percentage at the 0.5 inch vertical reference axis 122 offset from the striking surface imaginary vertical axis 120 is approximately 67%. The second material vertical land area percentage at the 0.25 inch vertical reference axis 121 offset from the striking surface imaginary vertical axis 120 is approximately 50%. The second material vertical land area percentage at the striking surface imaginary vertical axis 120 is approximately 46%.

Figure 5:
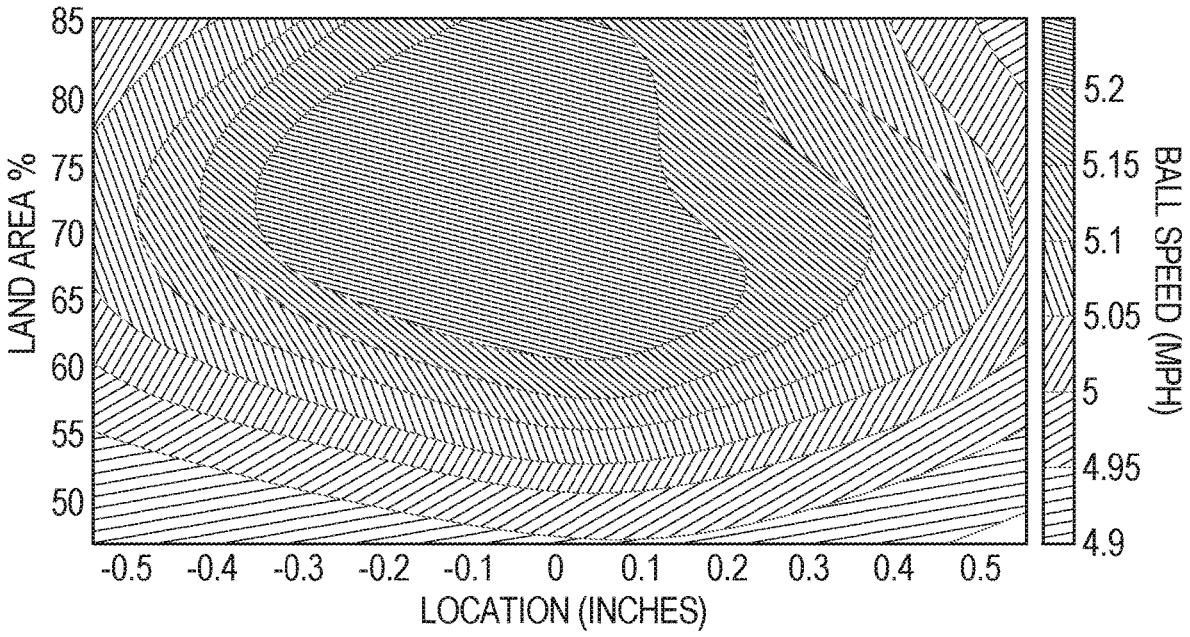
FIG. 5 shows a seven variable gradient map that compares ball speed, impact location, and the land area percentage for putts of 25 ft in length.

For further example, FIG. 5 illustrates another seven variable gradient map that details for various impact locations the required land area needed to achieve a consistent ball speed for putts of approximately 25 feet in length. If a desired ball speed for a 25 ft putt of 7.73 mph is desired, the second material vertical land area percentage at the 0.5 inch vertical reference axis 122 laterally offset from the striking surface imaginary vertical axis 120 is approximately 65%. The second material vertical land area percentage at the 0.25 inch vertical reference axis 121 laterally offset from the striking surface imaginary vertical axis 120 is approximately 58%. The second material vertical land area percentage at the striking surface imaginary vertical axis 120 is approximately 55%.

If a desired ball speed for a 25 ft putt of 7.68 mph is desired, the second material vertical land area percentage at the 0.5 inch vertical reference axis 122 laterally offset from the striking surface imaginary vertical axis 120 is approximately 60%. The second material vertical land area percentage at the 0.25 inch vertical reference axis 121 laterally offset from the striking surface imaginary vertical axis 120 is approximately 56%. The second material vertical land area percentage at the striking surface imaginary vertical axis 120 is 53%.

If a desired ball speed for a 25 ft putt of 7.60 mph is desired, the second material vertical land area percentage at the 0.5 inch vertical reference axis 122 laterally offset from the striking surface imaginary vertical axis 120 is approximately 55%. The second material vertical land area percentage at the 0.25 inch vertical reference axis 121 laterally offset from the striking surface imaginary vertical axis 120 is approximately 51%. The second material vertical land area percentage at the striking surface imaginary vertical axis 120 is approximately 48%.

The seven variable gradient map of FIG. 4 and FIG. 5 are based upon the second material being generally composed of metal, for example, 17-4 stainless steel and the first material being generally composed of air. The percentage or relationship between the first material and the second material will vary based upon the type of selected material but the application of controlling the ratio or relationship between the first material and the second material still applies to achieve consistent ball speed.

Example 2

For many of the above described embodiments, the first material hardness and first material land area percentage characteristics were altered to fully understand the effect that these variables have on ball speed. Specifically, a putter-pendulum test was conducted to measure the ball speed for ten putters. The below table illustrates the material characteristics of the exemplary striking surface tested. Ball speed data was captured at the striking surface imaginary vertical axis, at the heel vertical reference axis at 0.5 inches, and at the toe vertical reference axis at 0.5 inches.

Figure 24:
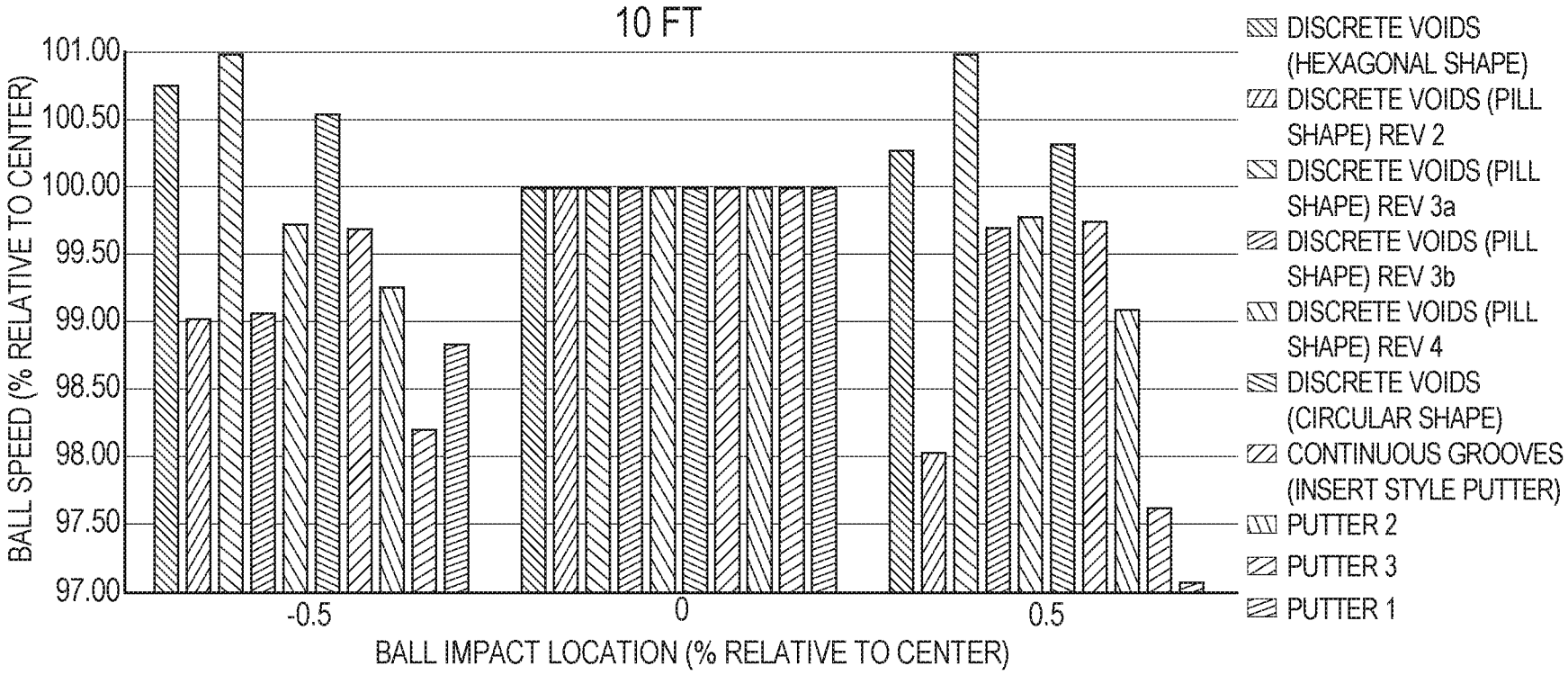
FIG. 24 shows a bar graph that compares the ball speed and ball impact location for various exemplary putter embodiments for putts of 10 feet in length.
Figure 25:
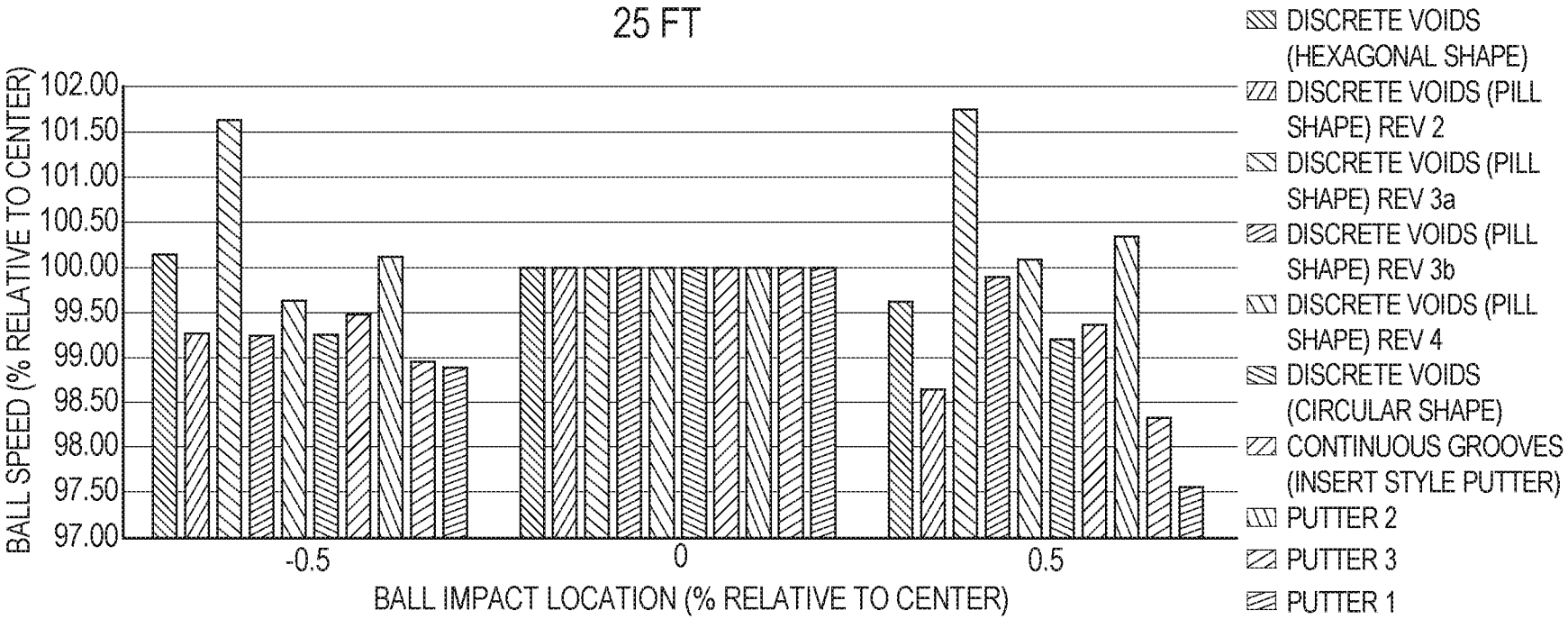
FIG. 25 shows a bar graph that compares the ball speed and ball impact location for various exemplary putter embodiments for putts of 25 feet in length.
Figure 26:
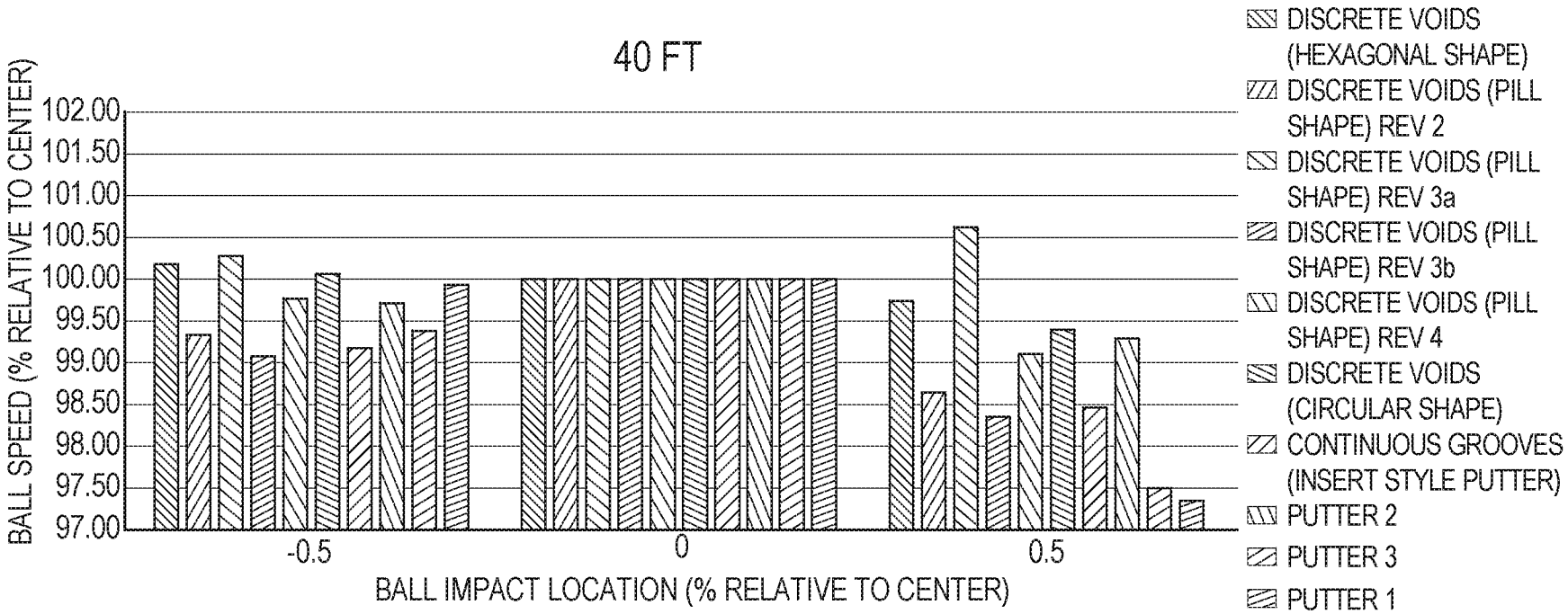
FIG. 26 shows a bar graph that compares the ball speed and ball impact location for various exemplary putter embodiments for putts of 25 feet in length.

The exemplary striking surfaces were further benchmarked against a first commercialized putter with polymer fill grooves but grooves not having less groove spacing in the center (Putter 1), a second commercialized putter having a groove concentration greater in the middle but devoid of a second material (Putter 2), and a third commercialized putter having a striking surface devoid of grooves (Putter 3). The results can be seen in FIGS. 24-26 and the data was plotted as a percentage of ball speed relative to its own center for 10 ft putts, 25 ft putts, and 40 ft putts.

TABLE 1

| Putter | Second Material Hardness | First Material Hardness | Percentage of First Material Land Area @ the heel vertical reference axis at 0.5 inch | Percentage of First Material Land Area @ the heel vertical reference axis at 0.25 inch | Percentage of First Material Land Area @ the striking surface imaginary vertical axis | Percentage of First Material Land Area @ the toe vertical reference axis at 0.25 inch | Percentage of First Material Land Area @ the toe vertical reference axis at 0.5 inch |
|---|---|---|---|---|---|---|---|
| Discrete Voids (Hexagonal Shape) | 85 D | 50 A | 31% | 47% | 55% | 47% | 31% |
| Discrete Voids (Pill Shape) Rev 2 | 85 D | 80 A | 32% | 36% | 42% | 36% | 32% |
| Discrete Voids (Pill Shape) Rev 3a | 85 D | 40 A | 30% | 44% | 53% | 44% | 30% |
| Discrete Voids (Pill Shape) Rev 3b | 85 D | 90-95 A | 30% | 44% | 53% | 44% | 30% |
| Discrete Voids (Pill Shape) Rev 4 | 85 D | 65 A | 30% | 41% | 49% | 41% | 30% |
| Discrete Voids (Circular Shape) | 85 D | 64 A | 32% | 41% | 49% | 41% | 32% |

TABLE 1-continued

| Putter | Second Material Hardness | First Material Hardness | Percentage of First Material Land Area @ the heel vertical reference axis at 0.5 inch | Percentage of First Material Land Area @ the heel vertical reference axis at 0.25 inch | Percentage of First Material Land Area @ the striking surface imaginary vertical axis | Percentage of First Material Land Area @ the toe vertical reference axis at 0.25 inch | Percentage of First Material Land Area @ the toe vertical reference axis at 0.5 inch |
|---|---|---|---|---|---|---|---|
| Continuous Grooves (Insert Style Putter) | 85 D | 63 A | 32% | 41% | 49% | 41% | 32% |

The results show that the first material hardness, the second material hardness, and the percentage of the first material along a vertical references axis at specified locations are important factors to consider when a uniform ball speed across a striking surface is desired. For example, when comparing the Discrete Voids (Pill Shaped) Rev 3A and the Discrete Voids (Pill Shaped) Rev 3B putter characteristics, it can be seen that the putters were built the same except for the first material hardness being different. In a 25 ft putt comparison, it can be seen that ball speed on heel and toe hits (relative to center impacts) on the Discrete Voids (Pill Shaped) Rev 3A putter varied approximately 1.6% more than the ball speed produced at the striking surface center. However, the Discrete Voids (Pill Shaped) Rev 3B putter varied no more than 0.8% than the ball speed produced at the center of the striking surface. This led to the conclusion that the relationship/difference between the first material and the second material hardness is an important factor to consider to effectively control ball speeds.

Additionally, this example led to the conclusion that the percentage of the first material along a vertical reference axis (at specified locations) matters. For example, when comparing the Discrete Voids (Pill Shaped) Rev 4 Putter and the Discrete Voids (Circular Shape) Putter, the first and second material hardness's were substantially the same, but the percentage of the first material along the striking surface varied. Upon off-center impacts, the Discrete Voids (Pill Shaped) Rev 4 Putter varied no more than 0.4% than the ball speed produced at the striking surface center. The Discrete Voids (Circular Shaped) varied approximately 0.8% upon off center strikes when compared to the ball speed produced at the striking surface center. Therefore, when controlling ball speed produced across the striking surface, the percentage of the first material along a vertical reference axis is another important variable to help create an even hitting surface heel-to-toe.

The invention claimed is:

1. A putter-type golf club head comprising:

a body comprising:

a heel portion;

a toe portion opposite from the heel portion;

a top rail;

a sole portion opposite from the top rail; and a striking surface forming a recess defined by the heel portion, the toe portion, the top rail, and the sole portion of the body;

a striking surface first imaginary vertical axis that extends through a geometric center of the striking surface, the striking surface first imaginary vertical axis extends in a top rail to sole portion direction, a second imaginary vertical axis and a third imaginary vertical axis extending in the top rail to sole portion direction that are offset 0.5 inch from the geometric center in heel portion and toe portion directions respectively; and an insert configured to be received within and complimentary with the recess defined by the striking surface; wherein:

the striking surface defines an upper border adjacent the top rail, and a bottom border adjacent the sole portion;

the insert comprises a front surface adapted to impact a golf ball and a rear surface opposite the front surface, and a thickness defined as a distance between the front surface and the rear surface;

the insert comprises a first material forming the rear surface and a second material forming a portion of the front surface;

the front surface defines a first plurality of continuous groove recesses, a second plurality of arcuate continuous groove recesses, and a third plurality of arcuate continuous groove recesses forming non-ball contact areas of the striking surface;

wherein the first plurality of continuous groove recesses, the second plurality of arcuate continuous groove recesses, and the third plurality of arcuate continuous groove recesses extend across the striking surface first imaginary vertical axis;

wherein each of the first plurality of continuous groove recesses comprises an arcuate portion extending across the first striking surface imaginary vertical axis;

a width of each of the first plurality of continuous groove recesses, the second plurality of arcuate continuous groove recesses, and the third plurality of arcuate continuous groove recesses, measured in a top rail to sole direction, is constant across the striking surface in a heel portion to toe portion direction;

wherein each of the first plurality of continuous groove recesses comprises a first linear portion proximal to the heel portion and a second linear portion proximal to the toe portion;

wherein the second plurality of arcuate continuous groove recesses and the third plurality of arcuate continuous groove recesses each comprise a first end and a second end;

wherein the first end and the second end of each of the second plurality of arcuate continuous groove recesses are connected to the striking surface upper border;

wherein the first ends and the second ends of each of the third plurality of arcuate continuous groove recesses are connected to the striking surface bottom border; and wherein more continuous groove recesses are within an area bounded by the second and third imaginary vertical axes than outside the area bounded by the second and third imaginary vertical axes.

2. The putter-type golf club head of claim 1, wherein the first material of the insert entirely covers the rear surface of the insert and fills the first plurality of continuous groove recesses, the second plurality of arcuate continuous groove recesses, and the third plurality of arcuate continuous groove recesses.

3. The putter-type golf club head of claim 1, wherein the first material comprises a first hardness, the second material comprises a second hardness, and the first hardness is less than the second hardness.

4. The putter-type golf club head of claim 1, wherein the putter type golf club head comprises a loft angle less than 7 degrees.

5. The putter-type golf club head of claim 1, further comprising a plurality of land areas between the first plurality of continuous groove recesses, the second plurality of arcuate continuous groove recesses, and the third plurality of arcuate continuous groove recesses, the land areas forming ball contact areas of the striking surface.

6. A putter-type golf club head comprising:

a body comprising:

a heel portion;

a toe portion opposite from the heel portion;

a top rail;

a sole portion opposite from the top rail; and a striking surface forming a recess defined by the heel portion, the toe portion, the top rail, and the sole portion of the body;

a striking surface first imaginary vertical axis that extends through a geometric center of the striking surface, the striking surface first imaginary vertical axis extends in a top rail to sole portion direction, a second imaginary vertical axis and a third imaginary vertical axis extending in the top rail to sole portion direction that are offset 0.5 inch from the geometric center in heel portion and toe portion directions respectively; and an insert configured to be received within and complimentary with the recess defined by the striking surface;

wherein:

the striking surface defines an upper border adjacent the top rail, and a bottom border adjacent the sole portion;

the insert comprises a front surface adapted to impact a golf ball and a rear surface opposite the front surface, and a thickness defined as a distance between the front surface and the rear surface;

the insert comprises a first material forming the rear surface and a second material forming a portion of the front surface;

the front surface defines a first plurality of continuous groove recesses, a second plurality of arcuate continuous groove recesses, and a third plurality of arcuate continuous groove recesses forming non-ball contact areas of the striking surface;

wherein each of the first plurality of continuous groove recesses, the second plurality of arcuate continuous groove recesses, and the third plurality of arcuate continuous groove recesses extend across the striking surface first imaginary vertical axis;

wherein each of the first plurality of continuous groove recesses comprises an arcuate portion extending across the first striking surface imaginary vertical axis;

a width of the first plurality of continuous groove recesses, the second plurality of arcuate continuous groove recesses, and the third plurality of arcuate continuous groove recesses, measured in a top rail to sole direction, is constant across the striking surface in a heel portion to toe portion direction;

wherein each of the first plurality of continuous groove recesses comprises a first linear portion proximal to the heel portion and a second linear portion proximal to the toe portion;

the insert defines a plurality of land areas between the first plurality of continuous groove recesses, the second plurality of arcuate continuous groove recesses, and the third plurality of arcuate continuous groove recesses, the land areas forming ball contact areas of the striking surface;

a width of the land areas, measured in a top rail to sole direction, varies across the striking surface in a heel portion to toe portion direction;

wherein the second plurality of arcuate continuous groove recesses and the third plurality of arcuate continuous groove recesses each comprise a first end and a second end;

wherein the first ends and the second ends of the second plurality of arcuate continuous groove recesses are connected to the striking surface upper border;

wherein the first ends and the second ends of the third plurality of arcuate continuous groove recesses are connected to the striking surface bottom border; and wherein more continuous groove recesses are within an area bounded by the second and third imaginary vertical axes than outside the area bounded by the second and third imaginary vertical axes.

7. The putter-type golf club head of claim 6, wherein the first material of the insert entirely covers the rear surface of the insert and fills the first plurality of continuous groove recesses, the second plurality of arcuate continuous groove recesses, and the third plurality of arcuate continuous groove recesses.

8. The putter-type golf club head of claim 6, wherein the first material comprises a first hardness, the second material comprises a second hardness, and the first hardness is less than the second hardness.

9. The putter-type golf club head of claim 6, wherein the putter type golf club head comprises a loft angle less than 7 degrees.

10. The putter-type golf club head of claim 6, wherein the width of the land areas increase in a direction extending from the first striking surface imaginary vertical axis to at least one of the heel portion and the toe portion.

11. The putter-type golf club head of claim 7, wherein the first material fills the first plurality of continuous groove recesses, the second plurality of arcuate continuous groove recesses, and the third plurality of arcuate continuous groove recesses to form a plurality of second land areas; and wherein a width of the second land areas, measured in a top rail to sole direction, is greater than the width of the land areas at the striking surface first imaginary vertical axis.

12. A putter-type golf club head comprising:

a body comprising:

a heel portion;

a toe portion opposite from the heel portion;

a top rail;

a sole portion opposite from the top rail; and a striking surface forming a recess defined by the heel portion, the toe portion, the top rail, and the sole portion of the body;

a striking surface first imaginary vertical axis that extends through a geometric center of the striking surface, the striking surface first imaginary vertical axis extends in a top rail to sole portion direction, a second imaginary vertical axis and a third imaginary vertical axis extending in the top rail to sole portion direction that are offset 0.5 inch from the geometric center in heel portion and toe portion directions respectively; and an insert configured to be received within and complimentary with the recess defined by the striking surface; wherein:

the insert comprises a front surface adapted to impact a golf ball and a rear surface opposite the front surface, and a thickness defined as a distance between the front surface and the rear surface;

the insert comprises a first material forming the rear surface and a second material forming a portion of the front surface;

the front surface defines a first plurality of continuous groove recesses, a second plurality of arcuate continuous groove recesses, and a third plurality of arcuate continuous groove recesses forming non-ball contact areas of the striking surface;

wherein the first plurality of continuous groove recesses, the second plurality of arcuate continuous groove recesses, and the third plurality of arcuate continuous groove recesses extend across the striking surface first imaginary vertical axis;

wherein each of the first plurality of continuous groove recesses comprises an arcuate portion extending across the first striking surface imaginary vertical axis;

a width of each of the first plurality of continuous groove recesses, the second plurality of arcuate continuous groove recesses, and the third plurality of arcuate continuous groove recesses, measured in a top rail to sole direction, is constant across the striking surface in a heel portion to toe portion direction;

wherein each of the first plurality of continuous groove recesses comprises a first linear portion proximal to the heel portion and a second linear portion proximal to the toe portion;

wherein more continuous groove recesses are within an area bounded by the second and third imaginary vertical axes than outside the area bounded by the second and third imaginary vertical axes;

the insert defines a plurality of first land areas between the first plurality of continuous groove recesses, the second plurality of arcuate continuous groove recesses, and the third plurality of arcuate continuous groove recesses, the first land areas are formed by the second material;

a width of the first land areas, measured in a top rail to sole direction, varies across the striking surface in a heel portion to toe portion direction;

the first material of the insert entirely covers the rear surface of the insert and fills each continuous groove recess to form a plurality of second land areas; and the first land areas and the second land areas are adapted to impact the golf ball.

13. The putter-type golf club head of claim 12, wherein the striking surface defines an upper border adjacent the top rail and a bottom border adjacent the sole portion; wherein each of the second plurality of arcuate continuous groove recesses comprises a first end and a second end; and wherein the first end and the second end of at least one continuous groove recess is connected to the upper border.

14. The putter-type golf club head of claim 12, wherein the striking surface defines an upper border adjacent the top rail and a bottom border adjacent the sole portion; wherein each of the third plurality of arcuate continuous groove recesses comprises a first end and a second end; and wherein the first end and the second end of at least one continuous groove recess is connected to the bottom border.

15. The putter-type golf club head of claim 12, wherein the first material comprises a first hardness, the second material comprises a second hardness, and the first hardness is less than the second hardness.

16. The putter-type golf club head of claim 12, wherein the putter type golf club head comprises a loft angle less than 7 degrees.

17. The putter-type golf club head of claim 12, wherein the width of the first land areas increase in a direction extending from the striking surface first imaginary vertical axis to at least one of the toc portion and the heel portion.

* * * * *